US011313128B2

(12) United States Patent
Mongelluzzo et al.

(10) Patent No.: US 11,313,128 B2
(45) Date of Patent: Apr. 26, 2022

(54) DEBRIS COLLECTOR FOR ROOF GUTTER SYSTEMS

(71) Applicant: Unclutter Gutter, LLP, East Quogue, NY (US)

(72) Inventors: Michael Mongelluzzo, East Quogue, NY (US); James Bergdoll, East Setauket, NY (US)

( * ) Notice: Subject to any disclaimer, the term of this patent is extended or adjusted under 35 U.S.C. 154(b) by 0 days.

(21) Appl. No.: 16/730,299

(22) Filed: Dec. 30, 2019

(65) Prior Publication Data

US 2020/0256059 A1 Aug. 13, 2020

Related U.S. Application Data

(63) Continuation-in-part of application No. 16/259,218, filed on Jan. 28, 2019, now Pat. No. 10,526,788, which is a continuation of application No. 15/996,122, filed on Jun. 1, 2018, now Pat. No. 10,190,319, which is a continuation-in-part of application No. 15/837,962, filed on Dec. 11, 2017, now abandoned.

(60) Provisional application No. 62/529,908, filed on Jul. 7, 2017.

(51) Int. Cl.

| | |
|---|---|
| ***E04D 13/076*** | (2006.01) |
| ***F21V 33/00*** | (2006.01) |
| *F21Y 115/10* | (2016.01) |
| *F21Y 103/10* | (2016.01) |

(52) U.S. Cl.

CPC ..... *E04D 13/076* (2013.01); *E04D 13/0765* (2013.01); *F21V 33/006* (2013.01); *F21Y 2103/10* (2016.08); *F21Y 2115/10* (2016.08)

(58) Field of Classification Search

CPC ..... E04D 13/076; E04D 13/0765

See application file for complete search history.

(56) References Cited

U.S. PATENT DOCUMENTS

| | | | | | |
|---|---|---|---|---|---|
| 2,841,100 | A * | 7/1958 | Moller | E04D 13/076 | 210/474 |
| 3,204,090 | A * | 8/1965 | Kvarda, Jr. | F21S 4/20 | 362/249.01 |
| 3,325,038 | A * | 6/1967 | Ferney | E04D 13/08 | 52/11 |
| 3,420,378 | A * | 1/1969 | Turner | E04D 13/076 | 210/474 |
| 3,601,835 | A * | 8/1971 | Morgan | E04D 13/0765 | 15/25 |
| 3,630,383 | A * | 12/1971 | Reeves | B01D 29/01 | 210/404 |
| 3,740,787 | A * | 6/1973 | Bowermaster | E04D 13/076 | 15/105 |
| 3,834,091 | A * | 9/1974 | Dugan | E04D 13/076 | 52/12 |

(Continued)

*Primary Examiner* — Rodney Mintz

(74) *Attorney, Agent, or Firm* — Feldman Law Group

(57) ABSTRACT

An apparatus for catching debris that includes a collection assembly. The collection assembly including a screen section. The screen section including a plurality of diverters configured to break water tension and slow water flow as water flows over the plurality of diverters from a roof surface. The plurality of diverters being spaced apart from one another in such a way that the slowed water is capable of draining into a gutter system from the screen section.

16 Claims, 80 Drawing Sheets

(56) References Cited

U.S. PATENT DOCUMENTS 3,864,267 A * 2/1975 Nelems ..... B01D 35/00 210/474
3,977,135 A * 8/1976 Hunley, Jr. ..... E04D 13/076 52/12
4,032,456 A * 6/1977 Berce ..... B01D 35/00 210/474
4,351,134 A * 9/1982 Clarkson ..... E04D 13/076 210/474
4,418,504 A * 12/1983 Lassiter ..... E04D 13/076 210/474
4,467,570 A * 8/1984 Kriegel ..... E04D 13/076 210/162
4,631,875 A * 12/1986 Olson ..... E04D 13/064 248/48.2
4,727,689 A * 3/1988 Bosler ..... E04D 13/076 52/11
4,745,710 A * 5/1988 Davis ..... E04D 13/076 210/473
5,056,276 A * 10/1991 Nielsen ..... E04D 13/076 52/12
5,586,837 A * 12/1996 Udelle ..... E04D 13/076 405/118
5,640,810 A * 6/1997 Pietersen ..... E04D 13/076 210/474
5,727,350 A * 3/1998 Marcella ..... E04D 13/0765 134/166 R
5,729,931 A * 3/1998 Wade ..... E04D 13/076 52/12
5,875,590 A * 3/1999 Udelle ..... E04D 13/076 52/16
5,989,357 A * 11/1999 Vilhauer, Jr. ..... E04D 13/076 134/104.1
6,019,488 A * 2/2000 Hastings ..... F21V 15/01 362/152
6,050,709 A * 4/2000 Hastings ..... F21V 17/007 362/145
6,067,755 A * 5/2000 Maanum ..... E04D 13/076 248/48.1
6,164,020 A * 12/2000 Nitch ..... E04D 13/076 52/11
6,393,770 B1 * 5/2002 Groom ..... E04D 13/076 52/12
6,493,994 B1 * 12/2002 Lucas ..... E04D 13/076 210/477
6,598,352 B2 * 7/2003 Higginbotham ..... E04D 13/076 210/474
6,955,458 B2 * 10/2005 Cheema ..... F21V 33/006 362/145
7,581,356 B1 * 9/2009 Balkum ..... E04D 13/076 52/11
7,628,911 B2 * 12/2009 Koenig ..... E04D 13/076 134/166 R
8,001,729 B2 * 8/2011 Joly, Jr. ..... E04D 13/076 52/12
8,037,641 B2 * 10/2011 Gerig ..... E04D 13/076 52/12
8,250,813 B2 * 8/2012 Robins ..... E04D 13/076 52/12
9,021,748 B2 * 5/2015 Nelson ..... E04D 13/064 52/12
9,683,371 B1 * 6/2017 Nitch ..... E04D 13/064
9,725,909 B2 * 8/2017 Ward ..... E04D 13/0765
9,834,936 B2 * 12/2017 Lenney ..... E04B 1/92
9,863,150 B2 * 1/2018 Lenney ..... E04D 13/076
10,174,505 B1 * 1/2019 Hicks ..... E04D 13/076
10,190,319 B1 * 1/2019 Mongelluzzo ..... F21V 33/006
10,344,481 B2 * 7/2019 Song ..... E04D 13/064
10,519,668 B1 * 12/2019 Bachman ..... E04D 13/076
10,526,788 B2 * 1/2020 Mongelluzzo ..... F21V 33/006
10,982,447 B2 * 4/2021 Sager ..... E04D 13/0481
2003/0046876 A1 * 3/2003 Higginbotham ..... E04D 13/076 52/11
2003/0070366 A1 * 4/2003 Beyers ..... E04D 13/076 52/12
2004/0255522 A1 * 12/2004 Knudson ..... E04D 13/0459 52/11
2004/0257801 A1 * 12/2004 Cheema ..... F21S 4/20 362/152
2006/0075689 A1 * 4/2006 Hawash ..... E04D 13/076 52/12
2007/0234648 A1 * 10/2007 Tombazzi ..... E04D 13/076 52/12
2009/0320381 A1 * 12/2009 Gerig ..... E04D 13/076 52/12
2010/0071273 A1 * 3/2010 Joly, Jr. ..... E04D 13/076 52/12
2010/0281785 A1 * 11/2010 Kaiser ..... E04D 13/00 52/24
2011/0000143 A1 * 1/2011 Kaiser ..... E04D 13/00 52/24
2011/0067318 A1 * 3/2011 Lenney ..... E04D 13/076 52/12
2011/0107683 A1 * 5/2011 Ringuette ..... E04D 13/076 52/12
2011/0265391 A1 * 11/2011 Robins ..... E04D 13/0725 52/12
2012/0047817 A1 * 3/2012 Prentice ..... H02S 20/23 52/11
2013/0055648 A1 * 3/2013 Snyder ..... E06C 7/486 52/11
2013/0097943 A1 * 4/2013 Higginbotham ..... E04D 13/064 52/12
2015/0040488 A1 * 2/2015 Lenney ..... E04D 13/076 52/12
2016/0168856 A1 * 6/2016 Lenney ..... E04D 13/0404 52/12
2017/0058530 A1 * 3/2017 Ward ..... E04D 13/0767
2017/0204612 A1 * 7/2017 Lenney ..... E04D 13/076
2019/0010704 A1 * 1/2019 Mongelluzzo ..... E04D 13/0765
2019/0010705 A1 * 1/2019 Mongelluzzo ..... E04D 13/0765
2019/0017274 A1 * 1/2019 Song ..... E04D 13/0762
2019/0153731 A1 * 5/2019 Mongelluzzo ..... E04D 13/0765
2019/0352912 A1 * 11/2019 Sager ..... E04D 13/0481
2020/0308839 A1 * 10/2020 Neeb ..... E04D 13/076
2021/0270041 A1 * 9/2021 Mischker ..... E04D 13/076

* cited by examiner

10

DEBRIS COLLECTOR FOR ROOF GUTTER SYSTEMS

CROSS-REFERENCE TO RELATED APPLICATIONS

This application is a continuation-in-part of U.S. patent application Ser. No. 16/259,218, filed Jan. 28, 2019, which is a continuation of U.S. patent application Ser. No. 15/996,122, filed Jun. 1, 2018, now U.S. Pat. No. 10,190,319, which is a continuation-in-part of U.S. patent application Ser. No. 15/837,962, filed Dec. 11, 2017, now abandoned, and claims the benefit of U.S. provisional patent application Ser. No. 62/529,908, filed on Jul. 7, 2017, which patent applications are incorporated here by reference in their entirety to provide continuity of disclosure.

BACKGROUND

In a downpour, a clogged roof gutter can send a cascade of water down the side of a house, making canyons of flowerbeds and saturating a home's foundation. Clean gutters protect your siding and landscape plantings and prevent thousands of dollars of damage to a home's foundation. Therefore, it is in a homeowner's best interest to clean gutters of leaves and debris to help prevent damage and to head off expensive water damage repairs to a home.

Gutters should be cleaned at least once a year—twice a year if you have overhanging trees and more often if big storms are regular occurrence in the area of the home. The typical way to clean gutters is time-consuming and potentially dangerous as it entails donning proper cloths and gloves, climbing a ladder with a small plastic scoop in hand and clearing and removing leaves and debris. Afterwards, the gutters and downspouts should be flushed with a garden hose. If climbing ladders is not a task a homeowner can handle, a professional can be hired to do the job at a large expense.

A homeowner can slow clogging by installing gutter covers in the form of mesh screens, clip-on grates, or porous foam. However, these gutter covers also need maintenance, which is also time-consuming and potentially dangerous, at regular intervals to keep them clear.

SUMMARY

The disclosed technology is a debris collector for roof gutters that allows debris to collect and, using a poling tool and a hose from a ground level, the debris collector can be inverted, emptied and cleaned. This saves time, money and avoids the use of a ladder.

In one implementation, an apparatus for catching debris can comprise: a collection assembly, the collection assembly including a screen section, the screen section including a plurality of diverters configured to break water tension and slow water flow as water flows over the plurality of diverters from a roof surface, the plurality of diverters being spaced apart from one another in such a way that the slowed water is capable of draining into a gutter system from the screen section.

In some implementations, the plurality of diverters can include teardrop diverters and wedge diverters. In some implementations, a configuration of the teardrop diverters and the wedge diverters can create gaps between the teardrop diverters and the wedge diverters increasing in size from top to bottom thereby creating a venturi effect as water is drained into the gutter system.

In some implementations, the screen section can further include a plurality of fingers along a back edge of the screen section, the plurality of fingers being flexible and allowing the plurality of fingers to conform a roof surface.

In some implementations, the screen section can include guide grooves for creating corners angles for the screen section. In some implementations, the guide grooves can be configured to be supported by deflectors.

In some implementations, the apparatus for catching debris can further comprise: a mounting assembly, the mounting assembly an include a hinge that pivotally connects the mounting assembly to the collection assembly allowing the collection assembly to move between a first position and a second position. In some implementations, the mounting assembly can be fixedly attached to a gutter. In some implementations, the collection assembly can be fixedly attached to a gutter.

In another implementation, an apparatus for catching debris can comprise: a collection assembly, the collection assembly including a screen section, the screen section including a plurality of fingers along a back edge of the screen section, the plurality of fingers being flexible and allowing the plurality of fingers to conform a roof surface.

In some implementations, the screen section can further include a plurality of diverters configured to break water tension and slow water flow as water flows over the plurality of diverters from a roof surface, the plurality of diverters being spaced apart from one another in such a way that the slowed water is capable of draining into a gutter system from the screen section. In some implementations, the plurality of diverters include teardrop diverters and wedge diverters. In some implementations, a configuration of the teardrop diverters and the wedge diverters can create gaps between the teardrop diverters and the wedge diverters increasing in size from top to bottom thereby creating a venturi effect as water is drained into the gutter system.

In some implementations, the screen section can include guide grooves for creating corners angles for the screen section. In some implementations, the guide grooves can be configured to be supported by deflectors.

In some implementations, the apparatus for catching debris can further comprise: a mounting assembly, the mounting assembly including a hinge that pivotally connects the mounting assembly to the collection assembly allowing the collection assembly to move between a first position and a second position. In some implementations, the mounting assembly can be fixedly attached to a gutter. In some implementations, the collection assembly can be fixedly attached to a gutter.

In another implementation, an apparatus for catching debris can comprise: a deflector, the deflector including a ridge, a first side, a second side, a hinge and a mount, wherein the deflector is configured move between a first position and a second position. In some implementations, the first side can support an edge of a first collection assembly cut for corner use and the second side can support an edge of a second collection assembly cut for corner use.

DETAILED DESCRIPTION OF THE INVENTION

The disclosed technology relates to a debris collector for a roof gutter system. Specifically, the debris collector is designed so that debris that normally collects in a gutter system can be trapped within the debris collector. Once debris has collected, the debris collector can be moved from a first position to a second position for removal of the debris from the debris collector, as will be described more fully below.

Figure 6:
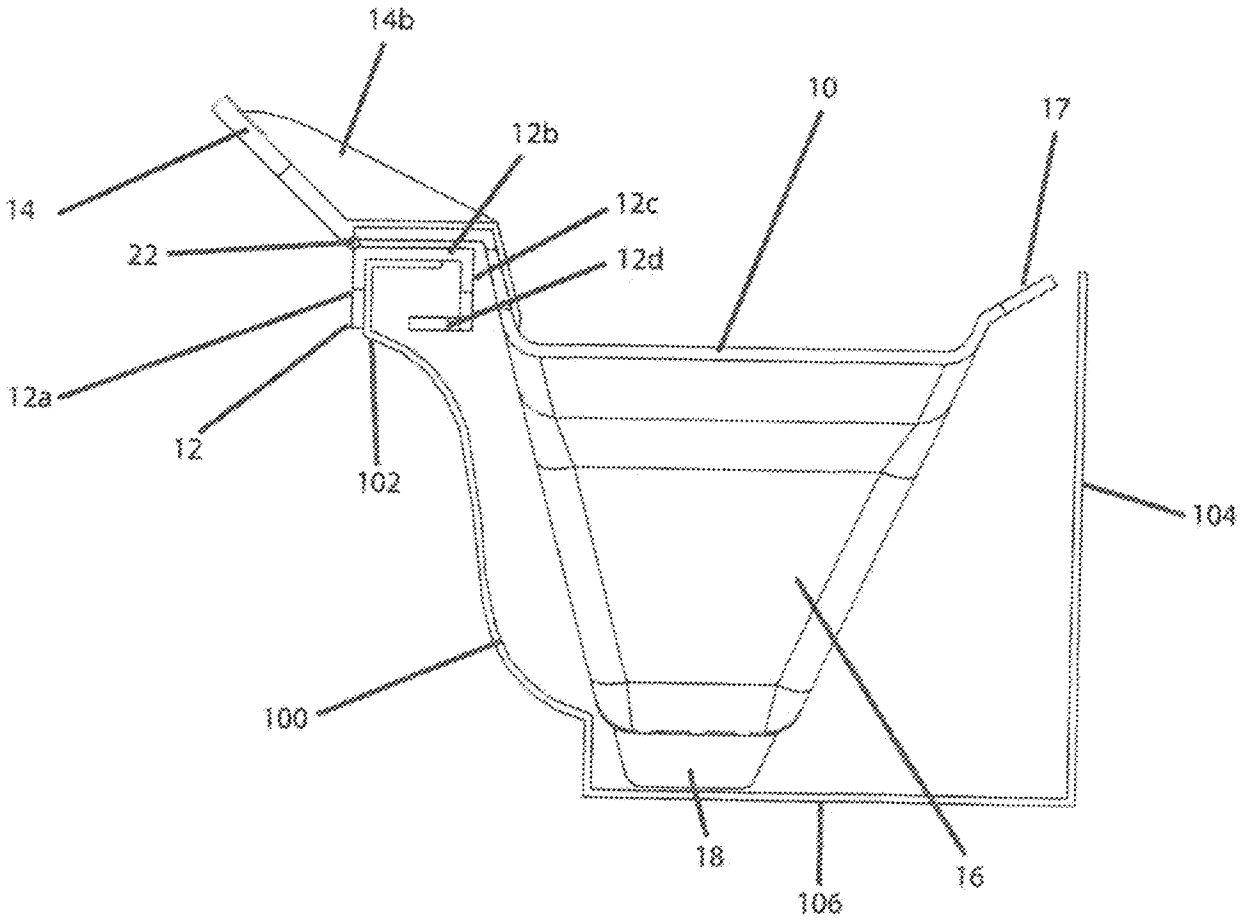
FIG. 6 is a side view of a debris collector of the disclosed technology secured within a roof gutter in a first position.
Figure 7:
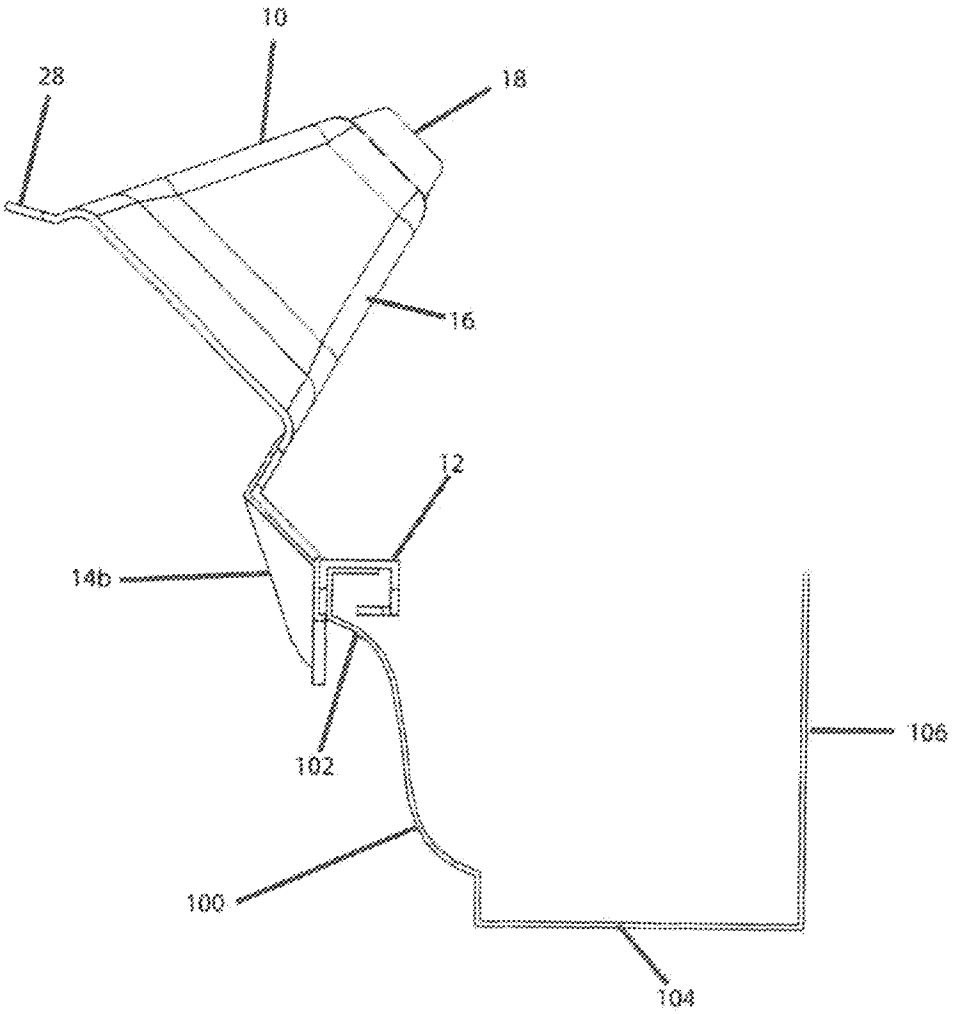
FIG. 7 is a side view of a debris collector of the disclosed technology secured within a roof gutter in a second position.

As shown in FIGS. 1-4, the debris collector 10 can include a clip assembly 12 and a basket section 16. The clip assembly 12 and the basket section 16 can be movably connected to each other with a hinge 22. The hinge 22 allows the debris collector 10 to move from a first position to a second position, as shown in FIGS. 6 and 7. The first position allows debris to collect within the debris collector 10 and the second position allows for removal of the debris from the debris collector 10.

The basket section 16 of the debris collector 10 can include strainer openings 20 that allow water to flow through the debris collector 10 but retain any debris that collects within the basket section 16. The basket section 16 of the debris collector 10 can also include risers 18. The risers 18 allow the basket section 16 to sit slightly above the bottom 106 of a roof gutter system 100 as shown in FIG. 6. The height of the riser 18 can be chosen so that rain water can freely flow though the strainer openings 20 of the basket section 16 while allowing the rain water to freely flow through the roof gutter system 100.

Figure 5:
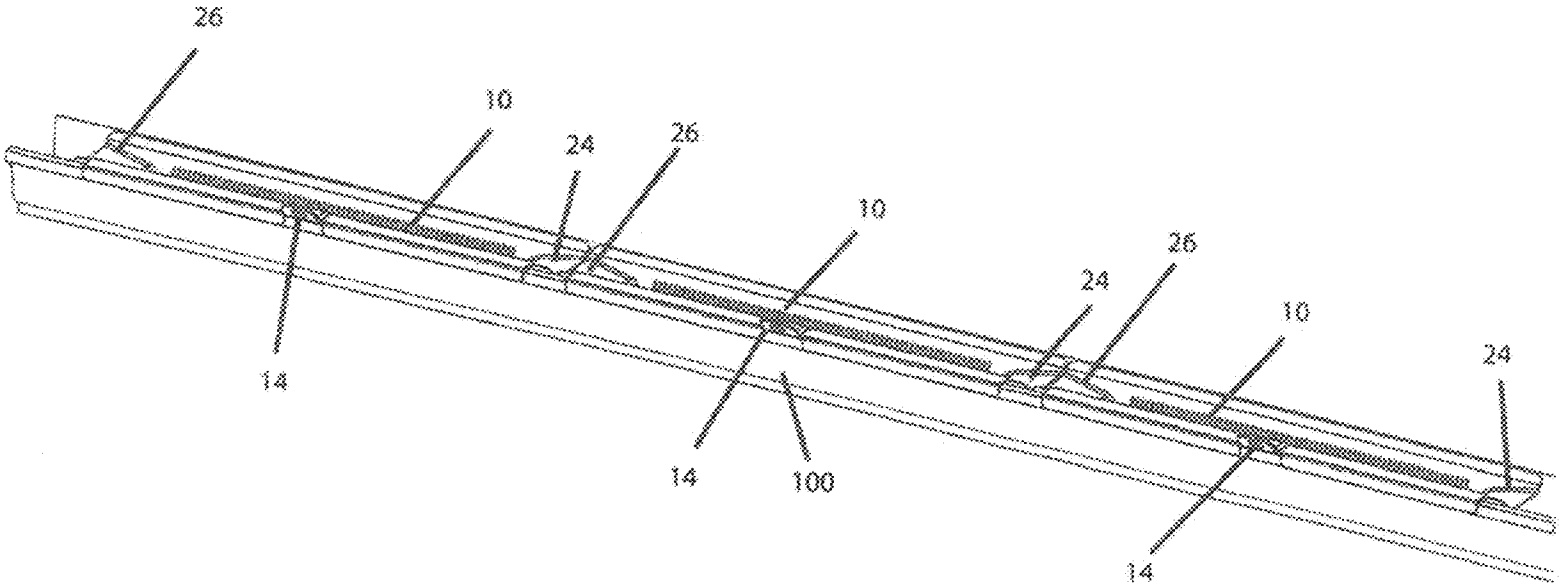
FIG. 5 is a perspective view of a debris collector of the disclosed technology secured within a roof gutter in a first position.

The basket section 16 of the debris collector 10 can also include a right extension 24, a left extension 26 and a rear extension 17. The right extension 24 and the left extension 26 can be used for placement of the several debris collectors adjacent to one another within a gutter system, as shown in FIG. 5. The right extension 24 and the left extension 26 can also be sloped so that rain water can be directed into the basket section 16. The rear extension 17 can be used for placement of the debris collector 10 in close proximity to a rear side 104 of the roof gutter system 100.

Figure 11:
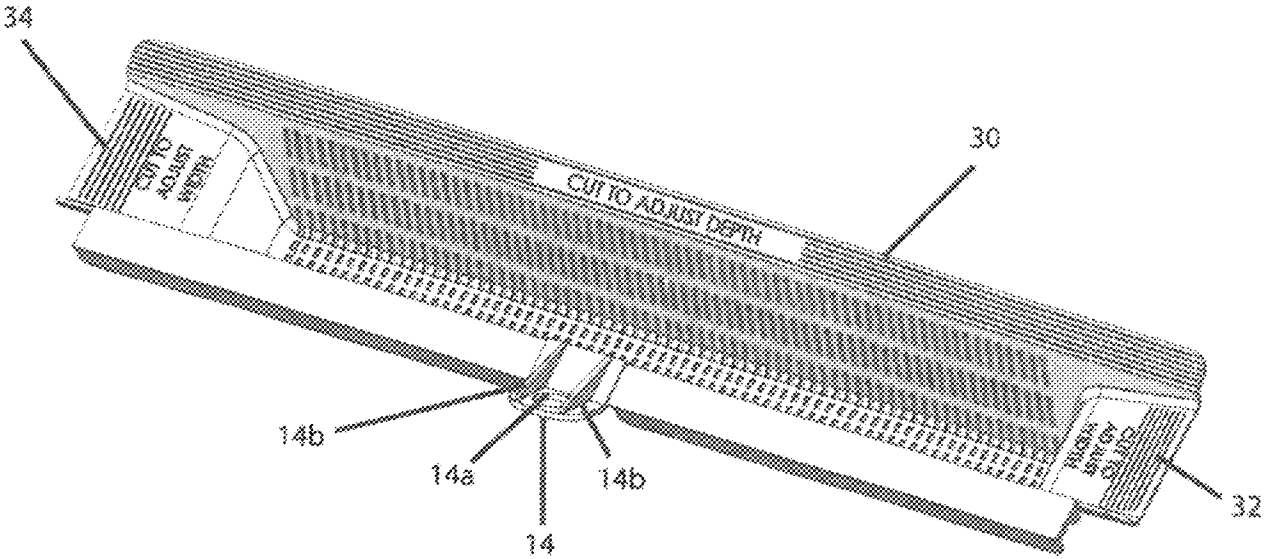
FIG. 11 is a top perspective view of a debris collector of the disclosed technology.

As shown in FIG. 11, the right extension 24, the left extension 26 and the rear extension 17 can include score lines 30, 32, 34 for customizing and sizing the right extension 24, the left extension 26 and the rear extension 17 to fit within existing gutter systems.

The debris collector 10 can also include a lever 14. The lever 14 can be positioned midpoint on the debris collector 10, but other configurations are contemplated. The lever 14, when actuated, allows the debris collector to be moved from the first position to a second position. The lever 14 can include an opening 14*a* for receiving a tool (not shown) which can allow a user to rotate the debris collector 10 from the first position to a second position via the hinge 22. In some implementations, the lever 14 can also include a strengthening rib 14*b* for adding strength to the lever 14.

Figure 1:
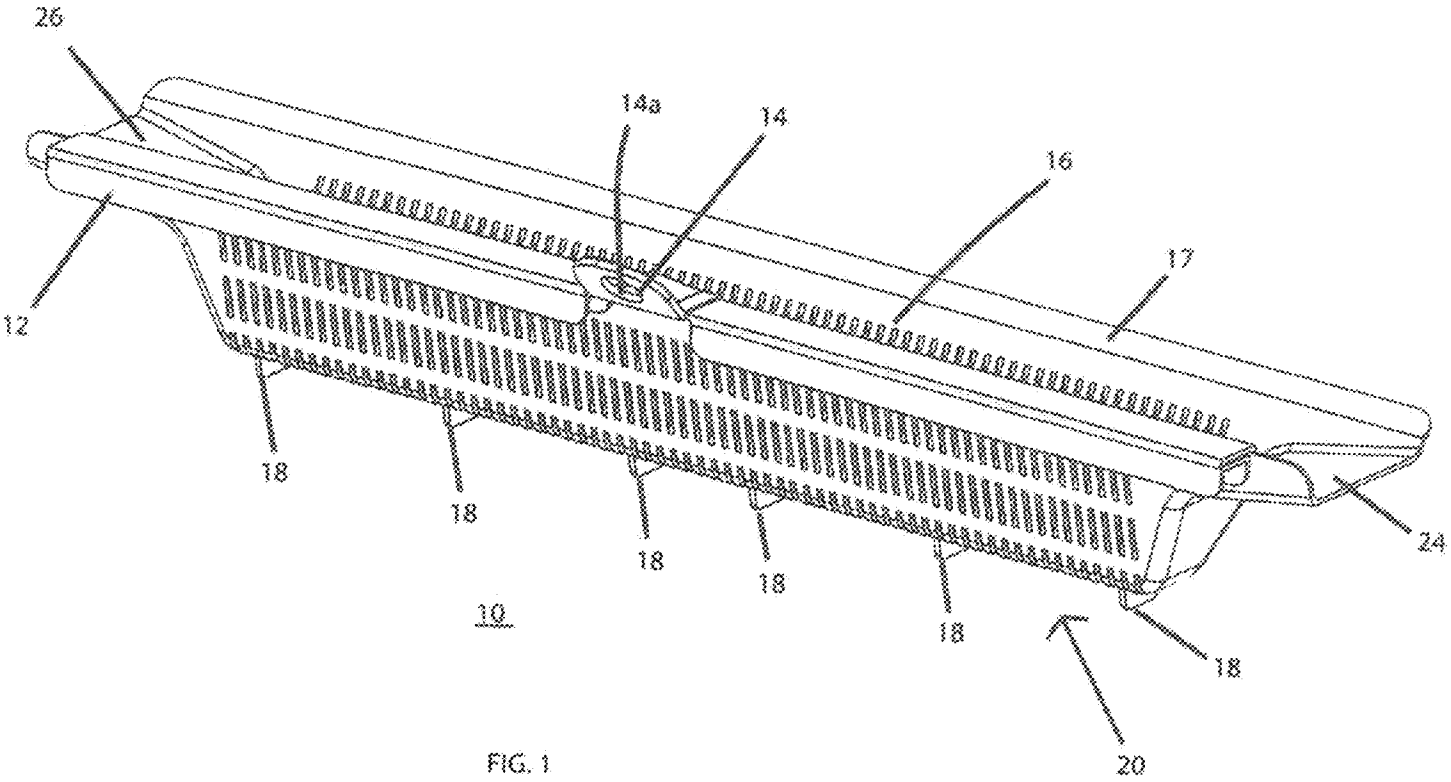
FIG. 1 is a top perspective view of a debris collector of the disclosed technology.
Figure 2:
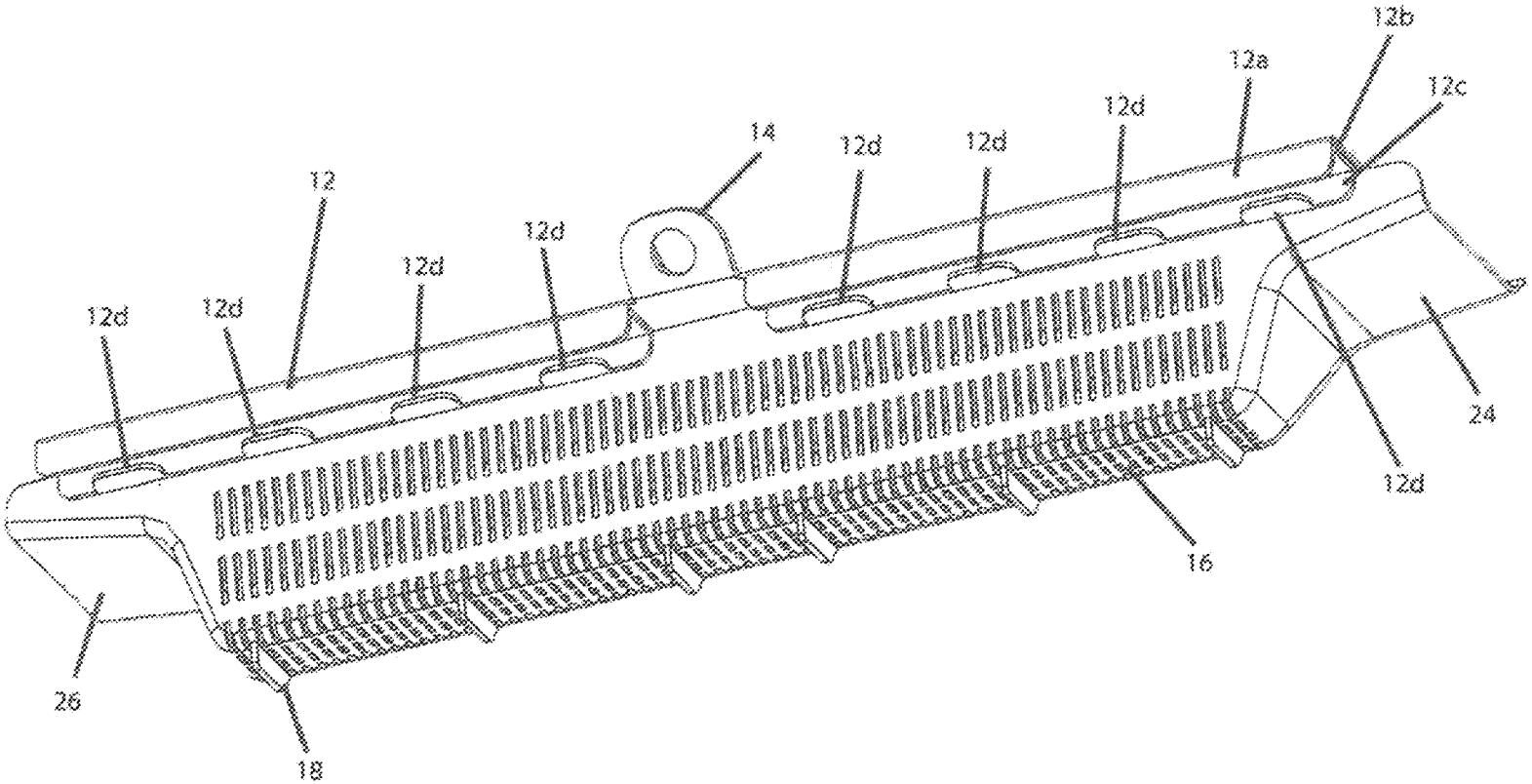
FIG. 2 is a bottom perspective view of a debris collector of the disclosed technology.
Figure 3:
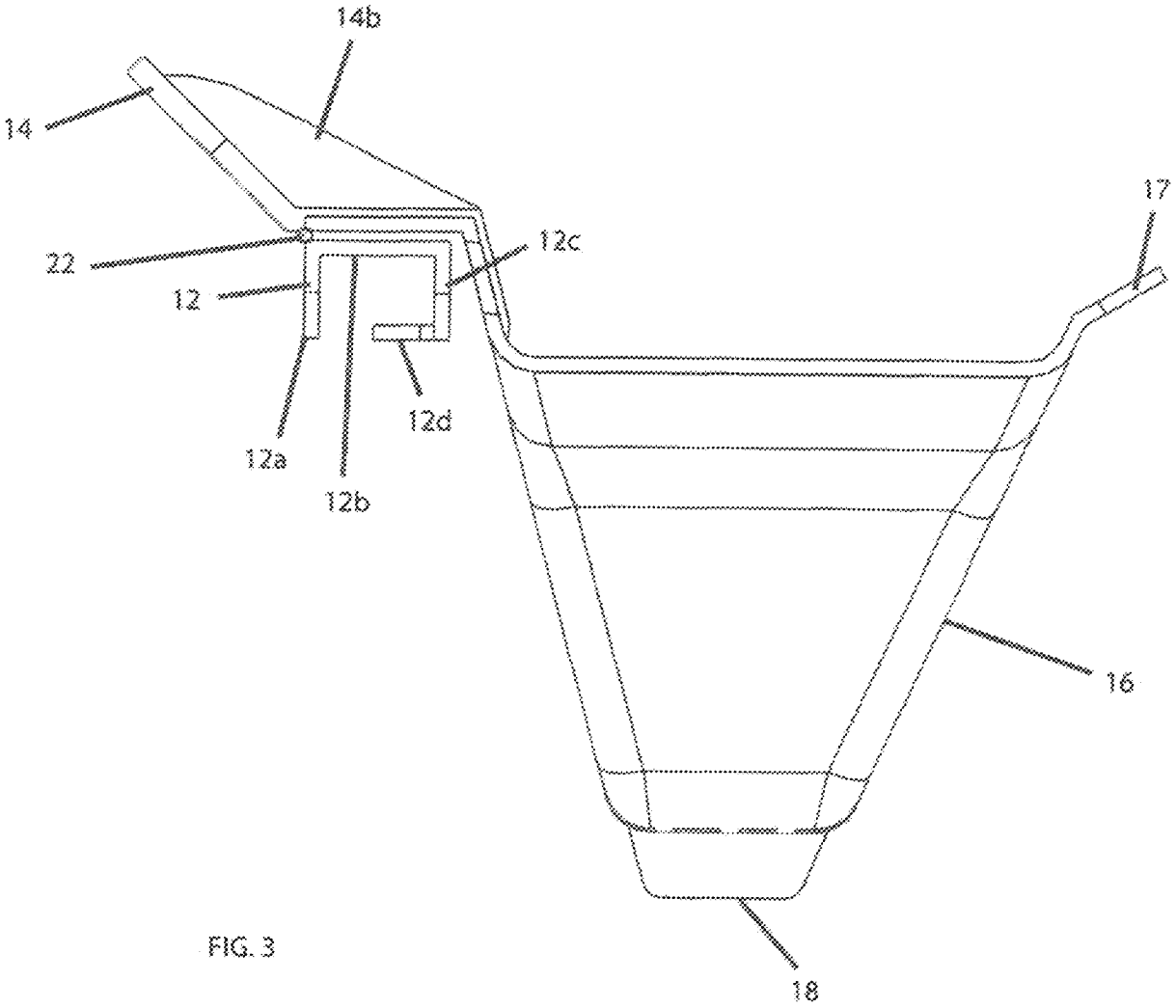
FIG. 3 is a side view of a debris collector of the disclosed technology.
Figure 4:
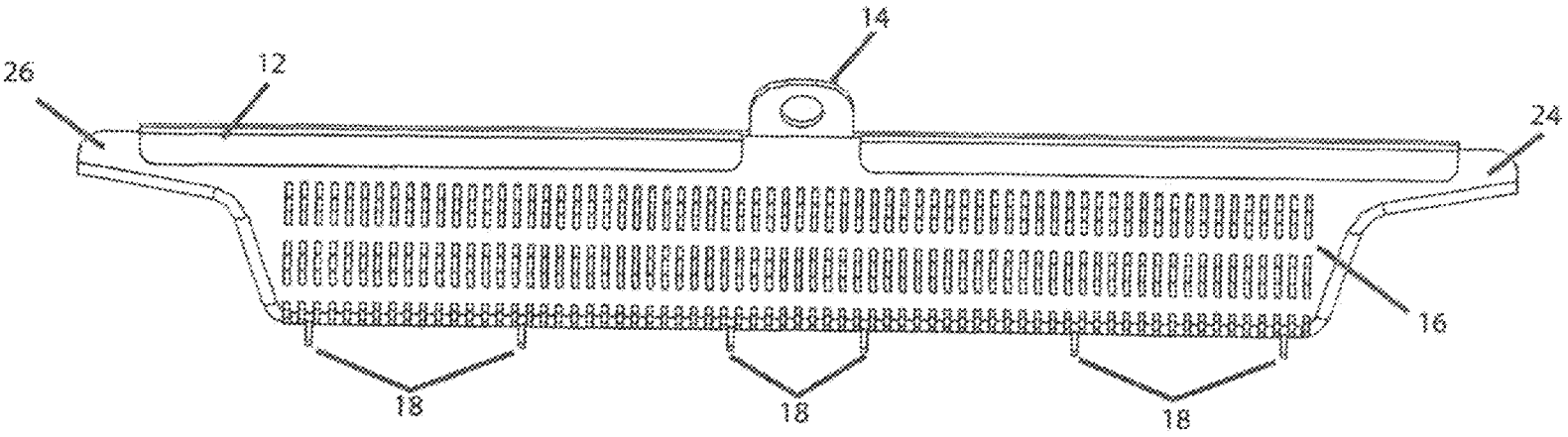
FIG. 4 is a front view of a debris collector of the disclosed technology.

As shown in FIG. 2, the clip assembly 12 can include a front lip 12*a*, a top lip 12*b*, a rear lip 12*c* and hooking tabs 12*d*. The clip assembly 12 can securely retain the debris collector 10 to the roof gutter system 100. That is, as shown in FIG. 6, the clip assembly 12 can be snap-fitted to a gutter flange 102, but other attachment mechanisms are contemplated. In this configuration, the gutter flange 102 can be firmly seated within the clip assembly 12. This configuration also allows the debris collector 10 to be removable from the gutter system 100.

Figure 8:
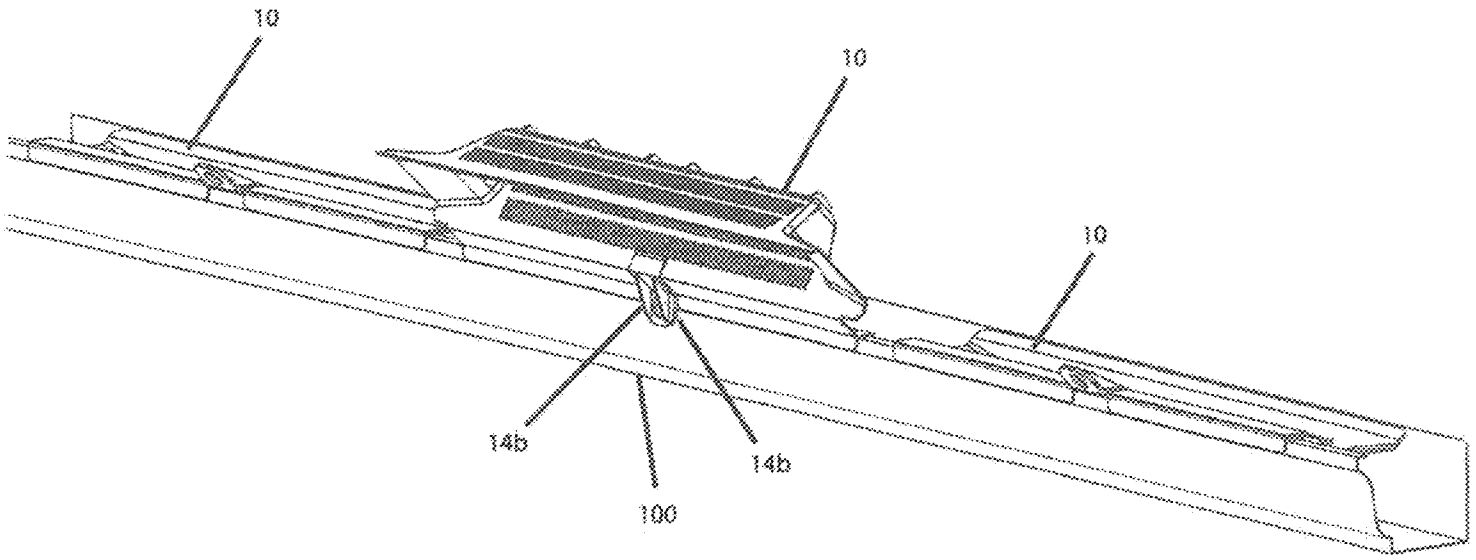
FIG. 8 is a perspective view of a debris collector of the disclosed technology secured within a roof gutter in a second position.
Figure 9:
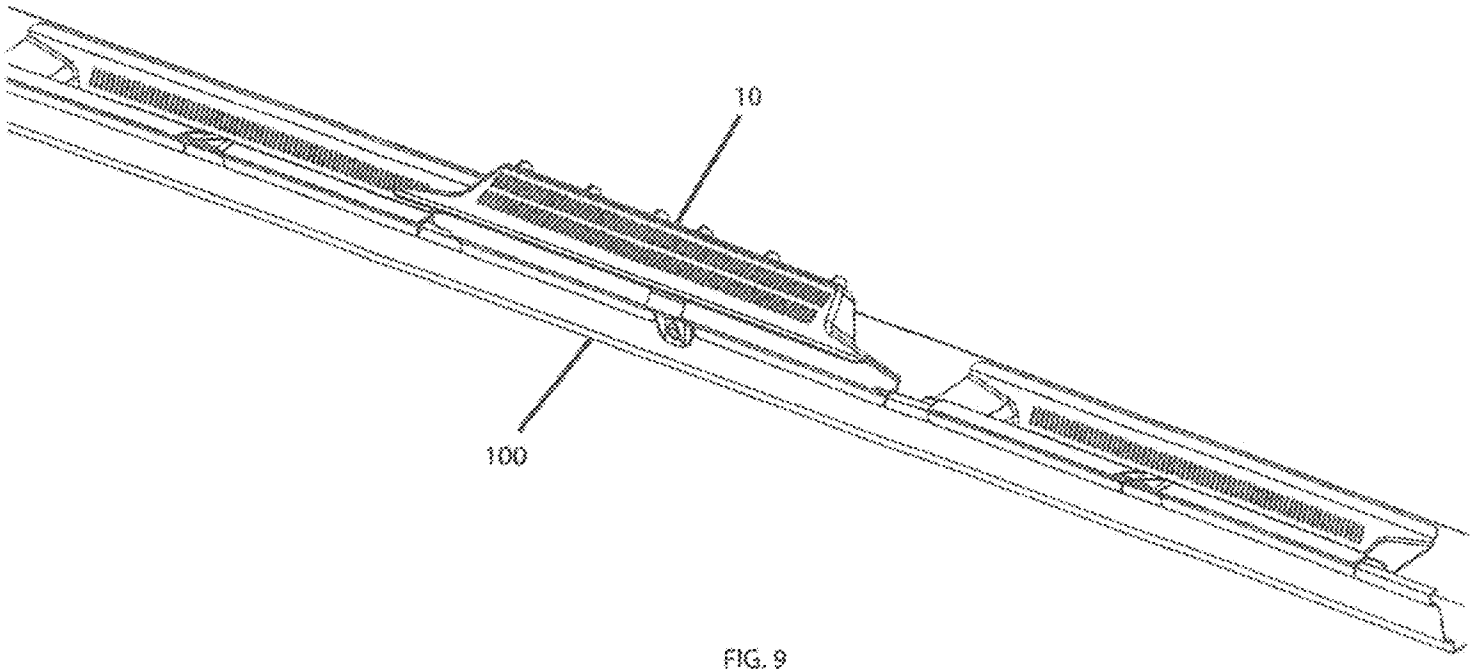
FIG. 9 is a perspective view of a debris collector of the disclosed technology secured within a roof gutter in a second position.
Figure 10:
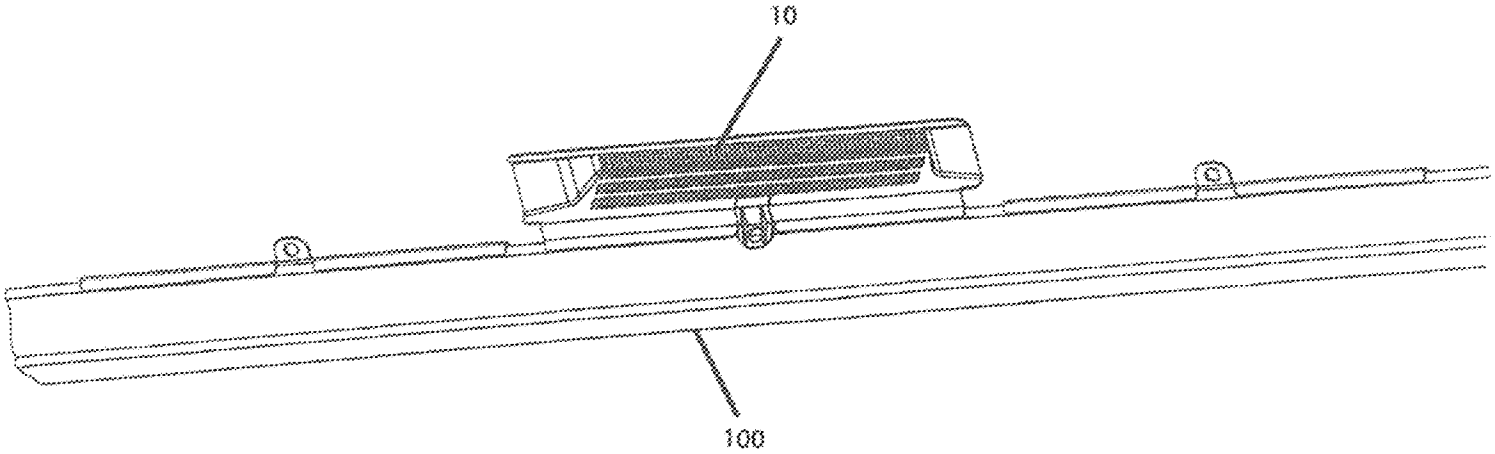
FIG. 10 is a perspective view of a debris collector of the disclosed technology secured within a roof gutter in a second position.

As shown in FIGS. 8-10, the debris collector 10 can be rotated out of the roof gutter system 100 for removing the debris from the debris collector. In some implementations, a user can place a hooked or magnetic tip of a poling tool (shown in FIGS. 29-36) into the opening 14*a* of the lever 14. Once inserted or magnetically connected, the user can apply downward pressure to the poling tool so that the lever 14 is moved downwards which in turn causes the basket section 16 to be rotated out of the gutter system 100. Once the debris collector 10 is placed in an inverted second position most if not all of the debris will fall out of the gutter and down to the ground. If some debris remains within the debris collector 10, a stream of a garden hose can be directed into the basket section 16 for clearing any remaining debris. After the basket section 16 is cleaned out, the user can push the lever in an upwards direction with the poling tool. This motion causes the basket section 16 to rotate and allows the basket section 16 to return to its seated position within the gutter system 100.

In some implementations, as shown in FIGS. 12-17, a debris collector 110 can include a collection assembly 111 and a mounting assembly 113. The collection assembly 111 and the mounting assembly 113 can be movably connected to each other with a hinge 120. The hinge 120 allows the debris collector 110 to move from a first position, shown in FIGS. 12-14, to a second position, shown in FIGS. 15-17. The first position allows debris to collect within the collection assembly 111 and the second position allows for removal of the debris from collection assembly 111.

The hinge 120 can be constructed from a flexible material and can be fixedly connected to the mounting assembly 113 or can be integrally formed with the mounting assembly 113 at one end. The hinge 120 can also include securing tab 136 at the other end. The securing tab 136 is capable of receiving a front edge 144*b* of the collection assembly 111. The front edge 144*b* can be seated and secured within the securing tab 136. In some implementations, the front edge 144*b* can have a downward slant.

Figure 12:
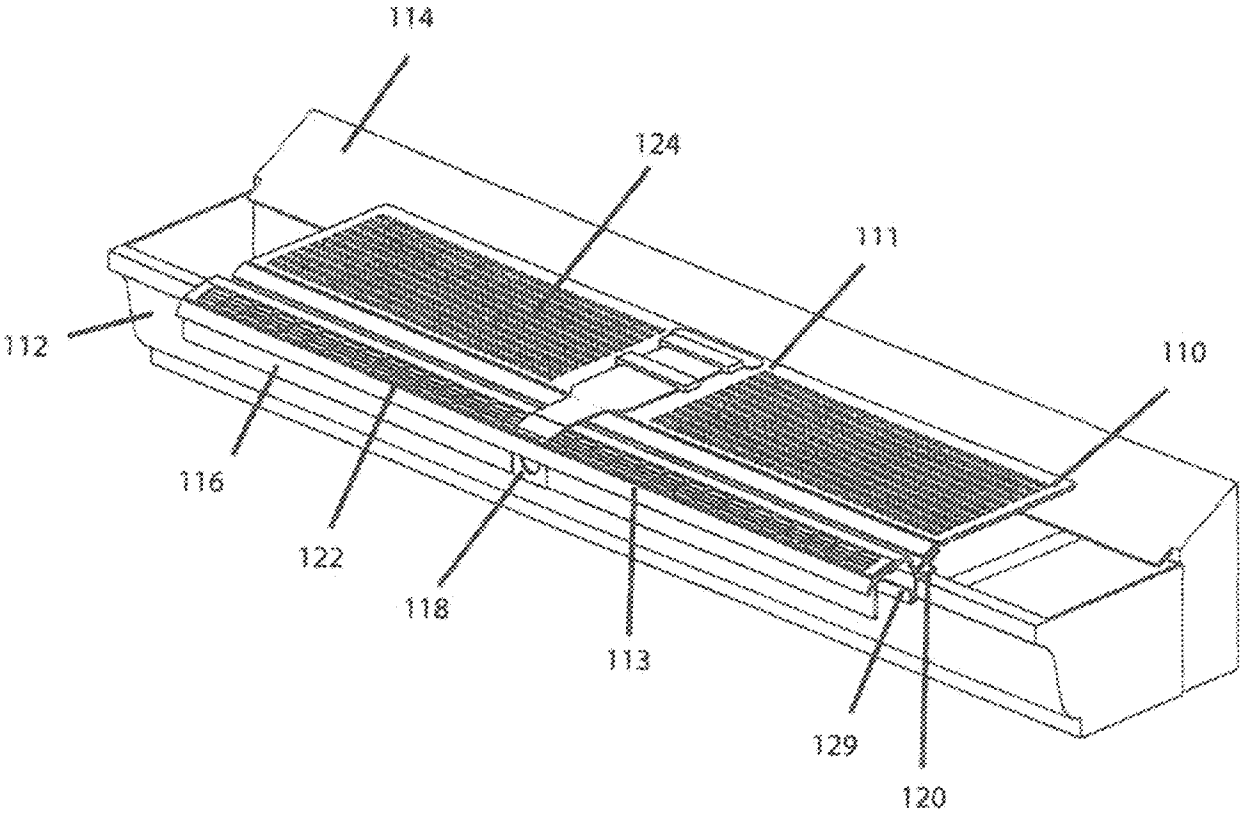
FIG. 12 is a perspective view of a debris collector of the disclosed technology in a first position.
Figure 13:
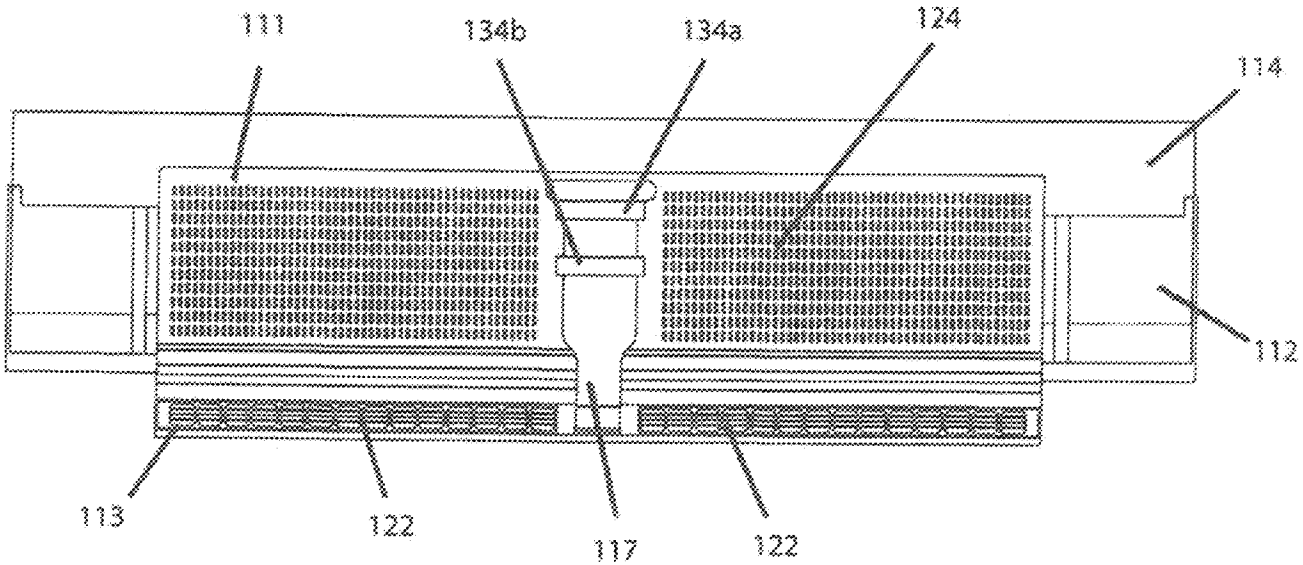
FIG. 13 is a top view of a debris collector of the disclosed technology in a first position.

The collection assembly 111 of the debris collector 110 can also include screen 124, e.g. a substantially flat and rectangular-shaped screen, that allows water to flow onto and through the screen 124 of the debris collector 110 but retains any debris that collects on a top surface of the screen 124. The screen 124 of the debris collector 110 can include a back edge 144*a* that rests on a roof shingle 114 as shown in FIG. 12. The back edge 144*a* is capable of allowing water to flow from a roof surface over the screen 124.

The debris collector 110 can also include a lever 117. The lever 117 can be positioned midpoint on the debris collector 110, but other configurations are contemplated. The lever 117, when actuated, allows the debris collector 110 to be moved from the first position to a second position. The lever 117 can include a pull tab 118 for receiving a tool (not shown) which can allow a user to rotate the debris collector 110 from the first position to a second position via the hinge 120. In some implementations, the lever 117 can be attached to the screen 124 by holders 134*a*, 134*b*.

Figure 17:
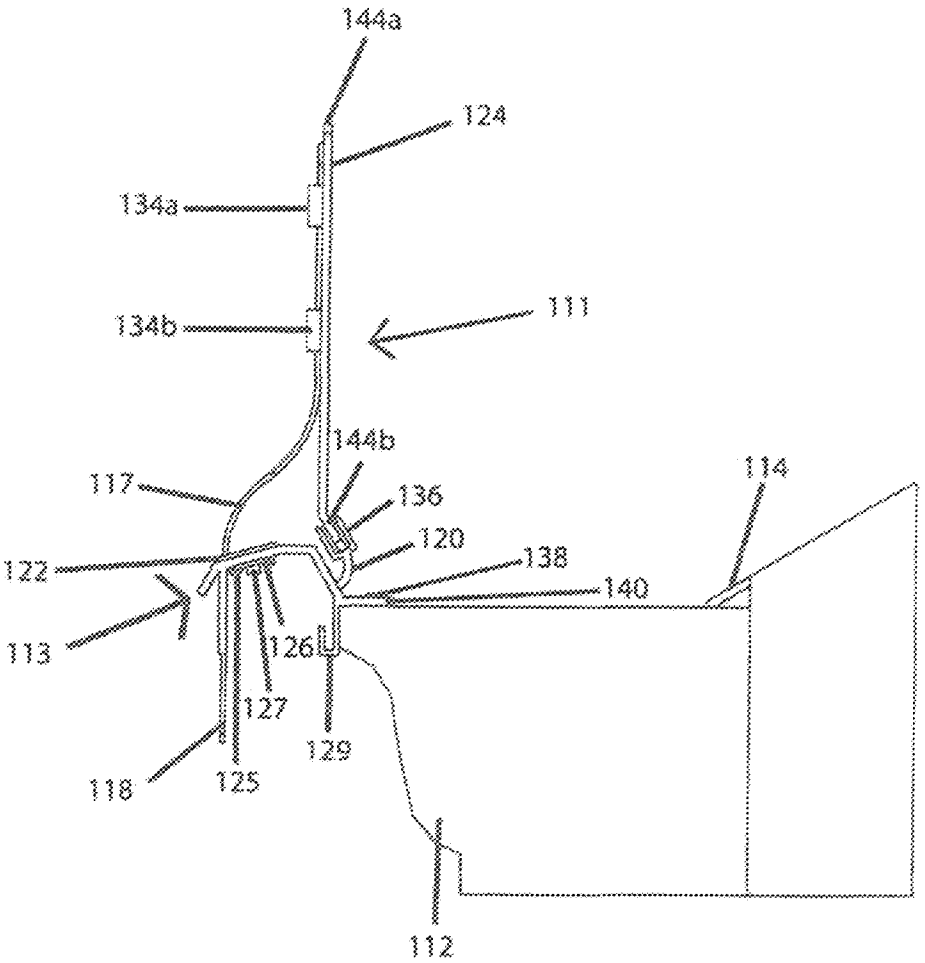
FIG. 17 is a cross-sectional view of a debris collector of the disclosed technology in a second position.
Figure 18:
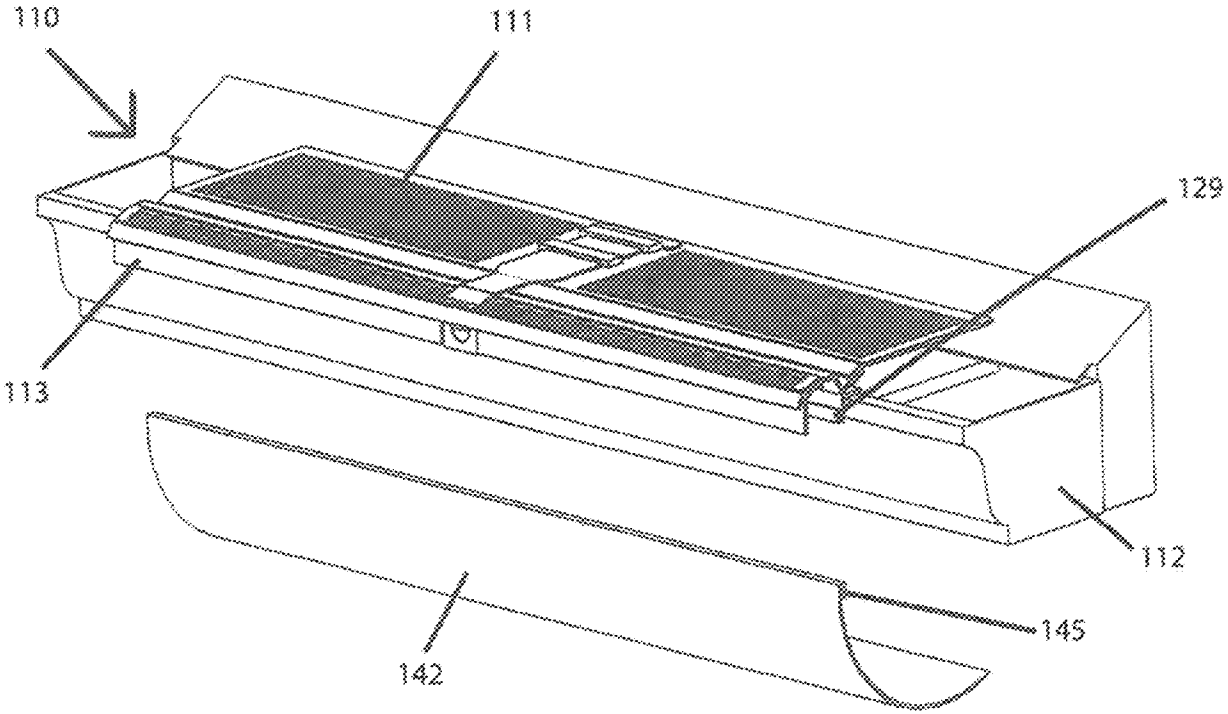
FIG. 18 is a perspective view of a debris collector of the disclosed technology with an unattached decorative cover.

The mounting assembly 113 can include an extrusion section 116 and an attachment ledge 140. The mounting assembly 113 can securely retain the debris collector 110 to the roof gutter system 112. That is, as shown in FIG. 17, the attachment ledge 140 can be fixedly attached roof gutter system 112, e.g., the attachment ledge 140 can be fixedly attached a gutter flange of the roof gutter system 112 with screws 138, but other attachment mechanisms are contemplated.

In some implementations, the extrusion section 116 can include a solar panel 122, an LED lighting strip 126, a drip edge 130, a light shield 132, strip guides 125 and hooking rail 129.

The solar panel 122 can be attached to a top surface of the extrusion section 116 with, e.g., an adhesive or clips, and the LED lighting strip 126 can be attached to an underside of the top surface of the extrusion section 116. e.g. with strip guides 125, but other attachment mechanisms are contemplated. The solar panel and the LED lighting strip 126 can be electrically connected to one another so that the solar panel can power the LEDs 127 of the LED lighting strip 126.

Figure 14:
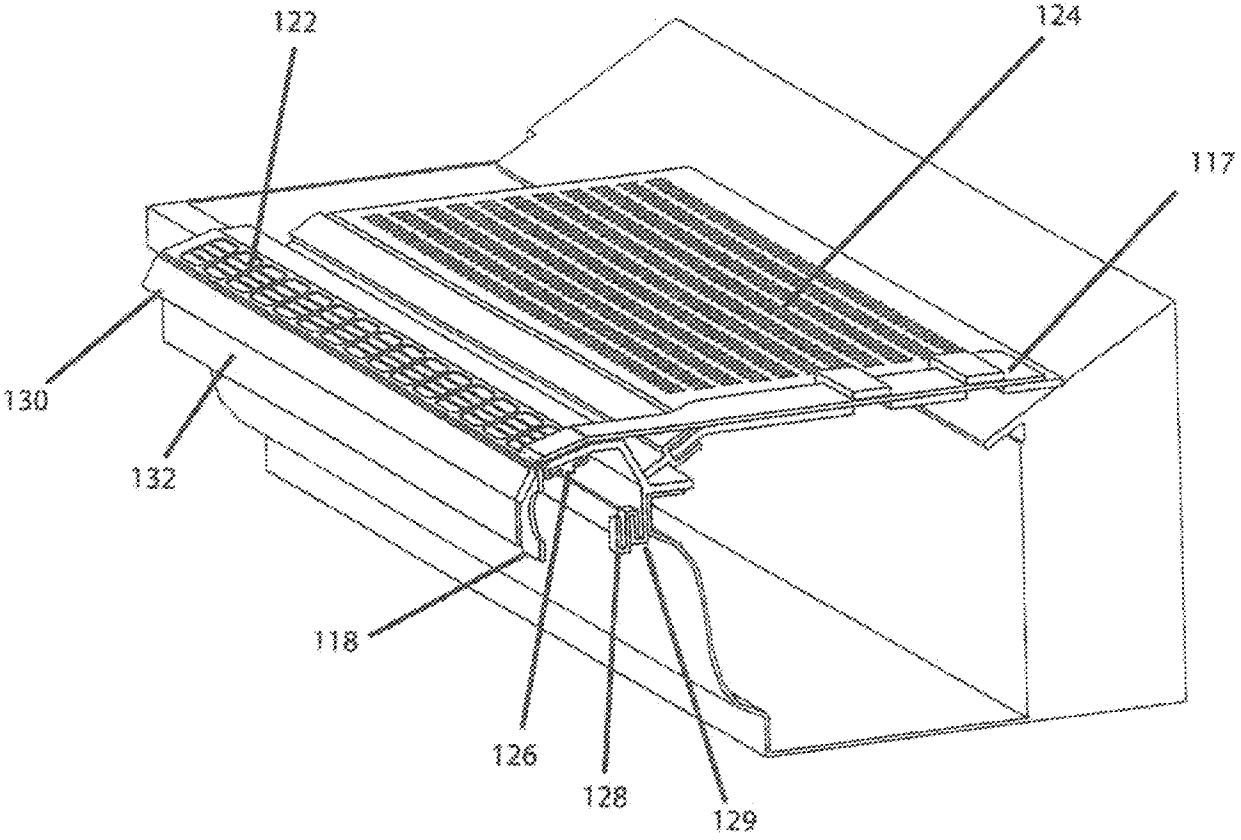
FIG. 14 is a perspective, cross-sectional view of a debris collector of the disclosed technology in a first position.
Figure 15:
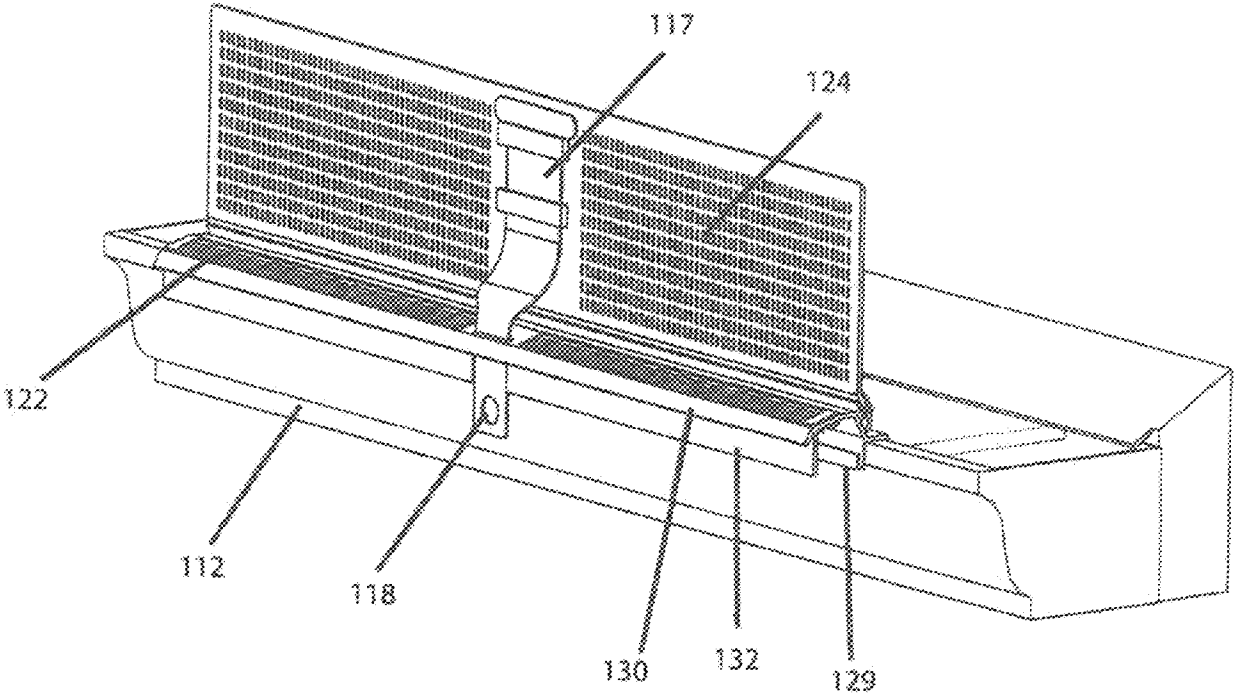
FIG. 15 is a perspective view of a debris collector of the disclosed technology in a second position.
Figure 16:
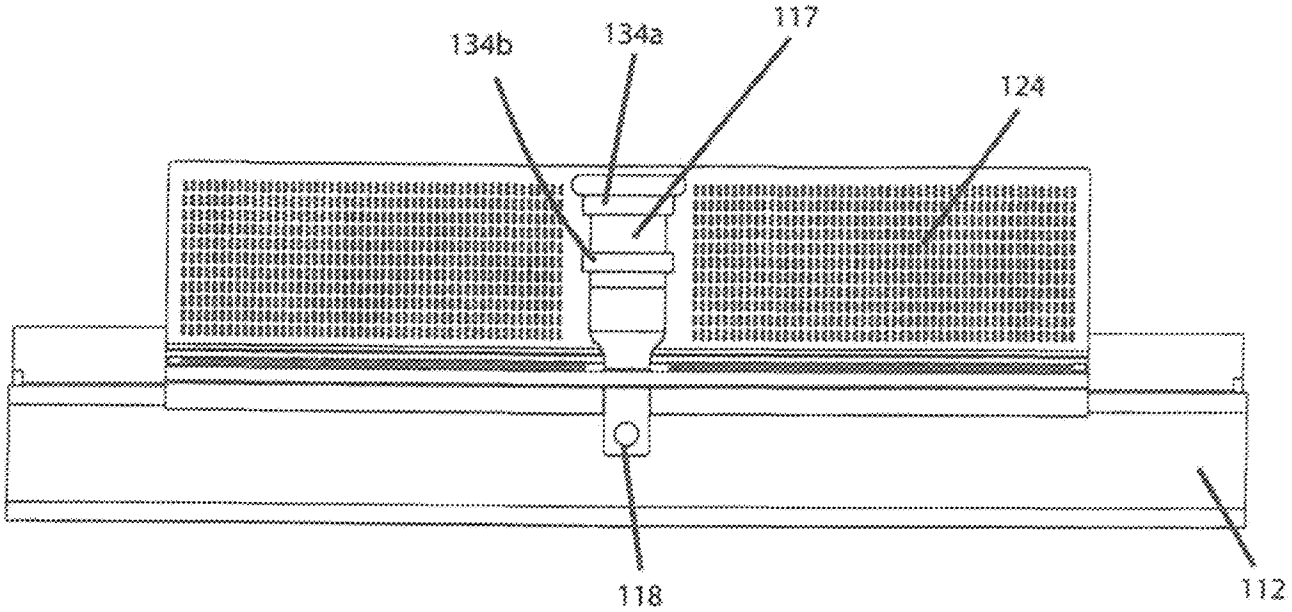
FIG. 16 is a front view of a debris collector of the disclosed technology in a second position.
Figure 19:
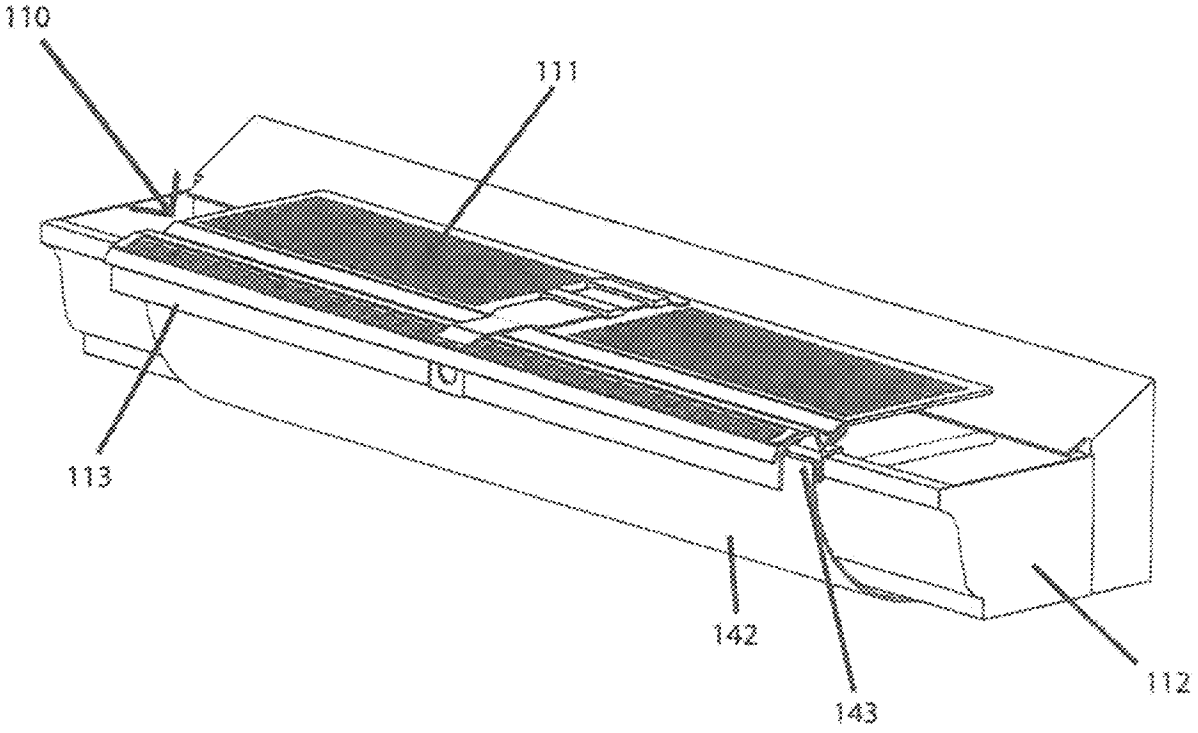
FIG. 19 is a perspective view of a debris collector of the disclosed technology with an attached decorative cover.
Figure 20:
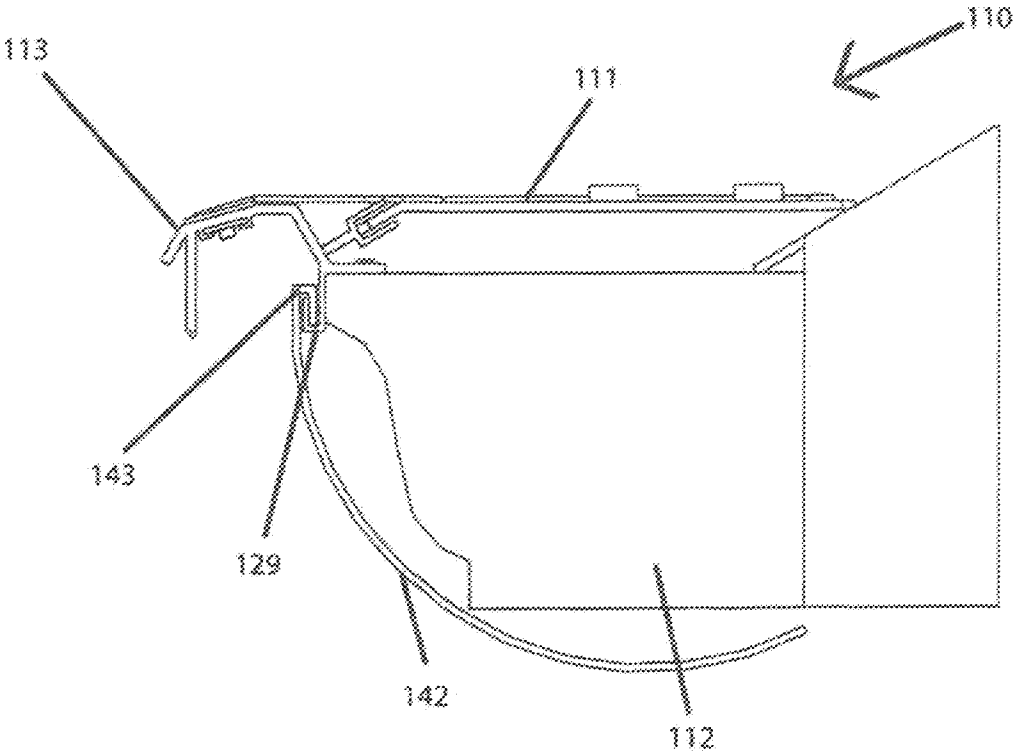
FIG. 20 is a cross-sectional view of a debris collector of the disclosed technology with an attached decorative cover.
Figure 21:
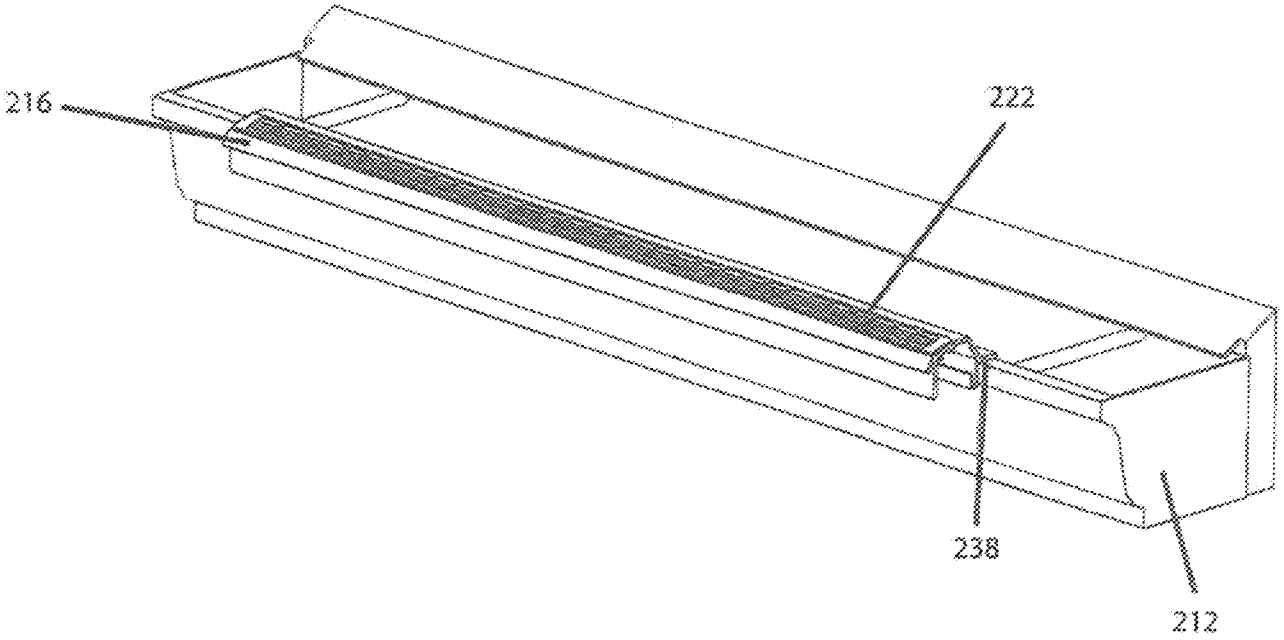
FIG. 21 is a perspective view of an extrusion assembly of the disclosed technology.
Figure 22:
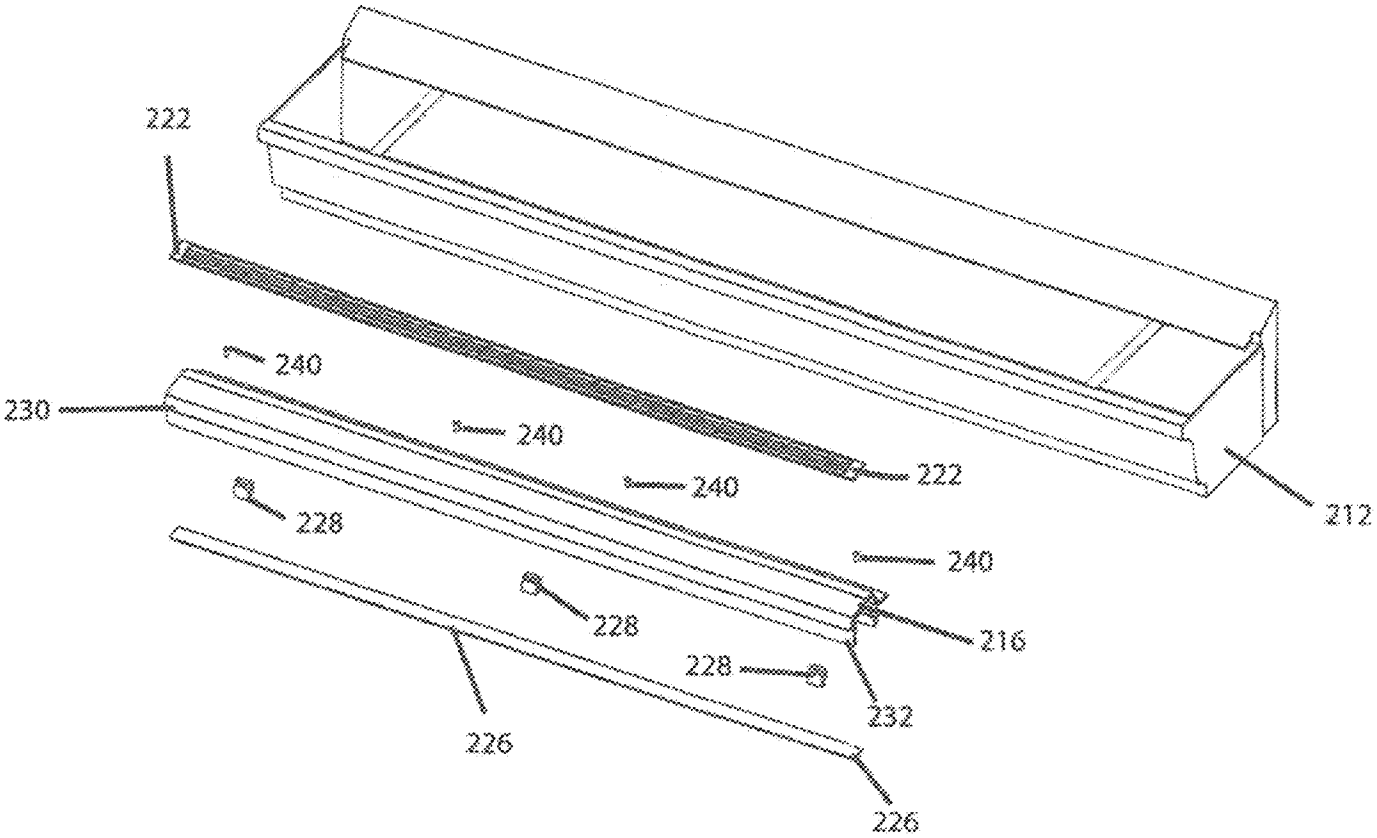
FIG. 22 is an exploded view of an extrusion assembly of the disclosed technology.
Figure 23:
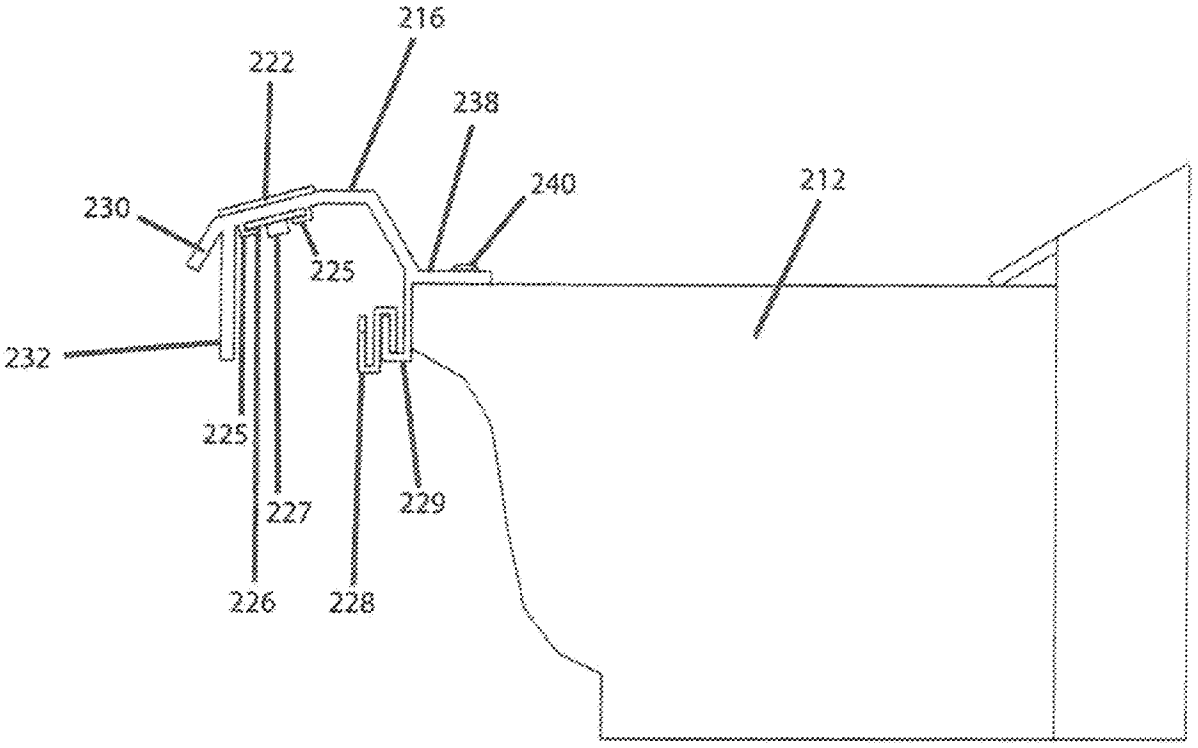
FIG. 23 is a side, cross-sectional view of an extrusion assembly of the disclosed technology.
Figure 24:
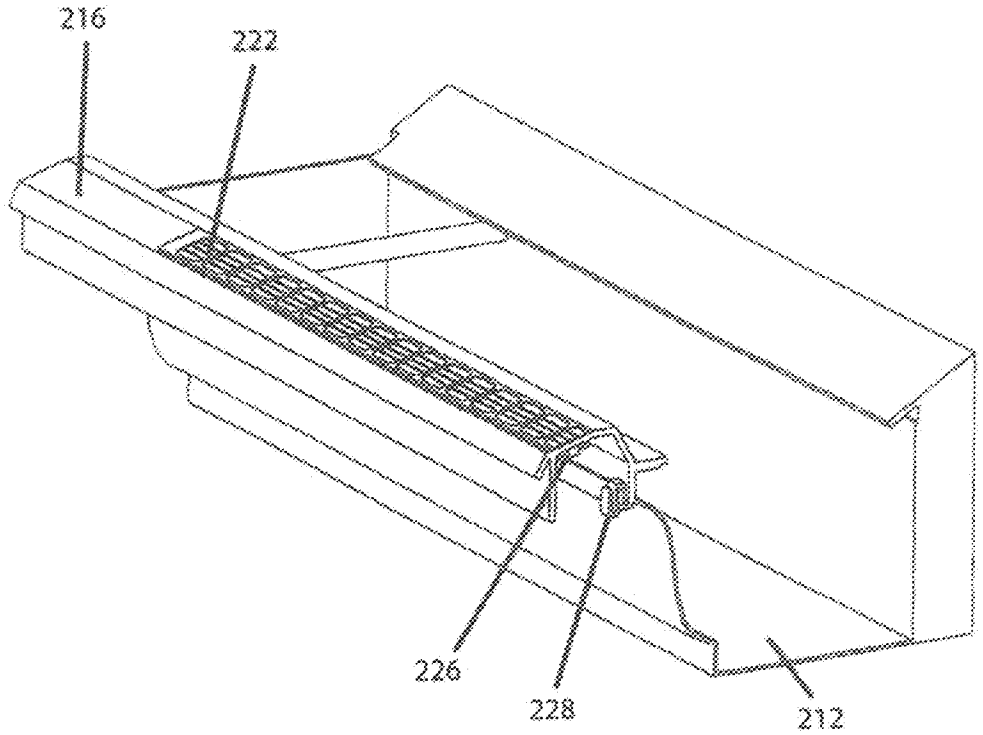
FIG. 24 is a perspective, cross-sectional view of an extrusion assembly of the disclosed technology.

Extending from top surface of the extrusion section 116 can be drip edge 130 that allows water to be directed away from the extrusion section 116 while the light shield 132 allows light to be directed downwards from the LED lighting strip 126. The hooking rail 129 can be located on a rear side of the extrusion section 116. The hooking rail 129 can be used to secure lighting hooks 128, as shown in FIGS. 14 and 23-24 or a decorative cover 142 as shown in FIGS. 19-20. The decorative cover 142 can be curved so as to cover a front and bottom of the roof gutter system 112. The decorative cover 142 can include flange 143 which attaches to the hooking rail 129 as shown in FIGS. 19-20. In some implementations, the decorative cover 142 can be copper, faux wood or any other decorative design.

As shown in FIGS. 12-17, the debris collector 110 can be rotated out of the roof gutter system 112 for removing the debris from the debris collector. In some implementations, a user can place a hooked or magnetic tip of a poling tool (shown in FIGS. 29-36) into the pull tab 118 of the lever 117. Once inserted, the user can apply downward pressure to the poling tool so that the lever 117 is moved downwards which in turn causes the collection assembly 111 to be rotated out of the gutter system 112. Once the debris collector 110 is placed in an inverted second position most if not all of the debris will fall out of the gutter and down to the ground. If some debris remains within the debris collector 110, a stream of a garden hose can be directed at the collection assembly 111 for clearing any remaining debris. After the collection assembly 11 is cleaned out, the user can push the lever 117 in an upwards direction with the poling tool. This motion causes the collection assembly 111 to rotate and allows the collection assembly 111 to return to its seated position covering the gutter system 112.

In some implementations, as shown in FIGS. 21-24, an extrusion section 216 can be installed as a standalone device for adding to the aesthetics of a gutter system 212. The extrusion section 216 can include a solar panel 222, an LED lighting strip 226, a drip edge 230, light shield 232, strip guides 225, hooking rail 229, attachment ledge 238, screws 240 and clips 228.

The solar panel 222 can be attached to a top surface of the extrusion section 216 and the LED lighting strip 226 can be attached to an underside of the top surface of the extrusion section 216 via strip guides 225. The solar panel 222 and the LED lighting strip 226 can be electrically connected to one another so that the solar panel 222 can power the LEDs 227 of the LED lighting strip 226. In some implementations, the LED lighting strip 226 can be electrically connected to a 110V power converter.

Extending from top surface of the extrusion section 216 can be drip edge 230 that allows water to be directed away from the extrusion section 216 while the light shield 232 allows light to be directed downwards from the LED lighting strip 226. On a rear side of the extrusion section 216, a hooking rail 229 can be used to secure hooks for hanging string lights 228, as shown in FIG. 23.

Figure 25:
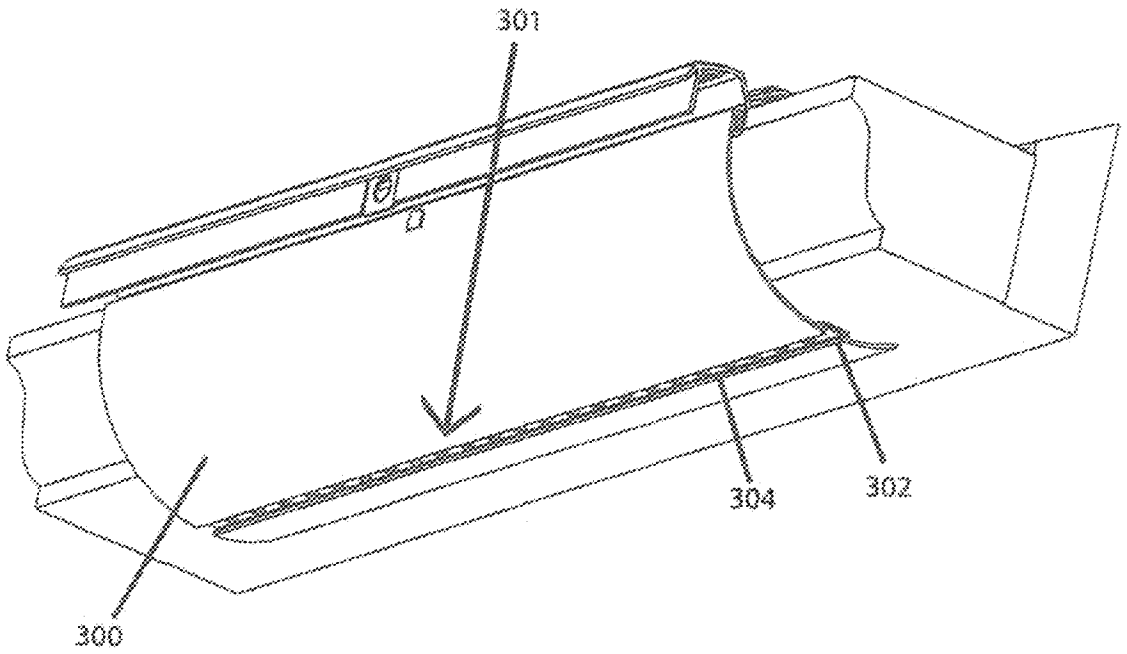
FIG. 25 is a perspective view of a debris collector of the disclosed technology with an attached decorative cover having a lighting system.
Figure 26:
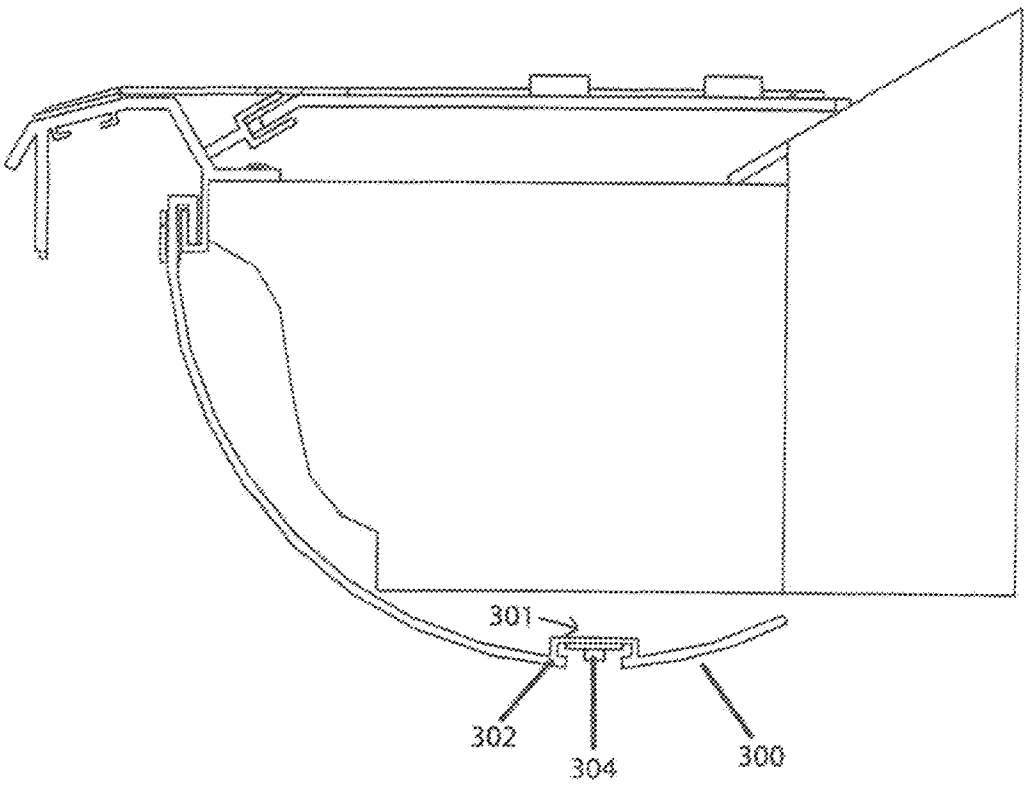
FIG. 26 is a cross-sectional view of a debris collector of the disclosed technology with an attached decorative cover having a lighting system.

In some implementations, as shown in FIGS. 25 and 26, a decorative cover 300 can include lighting system 301, e.g., a LED guide 302 that attaches a LED lighting strip 304, however, other attachment mechanisms are contemplated. The LED guide 302 and the LED lighting strip 304 can be positioned on a bottom of the decorative cover 300 for distributing light. The LED lighting strip 304 can be powered by a solar panel, as described above, or by a D.C. power converter (not shown) supplied from a 110V power source.

Figure 27:
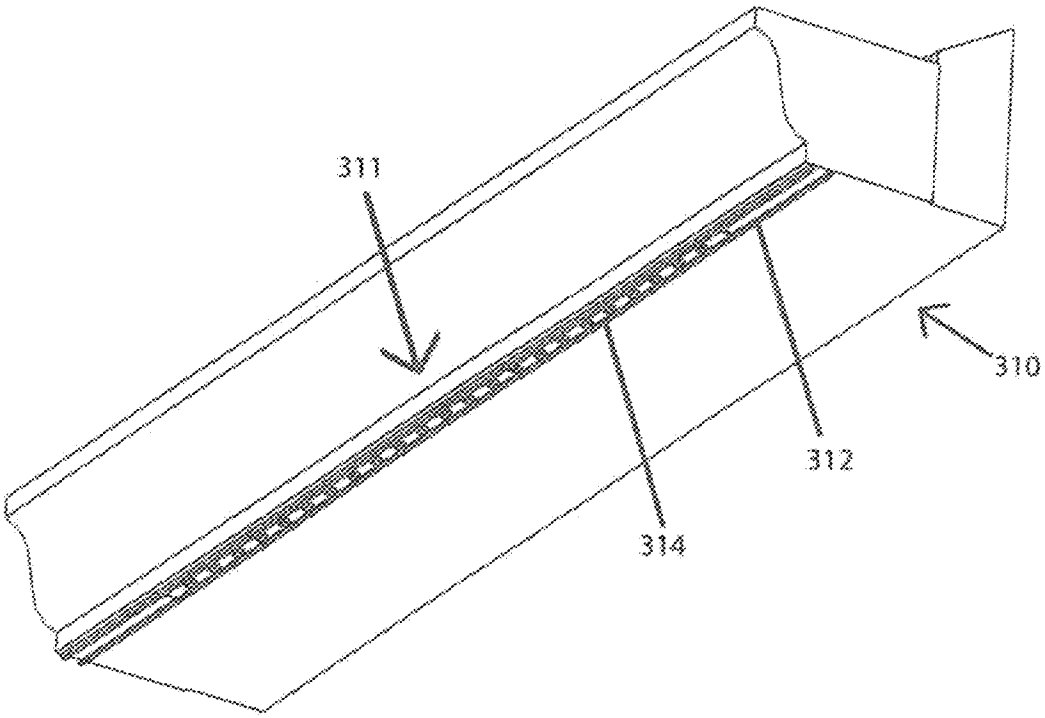
FIG. 27 is a perspective view of a gutter system of the disclosed technology having a lighting system.
Figure 28:
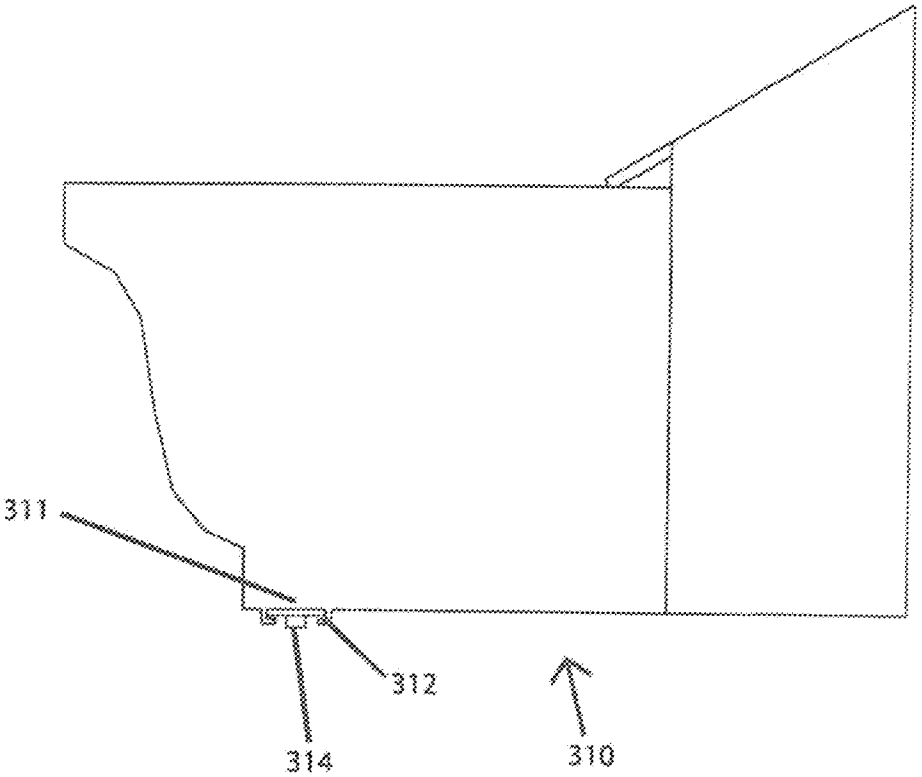
FIG. 28 is a cross-sectional view of a gutter system of the disclosed technology having a lighting system.

In some implementations, as shown in FIGS. 27 and 28, a gutter system 310 can include a lighting system, 311, e.g., a LED guide 312 that attaches an LED lighting strip 314. The LED guide 312 can be incorporated in the gutter system at time of manufacture or can be adhered to the gutter system 310 after installation through the use of an adhesive or some other attachment mechanism.

Figure 29:
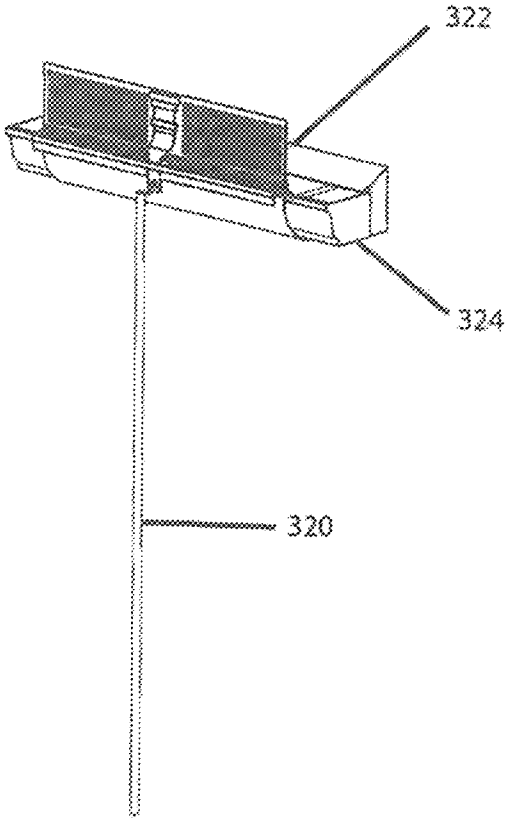
FIG. 29 is a perspective view of a debris collector of the disclosed technology along with a poling tool of the disclosed technology.
Figure 30:
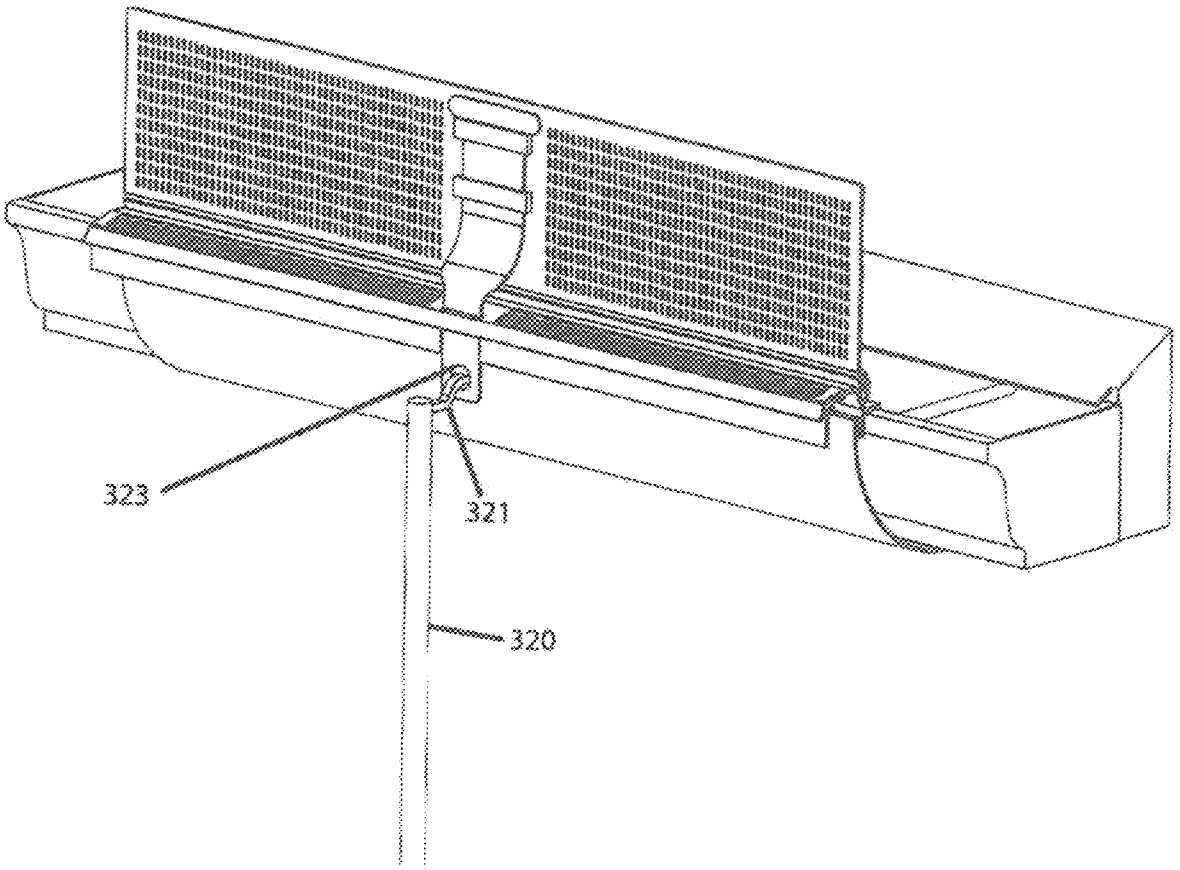
FIG. 30 is a perspective view of a debris collector of the disclosed technology along with a poling tool of the disclosed technology.

In some implementations, as shown in FIGS. 29-30, a poling tool 320 can used to rotate a debris collector 322 from a gutter system 324. In use, a tip 321 of the poling tool 320 can be inserted into a pull tab 323 of the debris collector 322. Once inserted, a user can apply downward pressure to the poling tool 320 so that debris collector 322 is rotated out of the gutter system 324 into an inverted, cleaning position. Once the debris collector 322 is placed in the inverted position most if not all of the debris will fall away from the debris collector 322 and down to the ground. If some debris remains within the debris collector 322, a stream of a garden hose can be directed at the debris collector 322 for clearing any remaining debris. After the debris collector 322 is cleaned out, the user can push the poling tool 320 in an upwards direction causing the debris collector 322 to rotate back to a seated position.

Figure 31:
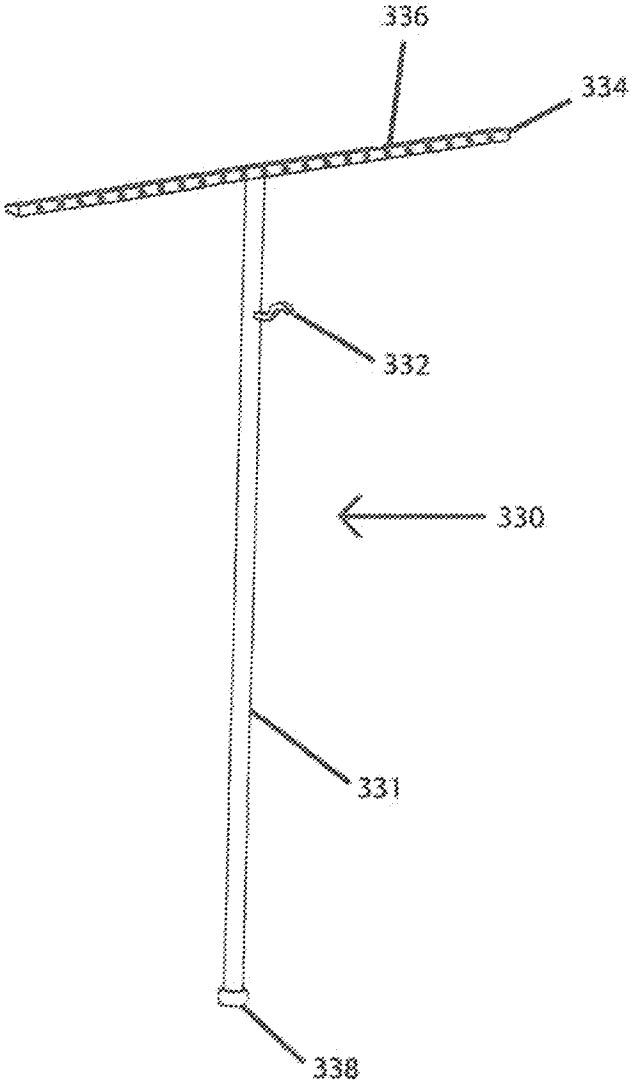
FIG. 31 is a perspective view of a poling tool of the disclosed technology having a cleaning head.
Figure 32:
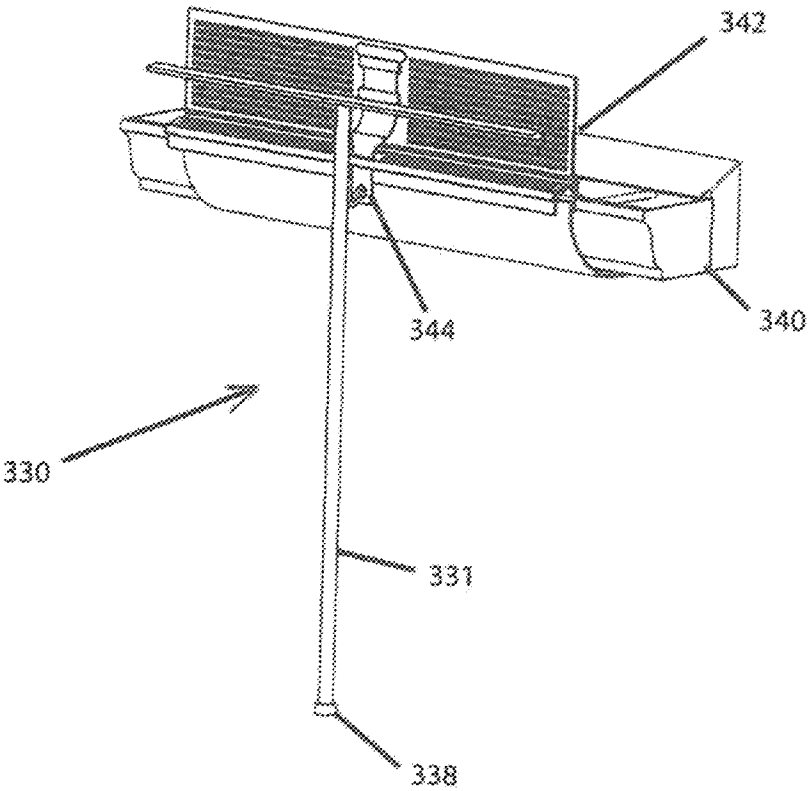
FIG. 32 is a perspective view of a debris collector of the disclosed technology along with a poling tool with a cleaning head of the disclosed technology.
Figure 33:
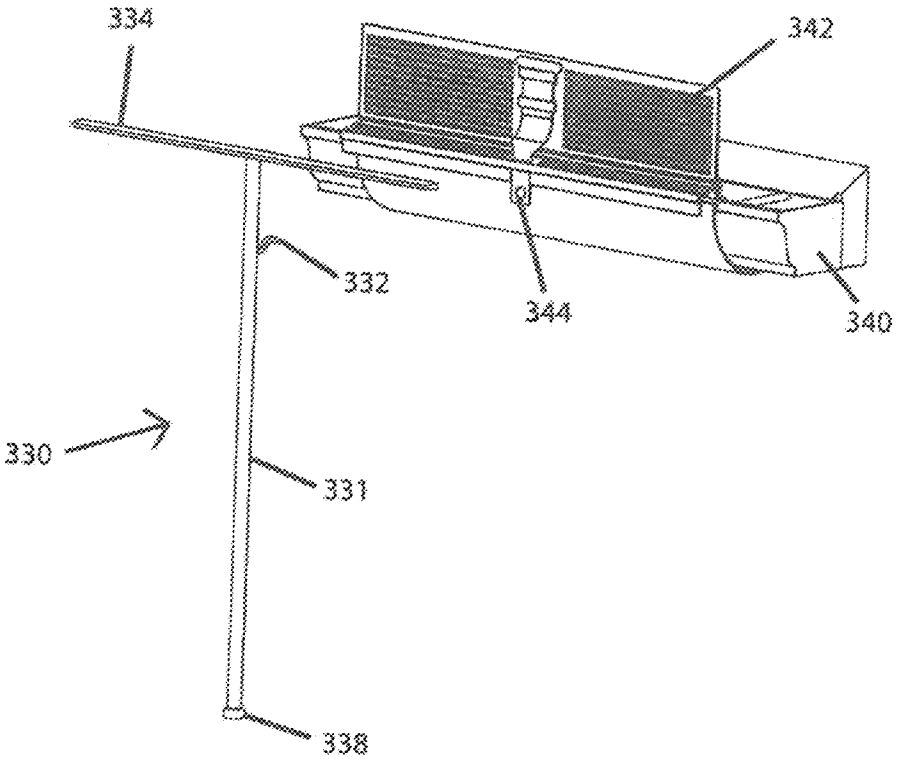
FIG. 33 is a perspective view of a debris collector of the disclosed technology along with a poling tool with a cleaning head of the disclosed technology.

In some implementations, as shown in FIGS. 31-33, a poling tool 330 is used to rotate a debris collector 342 from a gutter system 340. In use, a tip 332 of the poling tool 330 can be inserted a pull tab 344 of the debris collector 342. Once inserted, a user can apply downward pressure to the poling tool 330 so that debris collector 342 is rotated out of the gutter system 324 into an inverted, cleaning position. Once the debris collector 342 is placed in the inverted position most if not all of the debris will fall away from the debris collector 322 and down to the ground. In some implementations, the poling tool 330 can also include a hollow rod 331, a cleaning head 334 with nozzles 336 and a garden hose attachment 338. A garden hose (not shown) can be attached to the garden hose attachment 338. If some debris remains on the debris collector 342, a water stream from a garden hose can be directed up the hollow rod 331 to the cleaning head 334 and out of the nozzles 336. The water stream can be directed at a face of the debris collector 342 for clearing any remaining debris. After the debris collector 342 is rinsed, the user can push the poling tool 330 in an upwards direction causing the debris collector 342 to rotate to its seated position covering the gutter system 340. In some implementations, the poling tool 330 can include a valve for controlling the on/off and the pressure of the water stream.

Figure 34:
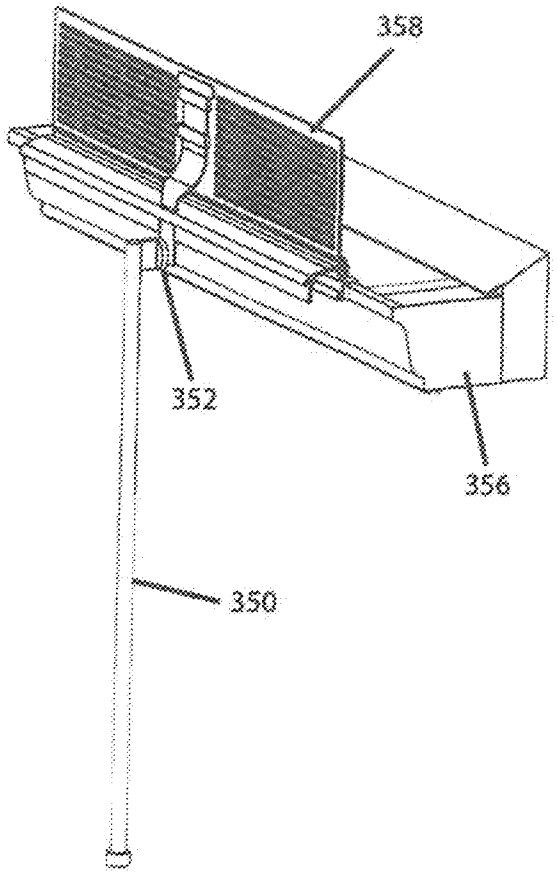
FIG. 34 is a perspective view of a debris collector of the disclosed technology along with a magnetic poling tool of the disclosed technology.
Figure 35:
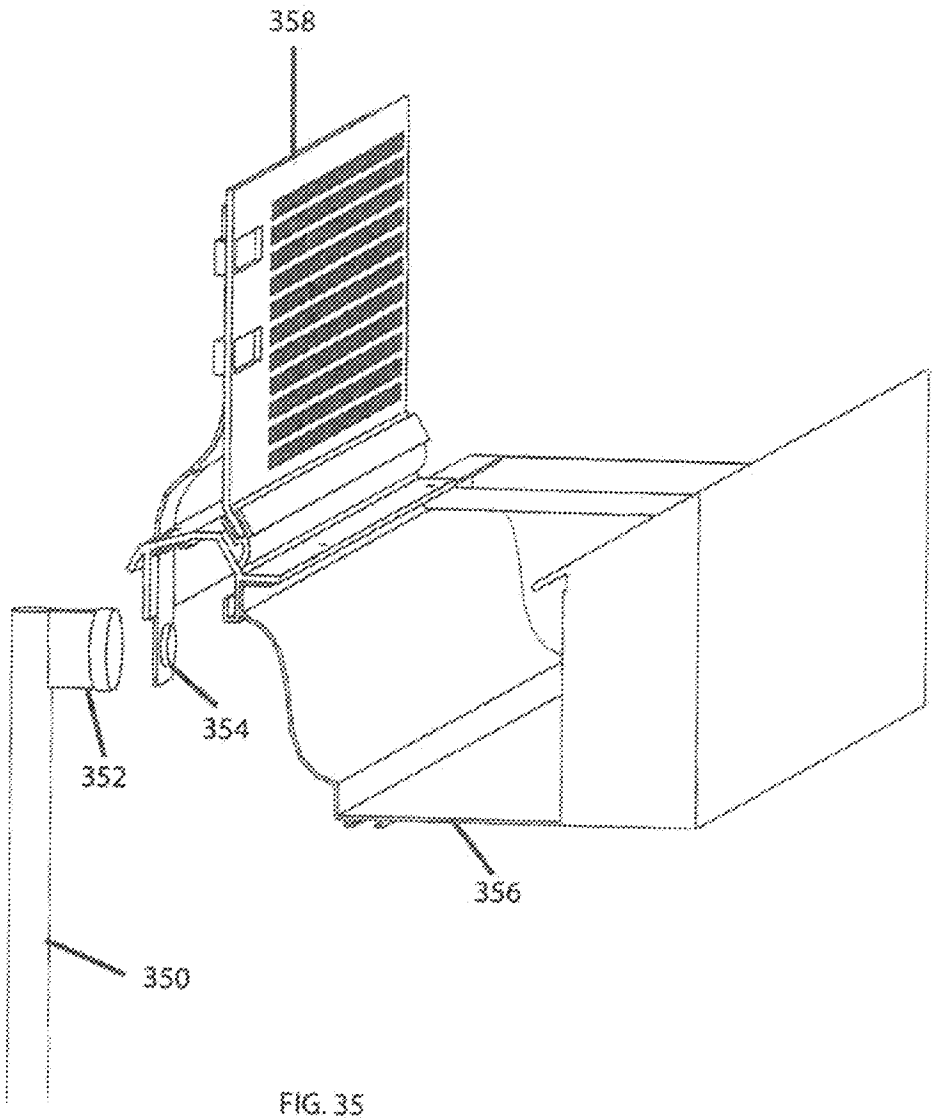
FIG. 35 is a perspective view of a debris collector of the disclosed technology along with a magnetic poling tool of the disclosed technology.
Figure 36:
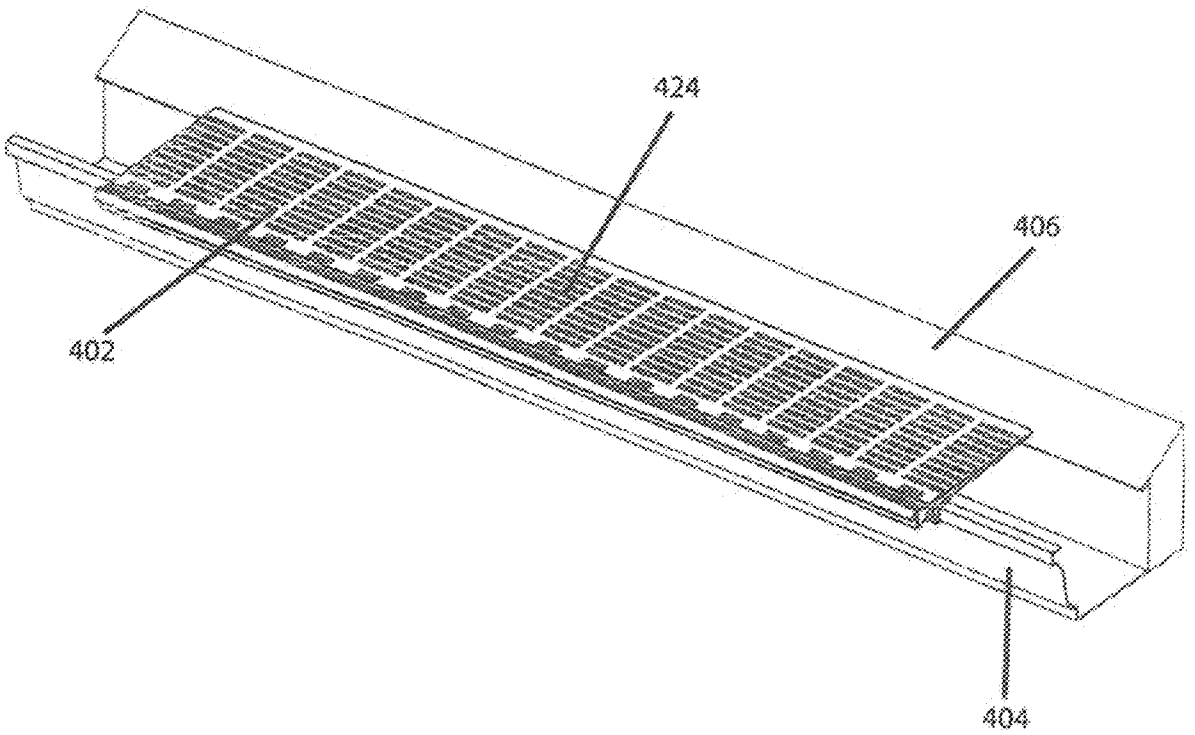
FIG. 36 is a perspective view of a debris collector of the disclosed technology in a first position.

In some implementations, as shown in FIGS. 34-35, a poling tool 350 can be used to rotate a debris collector 358 out of a gutter system 356. In use, a magnetic tip 352 of the poling tool 350 can be magnetically attracted to a magnetic pull tab 354 of the debris collector 358. Once magnetically secured to one another, a user can apply downward pressure to the poling tool 350 so that debris collector 358 is rotated out of the gutter system 356 into an inverted, cleaning position. Once the debris collector 358 is placed in the inverted position most if not all of the debris will fall away from the debris collector 358 and down to the ground. If some debris remains within the debris collector 358, a stream of a garden hose can be directed the debris collector 358 for clearing any remaining debris. After the debris collector 358 is cleaned out, the user can push the poling tool 350 in an upwards direction causing the debris collector 358 to rotate to its seated position. The user can then laterally slide the poling tool to the left or right so that the magnetic attraction between the magnetic tip 352 and the magnetic pull tab 354 can be removed.

Figure 38:
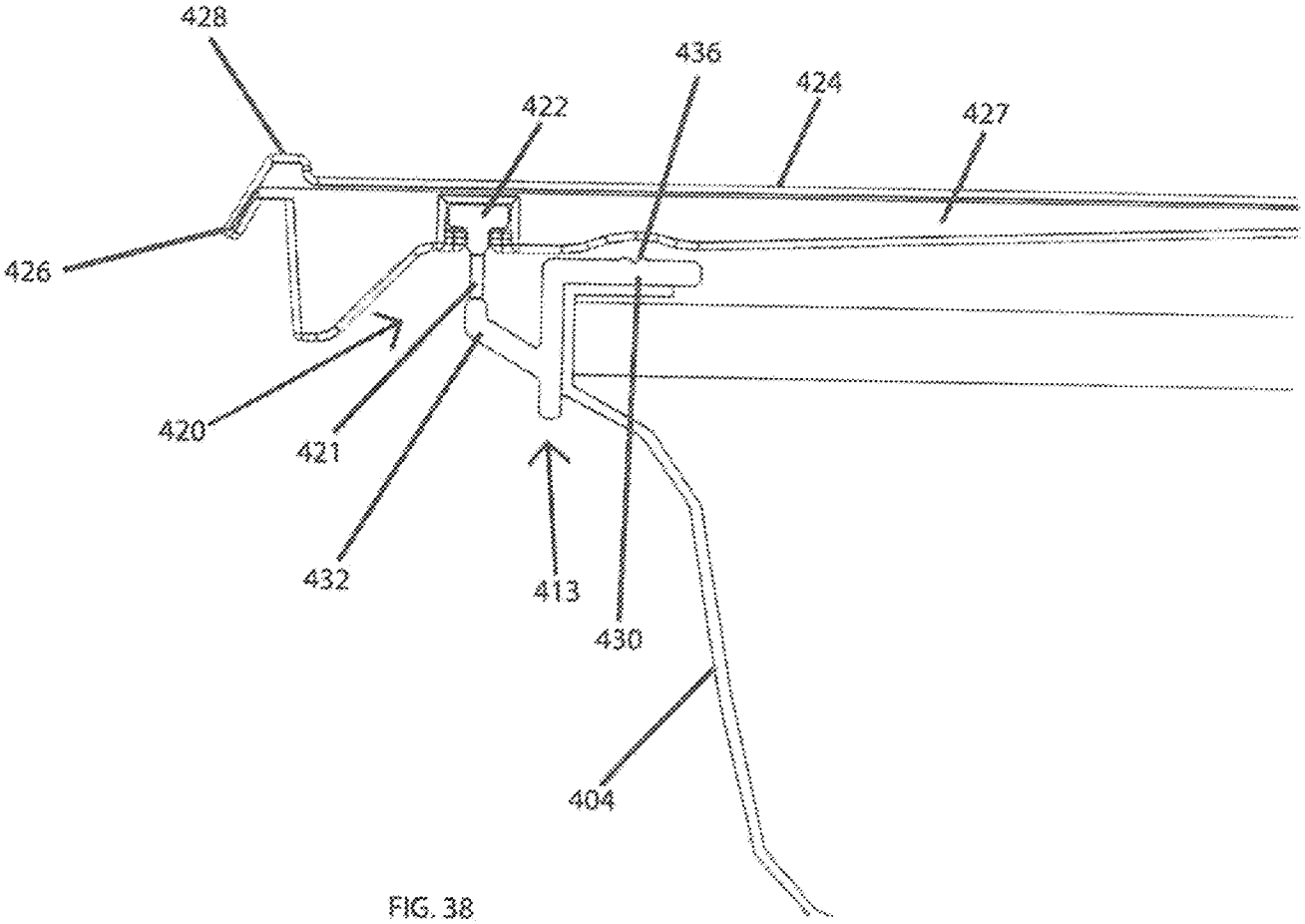
FIG. 38 is an exploded view of the cross-sectional view shown in FIG. 37.
Figure 39:
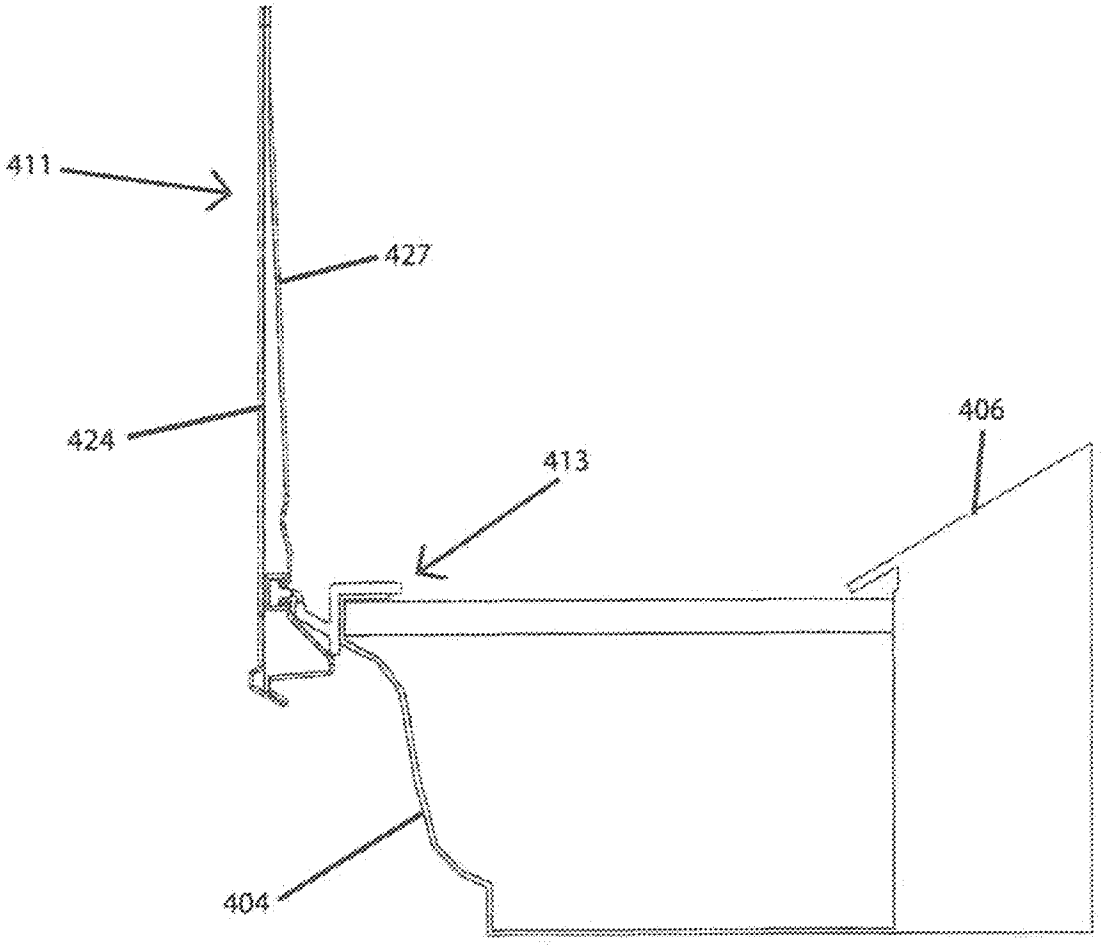
FIG. 39 is a cross-sectional view of the debris collector shown in FIG. 36 in a second position.
Figure 43:
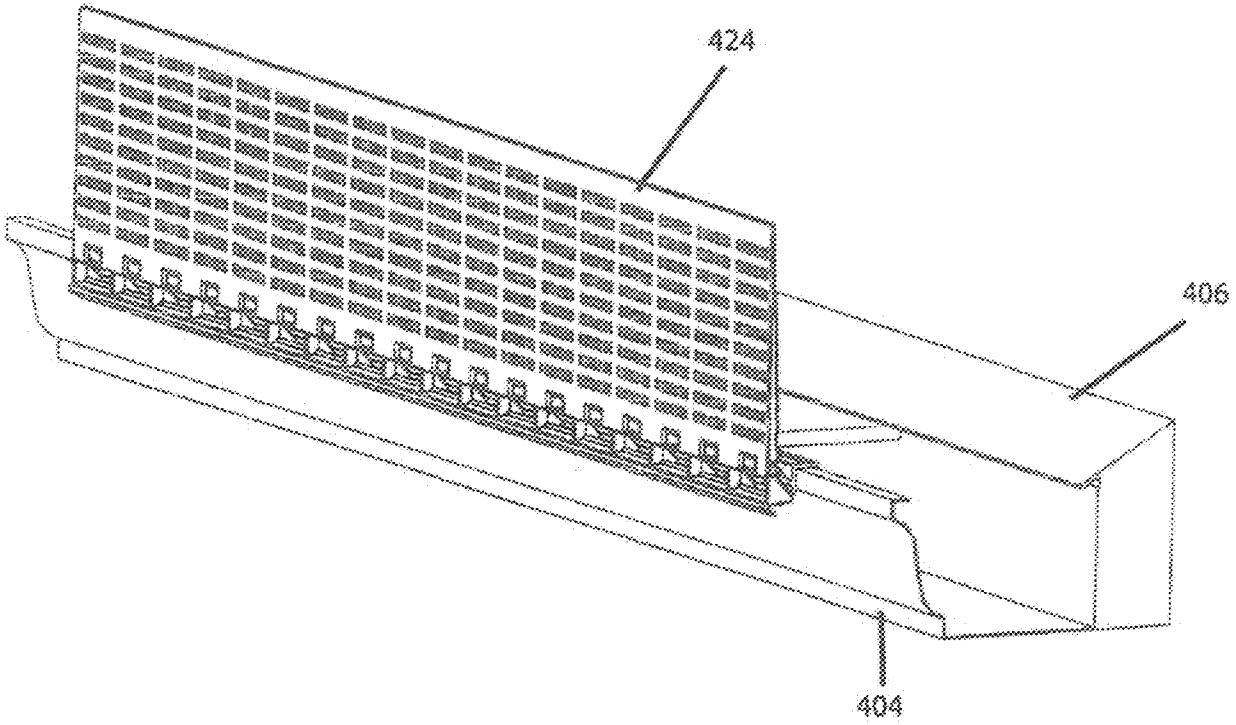
FIG. 43 is a perspective view of the debris collector shown in FIG. 36 in a second position.
Figure 44:
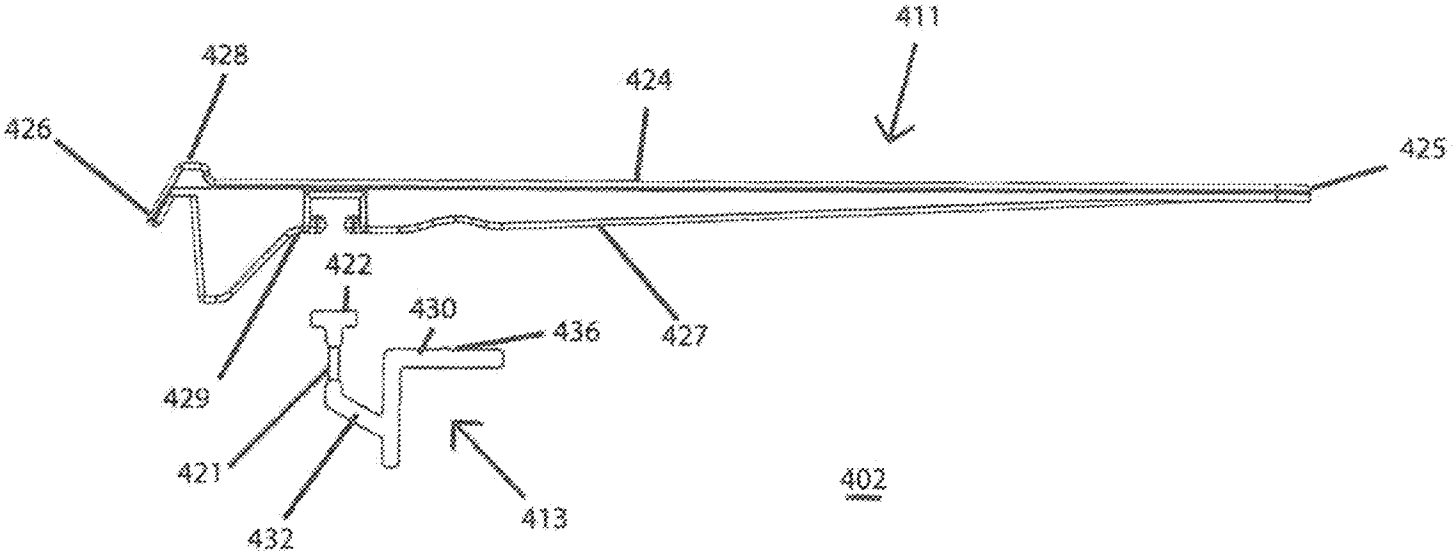
FIG. 44 is a cross-sectional view of a collection assembly and a mounting assembly shown in FIG. 36 in a disassembled state.
Figure 45:
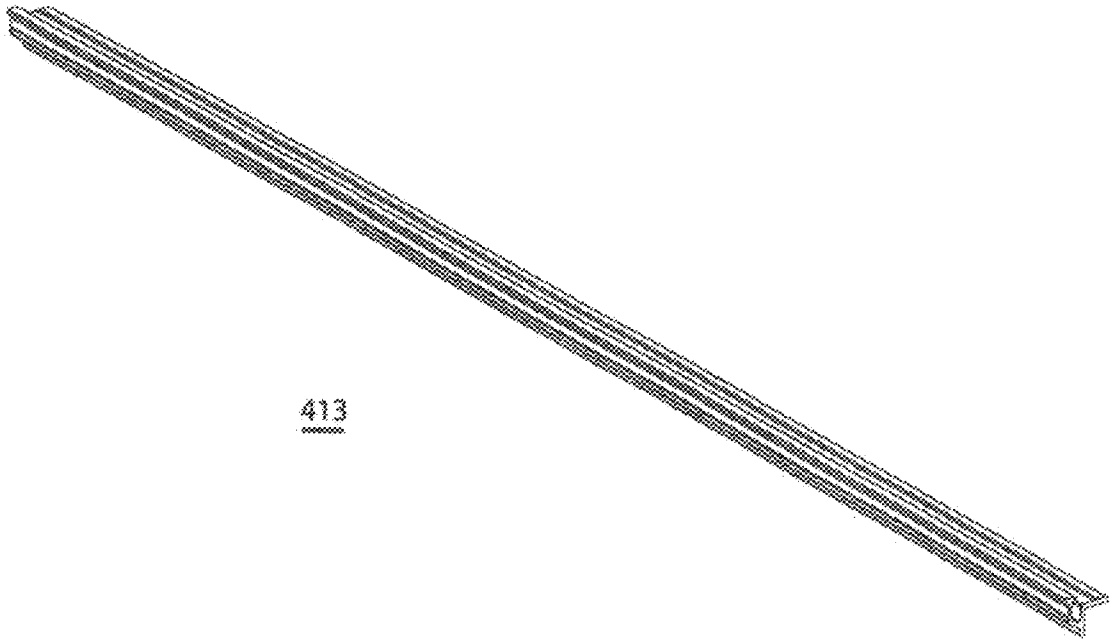
FIG. 45 is a perspective view a mounting assembly of the debris collector shown in FIG. 36.
Figure 46:
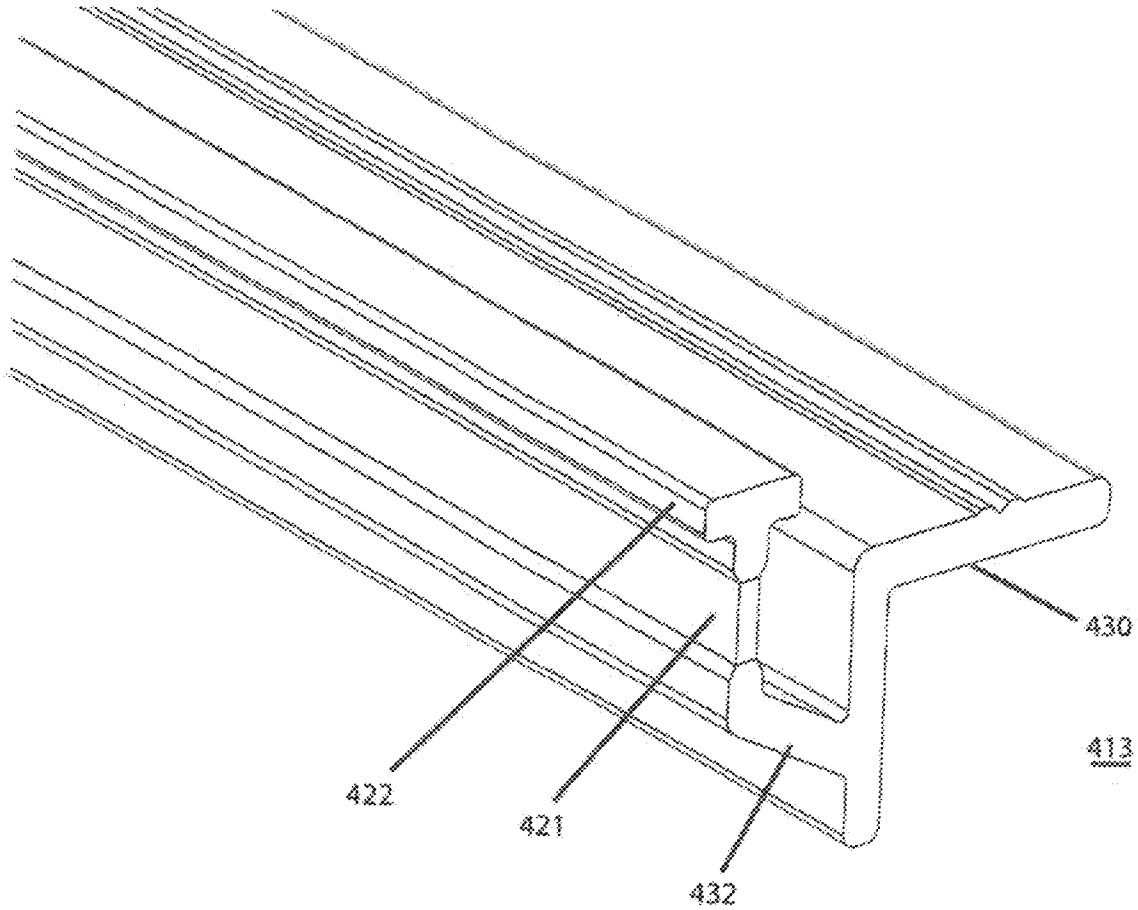
FIG. 46 is an exploded view of the mounting assembly shown in FIG. 45.
Figure 47:
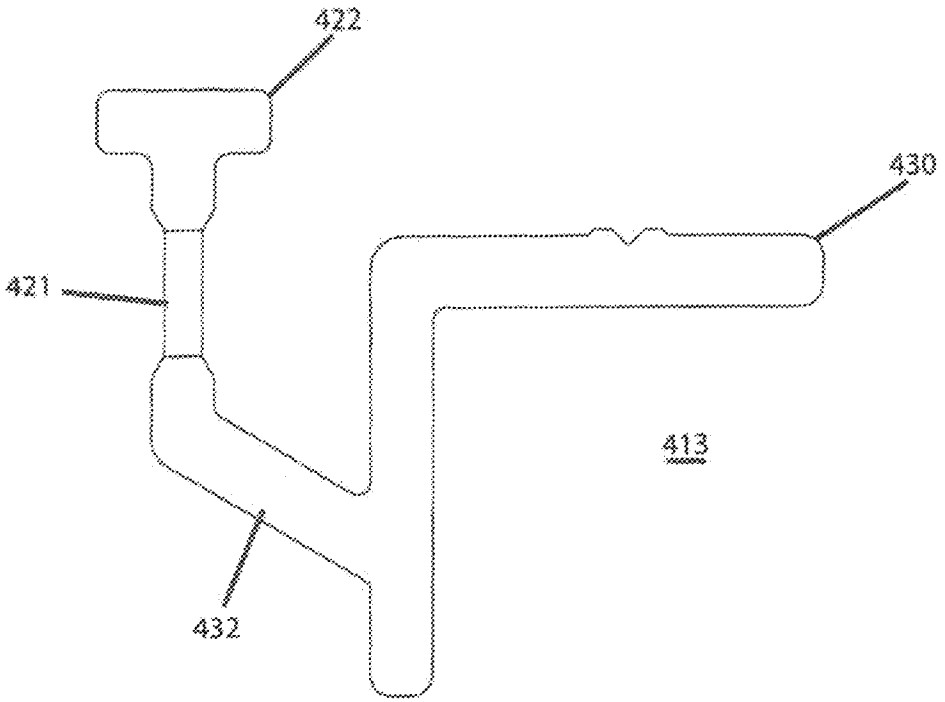
FIG. 47 is a side view of the mounting assembly shown in FIG. 45 in a first position.
Figure 48:
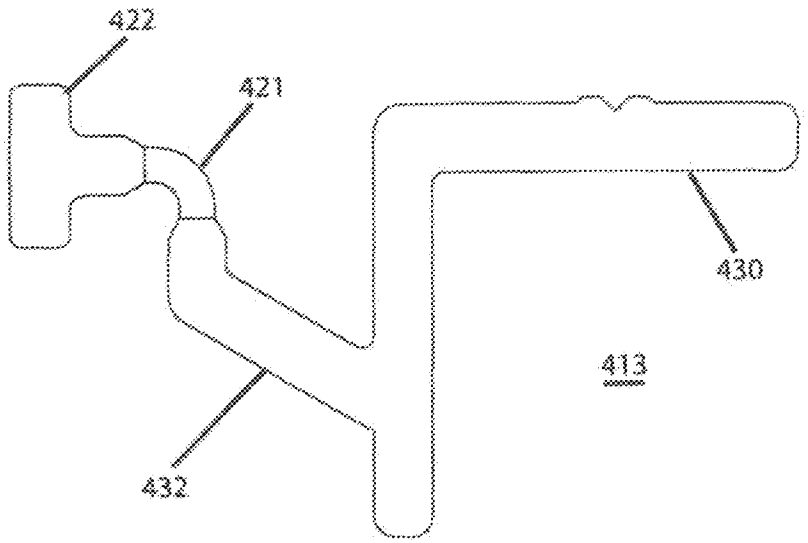
FIG. 48 is a side view of the mounting assembly shown in FIG. 45 in a first position.
Figure 49:
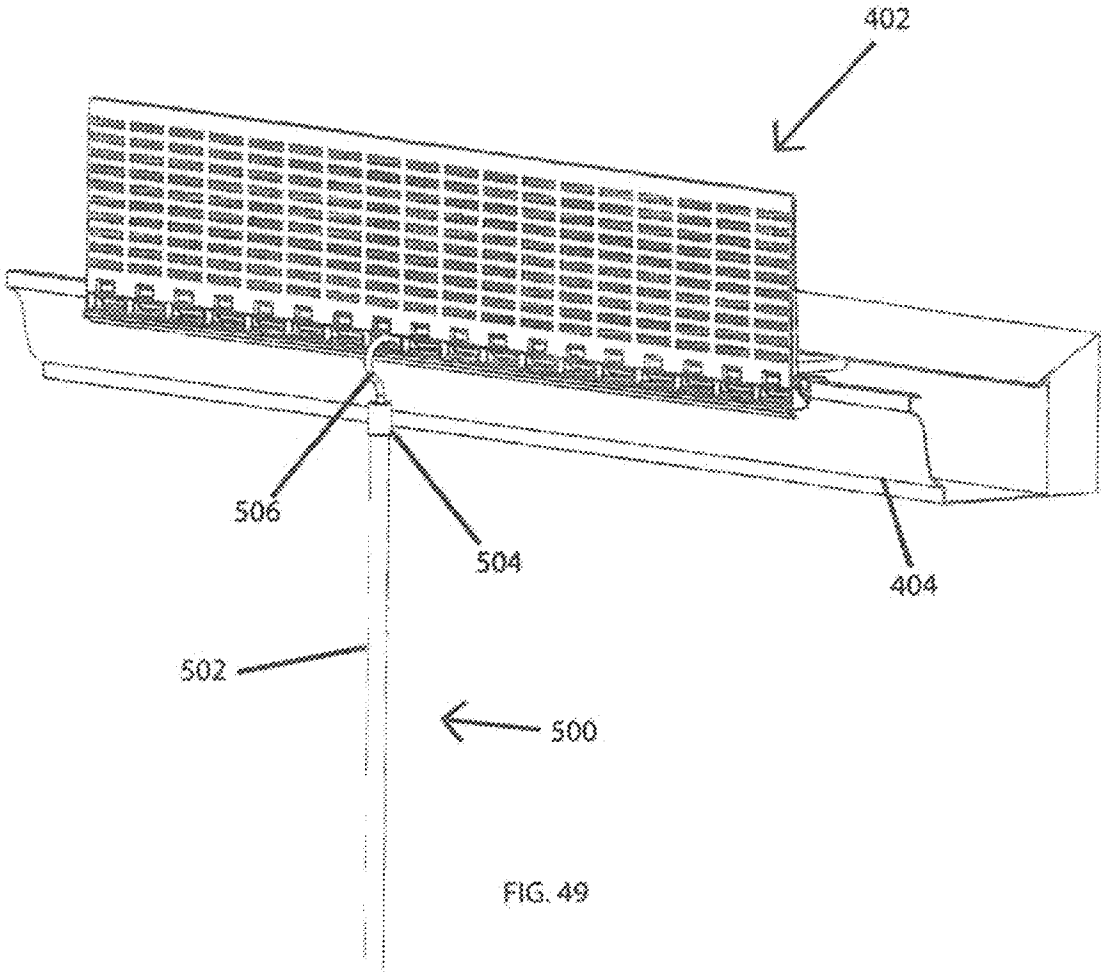
FIG. 49 is a perspective view of the debris collector of FIG. 36 in a second position with a poling tool.
Figure 50:
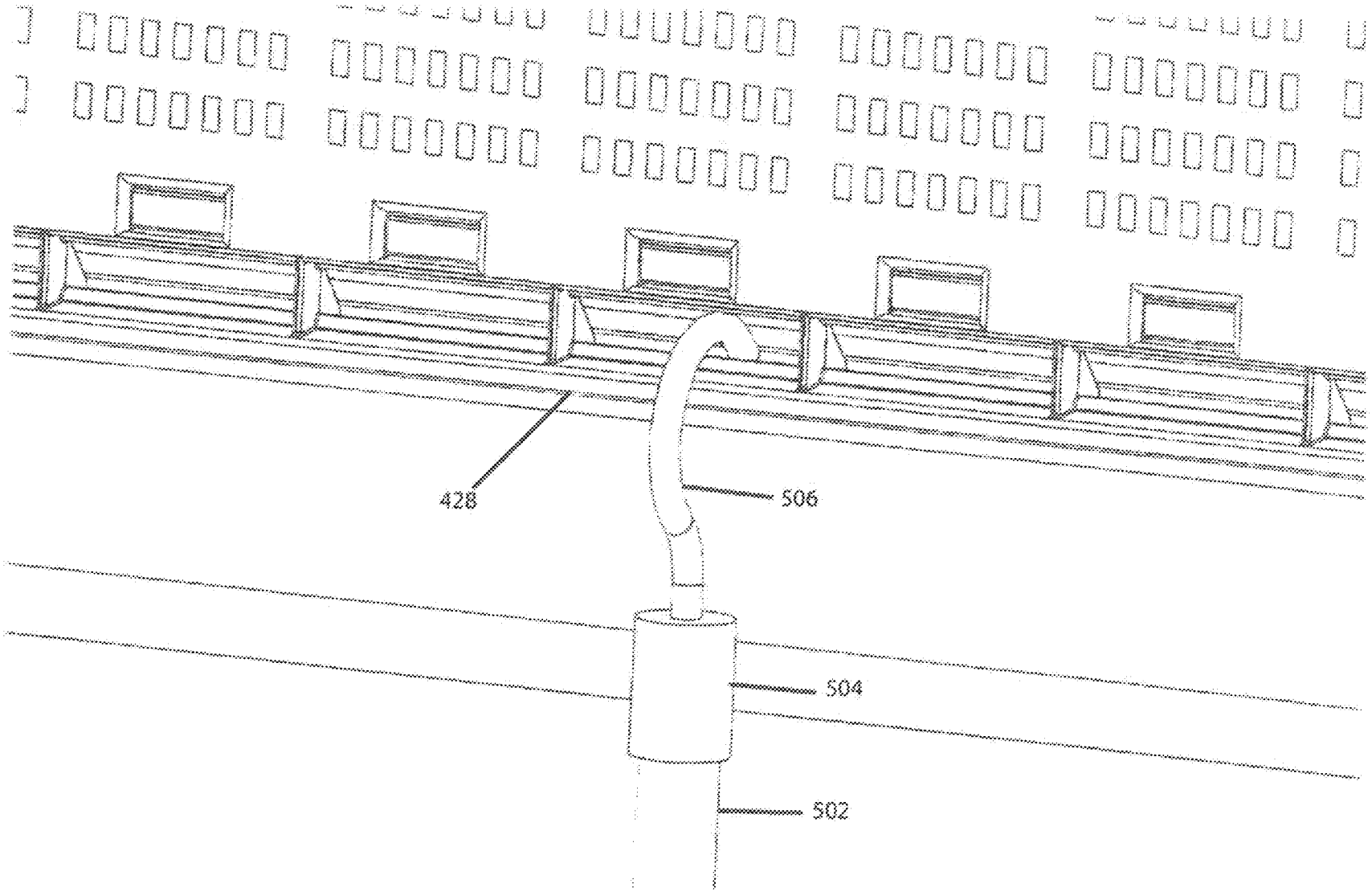
FIG. 50 is an exploded view of the debris collector and the poling tool shown in FIG. 49.

In some implementations, as shown in FIGS. 36-48, a debris collector 402 installed on a gutter 404 can include a collection assembly 411 and a mounting assembly 413. The collection assembly 411 and the mounting assembly 413 can be movably connected to each other with a hinge 420. The hinge 420 allows the debris collector 402 to move from a first position, shown in FIGS. 36-38, to a second position, shown in FIGS. 39-40 and 43. The first position allows debris to collect on a surface of the collection assembly 411 and the second position allows for removal of the debris from the collection assembly 411.

In some implementations, the collection assembly 411 can be a single unit formed from an injection molding process using polymers, thermoplastics, thermosets, elastomers and combinations thereof, e.g., including but not limited to, polyester, polyphenylene, polypropylene, polystyrene and polyvinyl. In other implementations, the collection assemblies can be made from malleable metallic materials and/or other plastic compositions and components.

The collection assembly 411 of the debris collector 402 can include a screen section 424, a reinforcement structure 427, a front section 426 and a back edge 425.

In some implementations, the screen section 424 can be laid out in a grid pattern with a top surface of the screen section 424 being substantially flat and rectangular but other configurations are contemplated. The grid pattern of the screen section 424 allows water to flow onto and through the screen section 424 of the debris collector 402 but retains any debris that collects on a top surface of the screen section 424.

Figure 37:
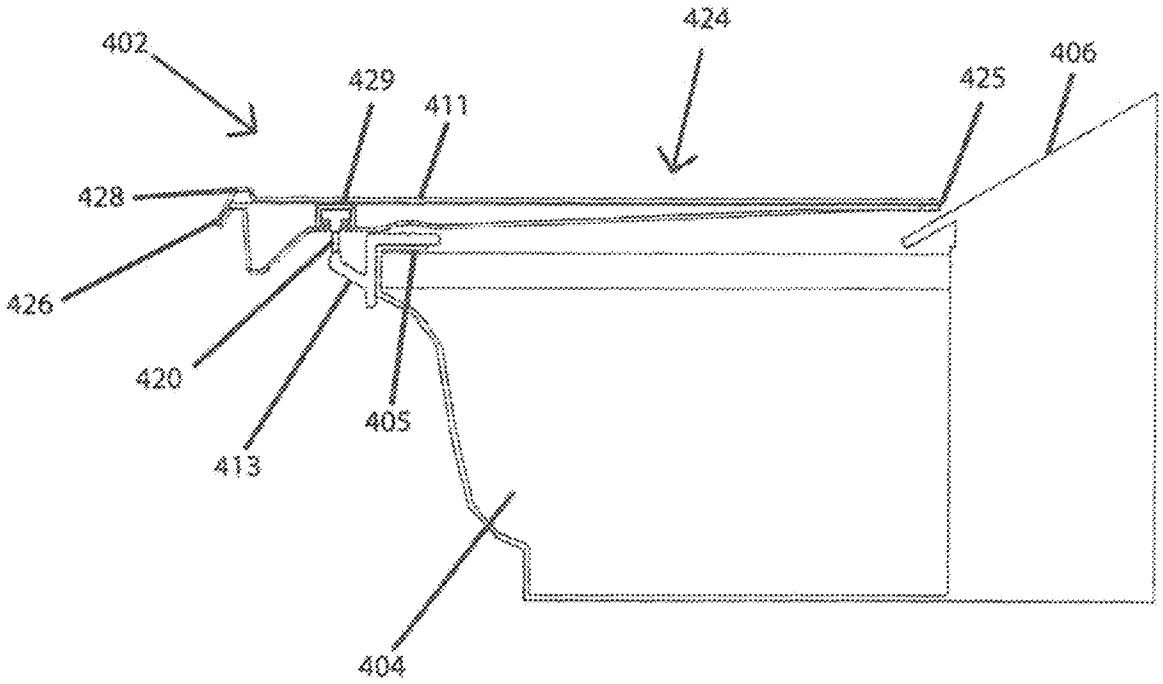
FIG. 37 is a cross-sectional view of the debris collector shown in FIG. 36 in a first position.

The back edge 425 of the debris collector 402 is capable of resting on or in close proximity to a roof 406, as shown in FIG. 37. In use, the back edge 425 allows water and debris to flow from a roof surface over the screen section 424.

The front section 426 of the debris collector 402 can include a grab rail 428. The grab rail 428 can be positioned along the front section 426 of the collection assembly 411, but other configurations are contemplated. The grab rail 428, when actuated by a poling tool 500, as shown in FIGS. 49-53, acts as a lever and allows the debris collector 402 to be moved from the first position to the second position and vice versa. In use, a user can rotate the debris collector 402 from the first position to a second position via the hinge 420.

The front section 426 of the debris collector 402 can also include a tee receiver guide 429 for receiving the hinge 420. That is, the tee receiver guide 429 can comprise fingers 429*a*, 429*b* for slidably receiving a tee section 422 of the hinge 420, shown in FIG. 42 and described more fully below.

Figure 40:
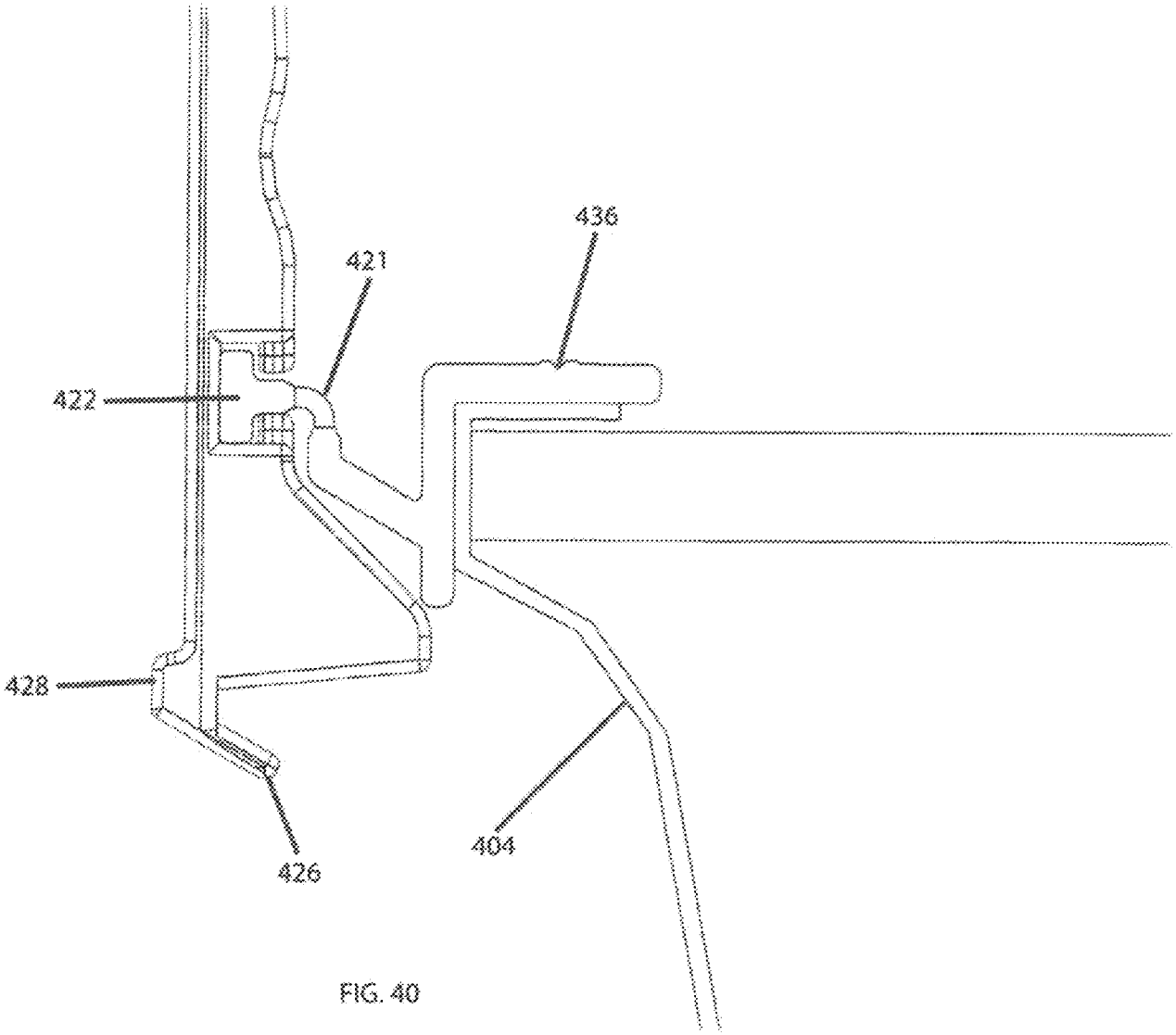
FIG. 40 is an exploded view of the cross-sectional view shown in FIG. 39.
Figure 41:
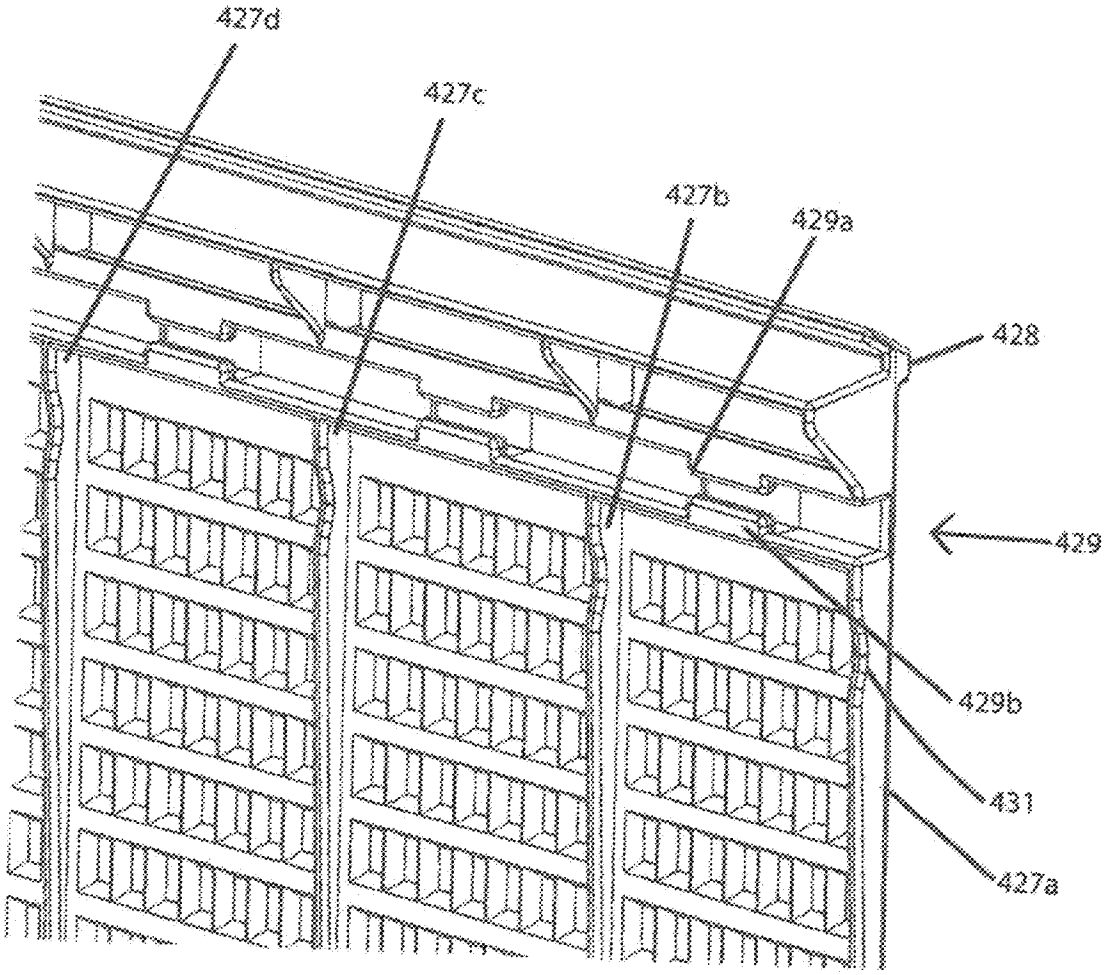
FIG. 41 is an exploded view of a rear side of a collection assembly of the debris collector shown in FIG. 36.
Figure 42:
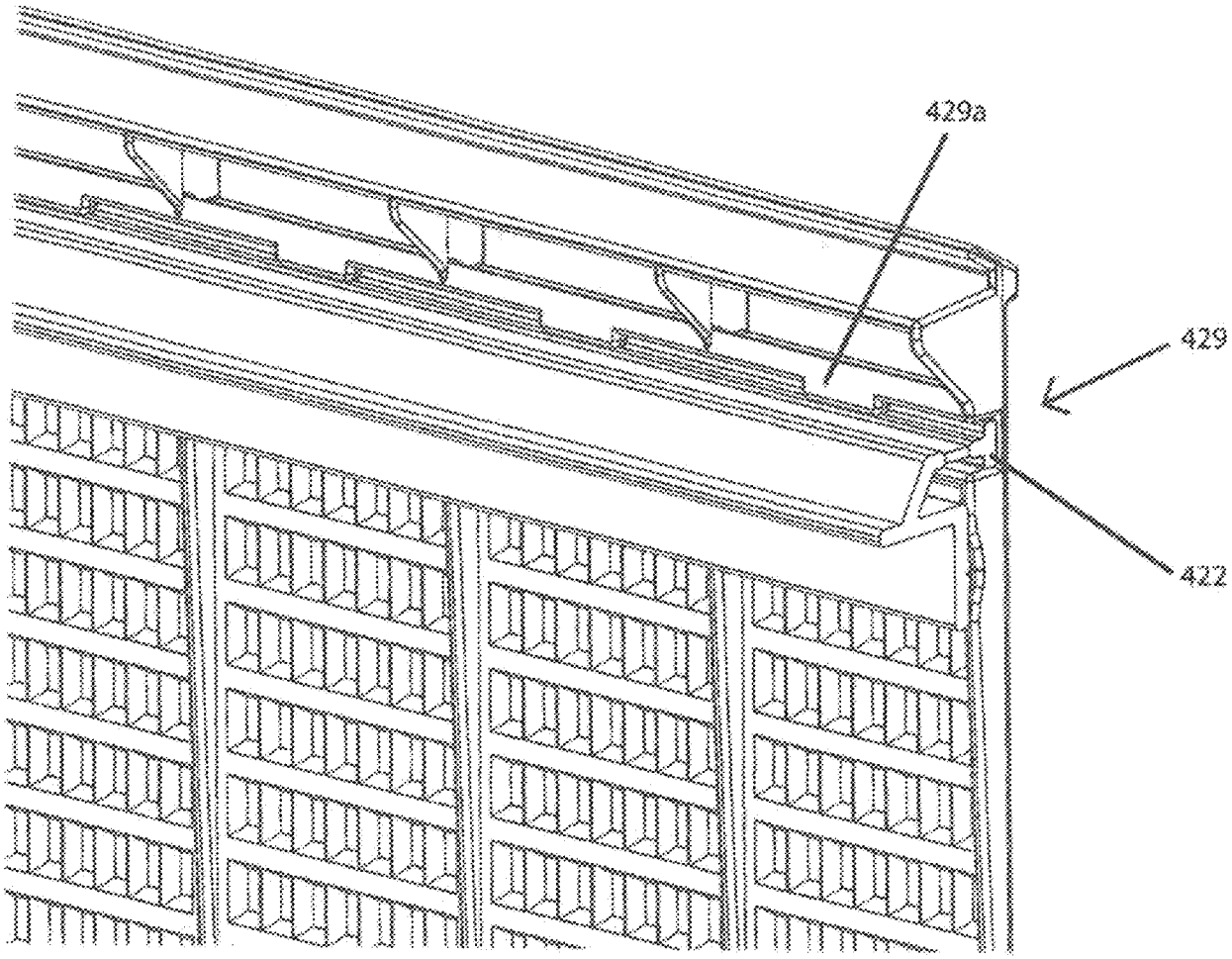
FIG. 42 is an exploded view of a rear side of a collection assembly and a mounting assembly of the debris collector shown in FIG. 36.

The reinforcement structure 427 of the debris collector 402 can include reinforcement strips 427*a-d*, as shown in FIGS. 40-41. The reinforcement strips 427*a-d* provide support for the screen section 424 as the screen section 424 is capable of receiving large and/or heavy amounts of debris from the roof. The reinforcement strips 427*a-d* can also include indents 431 for providing spacing for screw location ribs 436, described below.

The mounting assembly 413 of the debris collector 402 can include a gutter mounting section 430 and a hinge mounting section 432. The gutter mounting section 430 can be an L-shaped mount for attaching to a gutter rail of roof gutter 405. The gutter mounting section 430 can securely retain the debris collector 402 to the roof gutter system 405. e.g., with screws positioned in screw location ribs 436, but other attachment mechanisms are contemplated, e.g., snap-on components. The hinge mounting section 432 can project from the gutter mounting section 430 at one end and can be fixedly attached to the hinge 420 at the other end.

The hinge 420 can include a hinge section 421 and a tee section 422. The hinge section 421 can be constructed from a flexible material, e.g., a thermoplastic elastomer/rubber while the tee section 422 can be constructed from a solid material e.g., polymers, thermoplastics, thermosets and/or elastomers.

In some implementations, the gutter mounting section 430, the hinge mounting section 432, the hinge section 421 and the tee section 422 can be integrally connected to one another through a co-extrusion process. For example, the gutter mounting section 430, the hinge mounting section 432, and the tee section 422 can be constructed from a solid material e.g., polymers, thermoplastics, thermosets, elastomers while the hinge section 421 can be constructed from a flexible material, e.g., a thermoplastic elastomer/rubber. Other manufacturing processes are contemplated.

To assemble the debris collector 402, the tee section 422 of the hinge 420 can be slidably received by the tee receiver guide 429. Once in place, the debris collector 402 can be screwably mounted to the gutter 404. In some implementations, the collection assembly 411 can be removed and replaced as needed.

Figure 51:
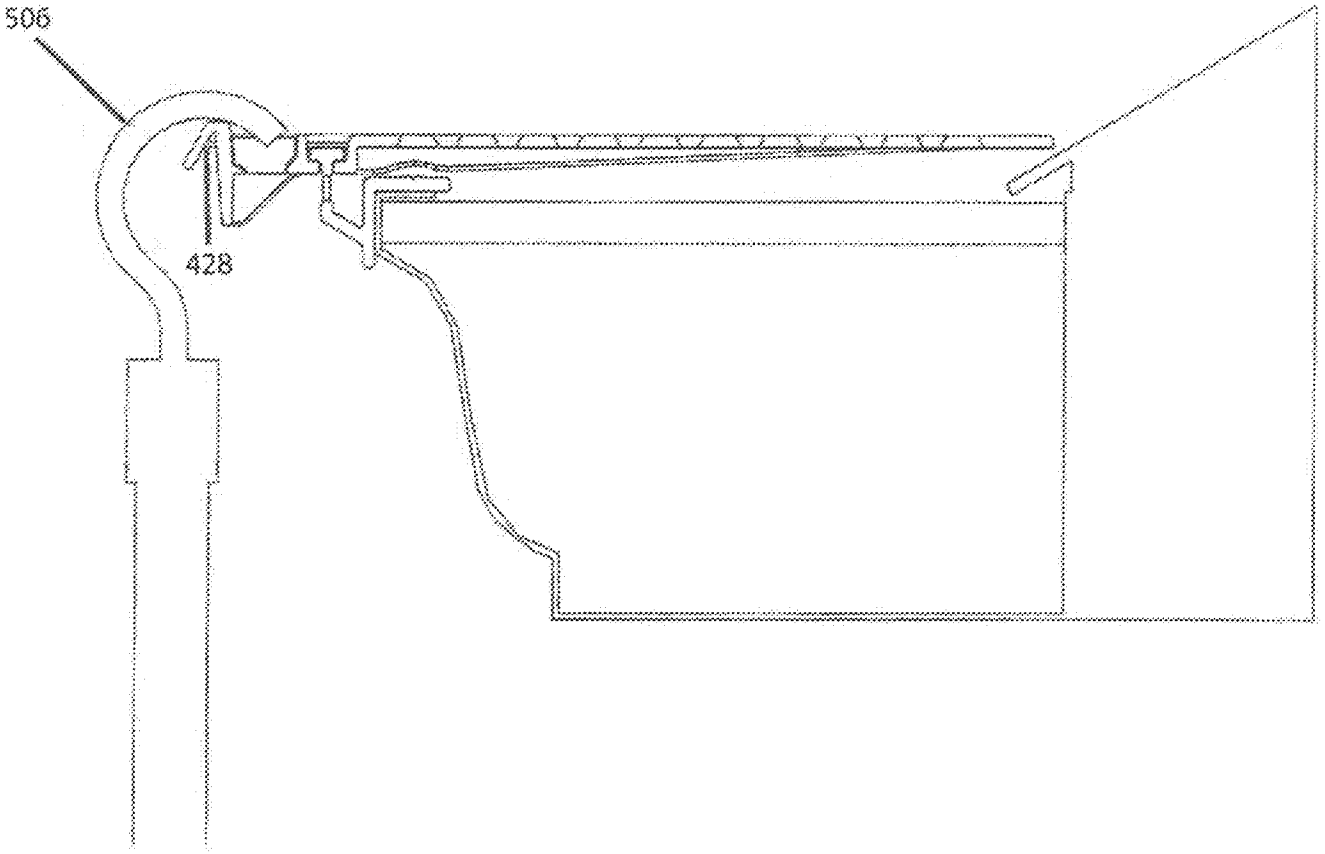
FIG. 51 is a cross-sectional view of a debris collector in a first position with a poling tool.
Figure 52:
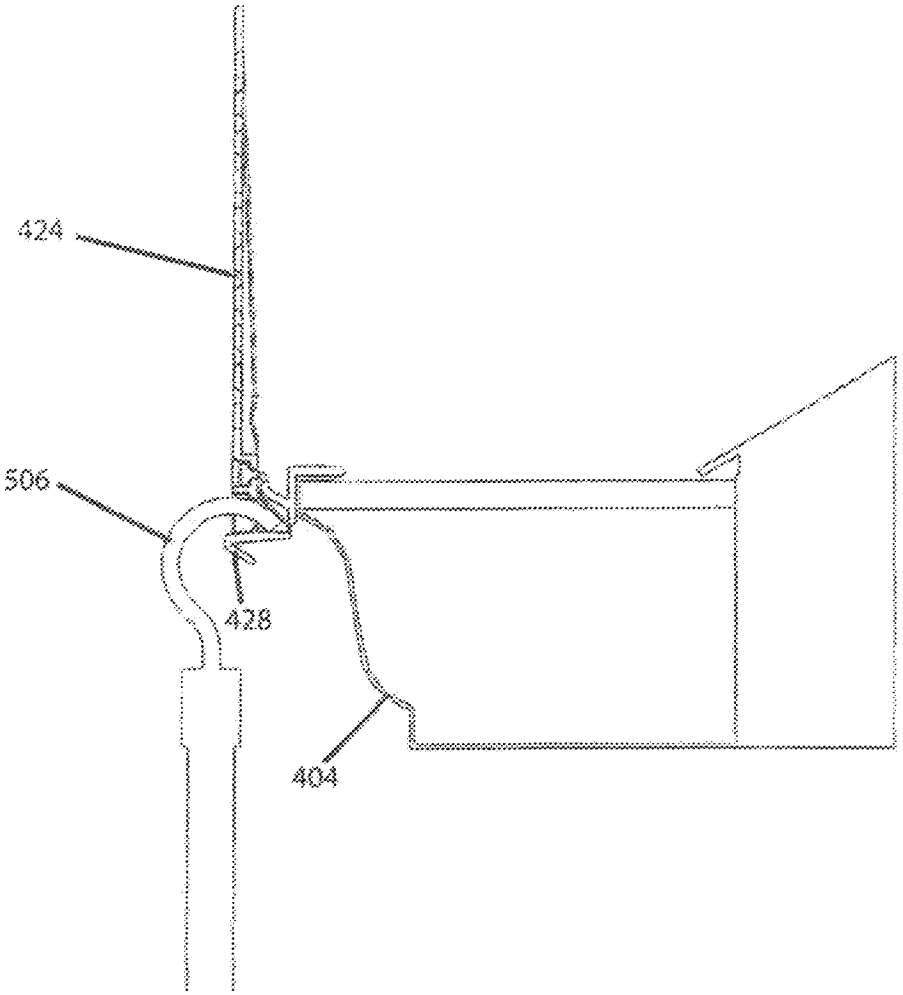
FIG. 52 is a cross-sectional view of the debris collector shown in FIG. 51 in a second position with a poling tool.
Figure 53:
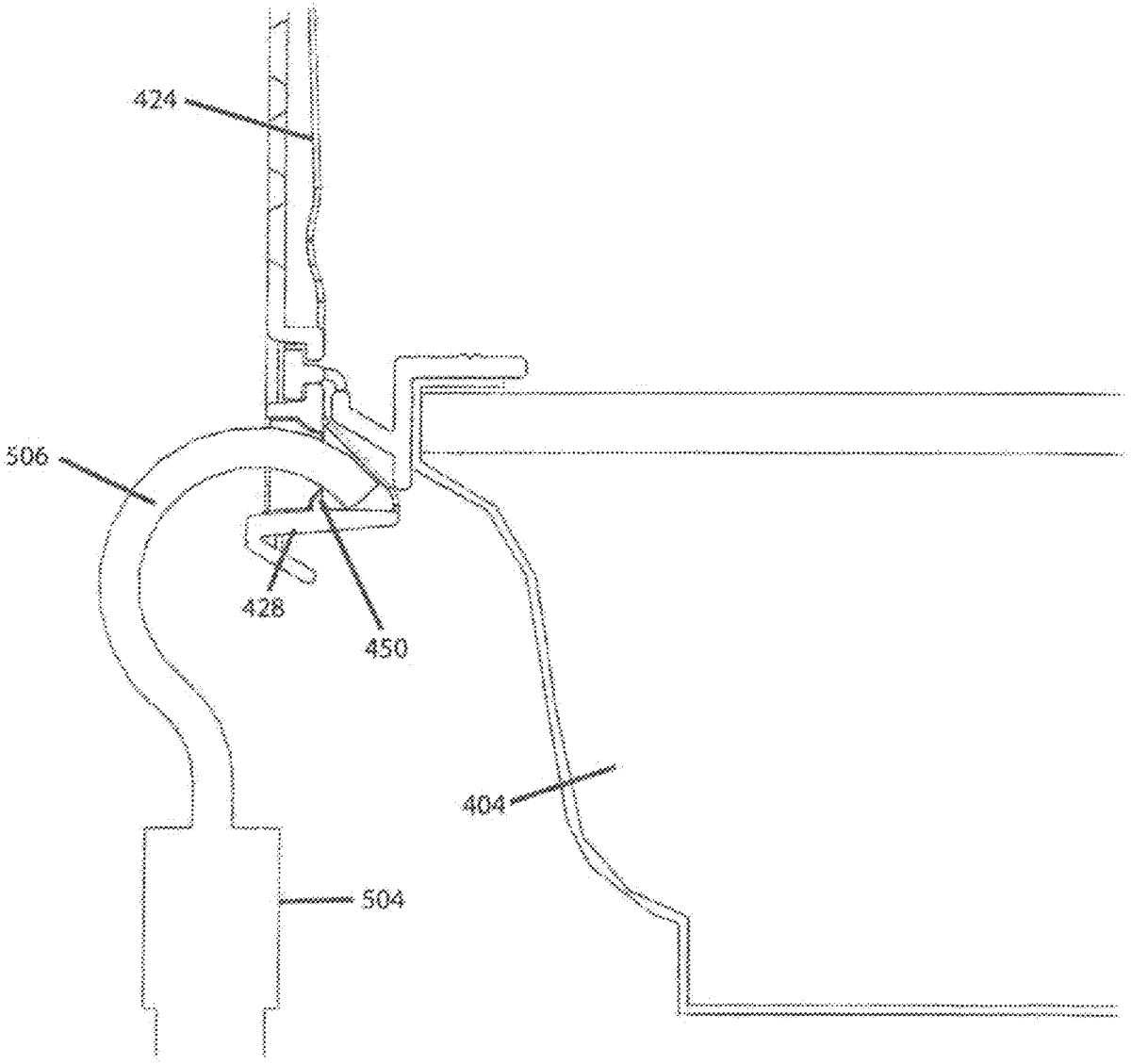
FIG. 53 is an exploded view of the debris collector and the poling tool shown in FIG. 52.
Figure 54:
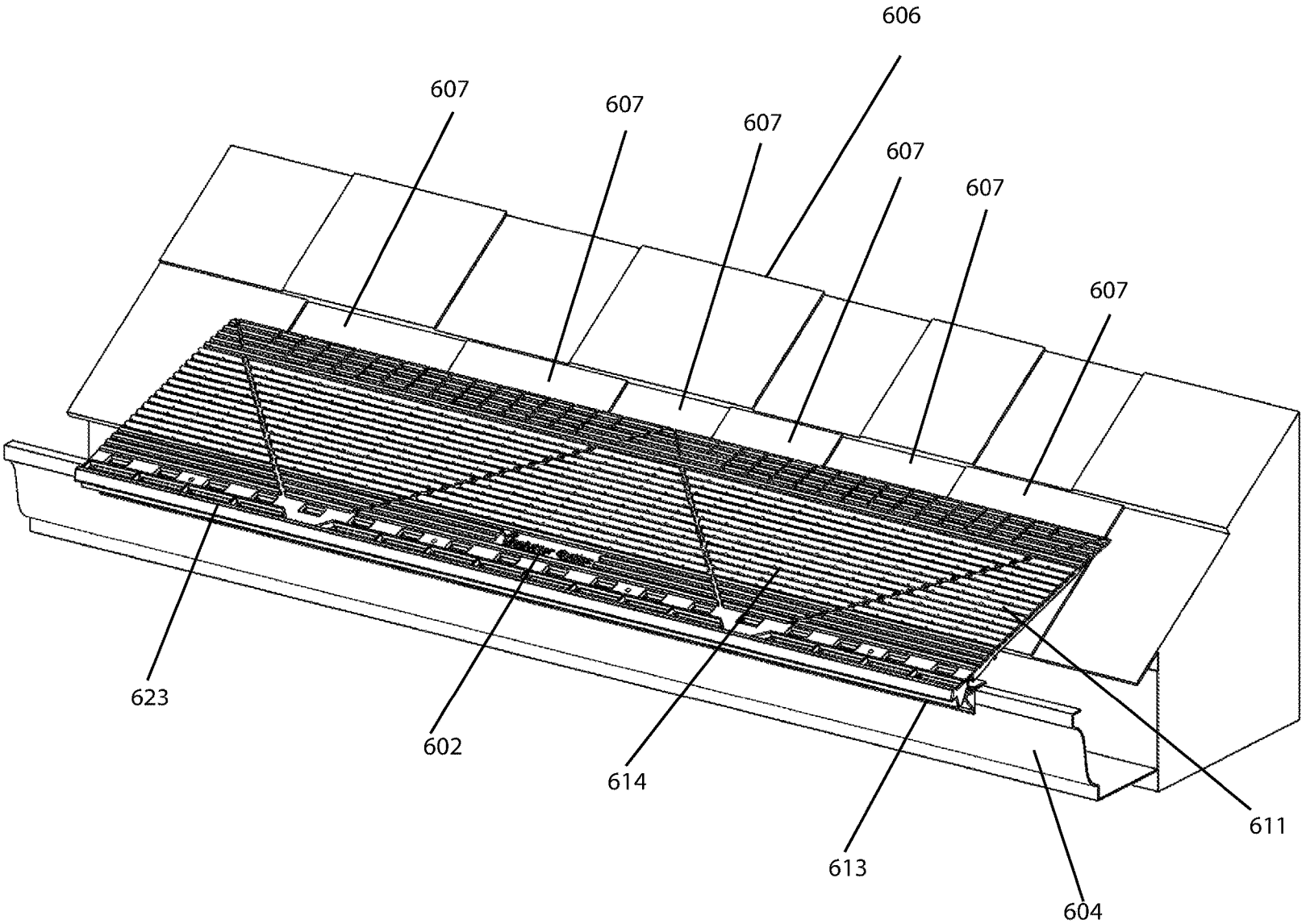
FIG. 54 is a top perspective view of a debris collector of the disclosed technology.
Figure 55:
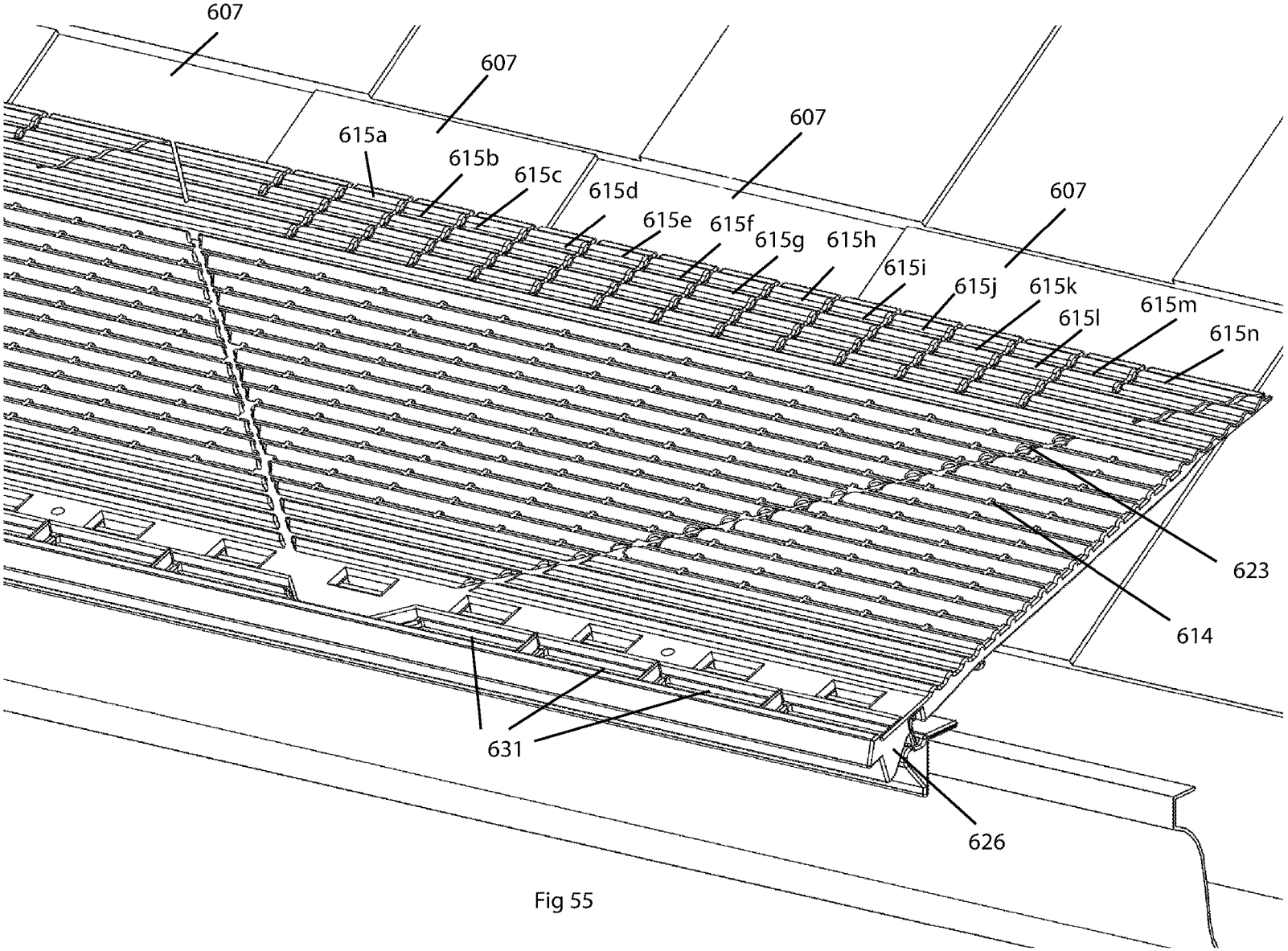
FIG. 55 is a close-up, top perspective view of the debris collector of the disclosed technology as shown in FIG. 54.
Figure 56:
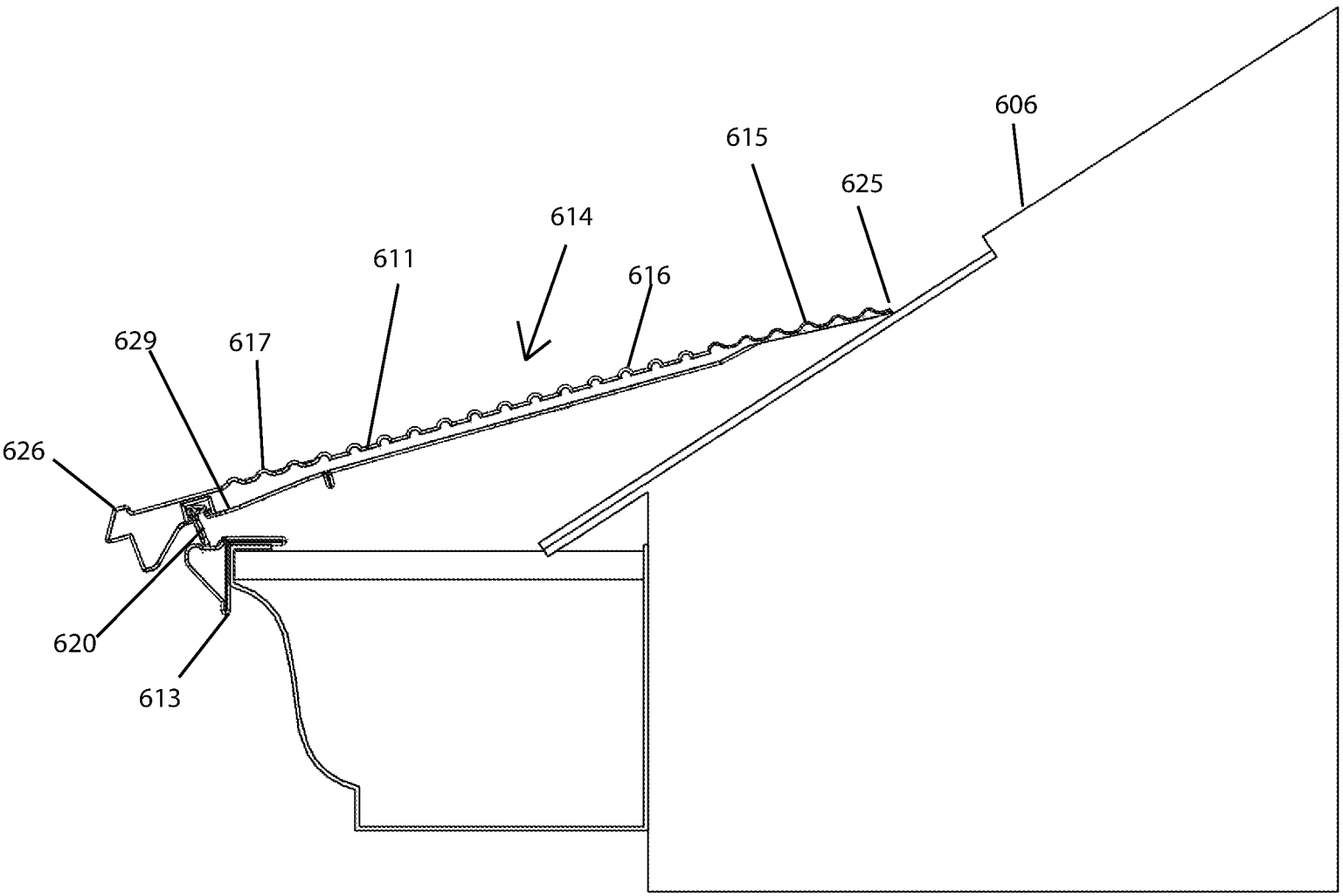
FIG. 56 is a side view of the debris collector of the disclosed technology as shown in FIG. 54.
Figure 57:
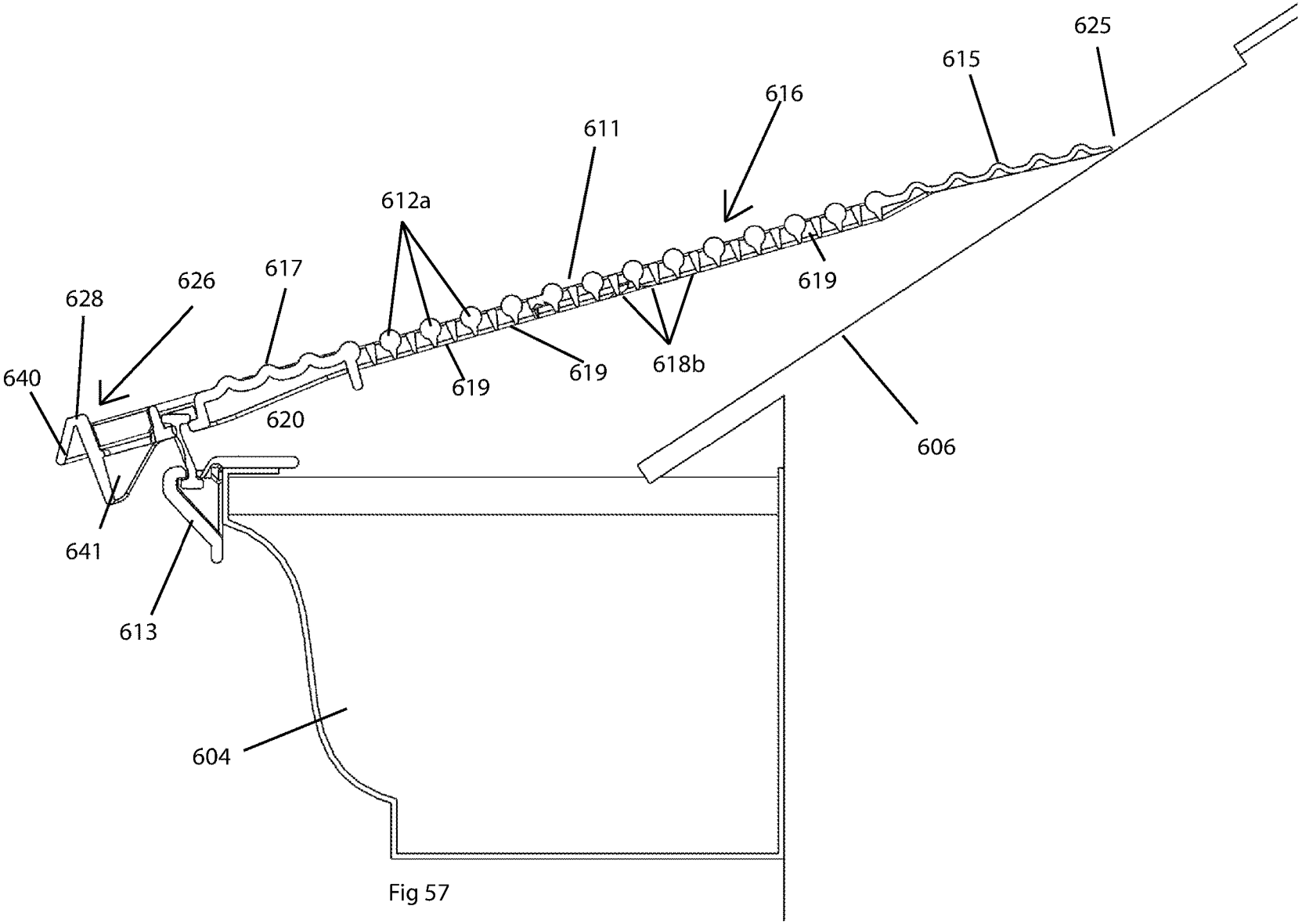
FIG. 57 is a cross-sectional side view of the debris collector of the disclosed technology as shown in FIG. 54.
Figure 58:
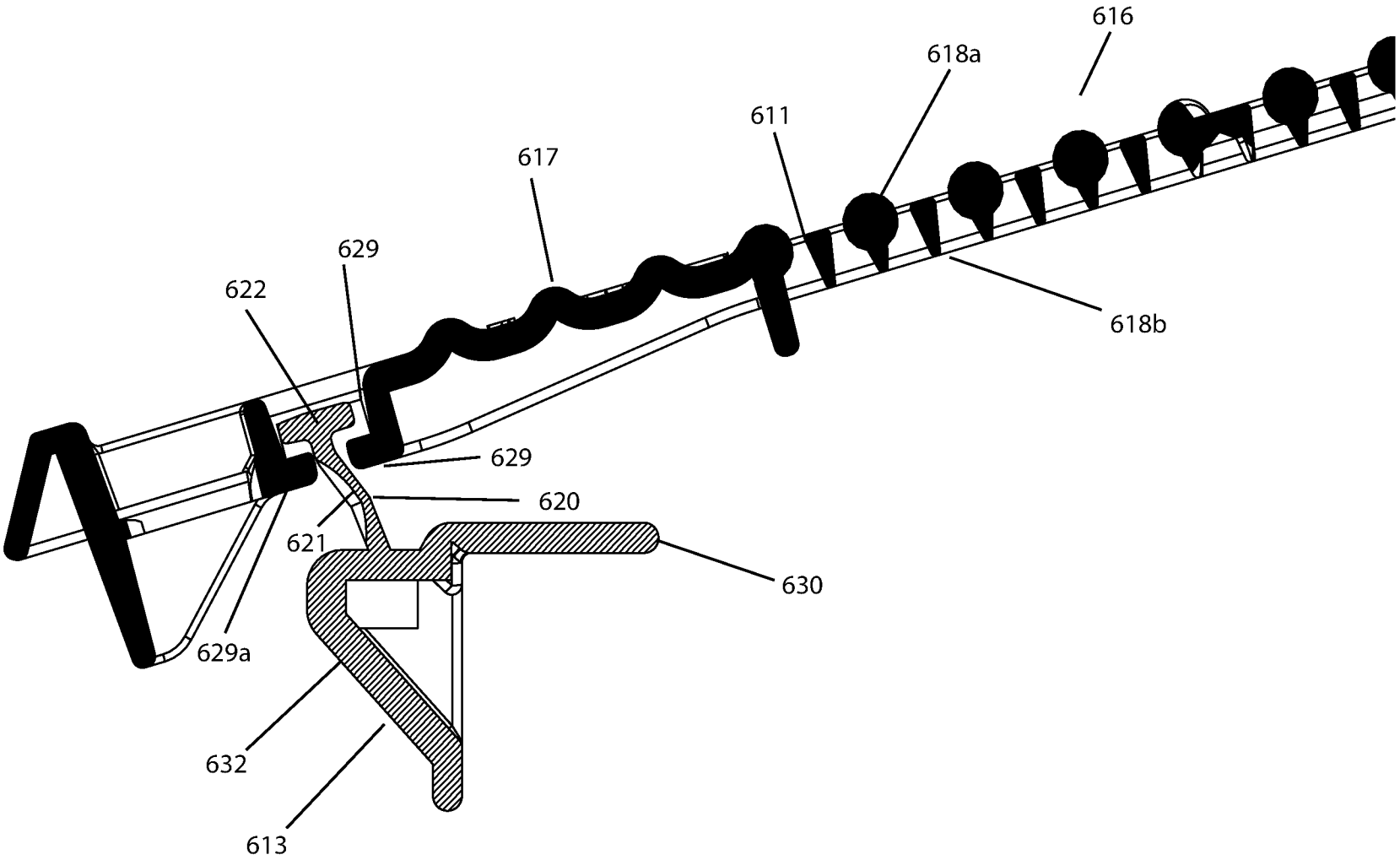
FIG. 58 is a close-up, cross-sectional side view of the debris collector of the disclosed technology as shown in FIG. 54.
Figure 59:
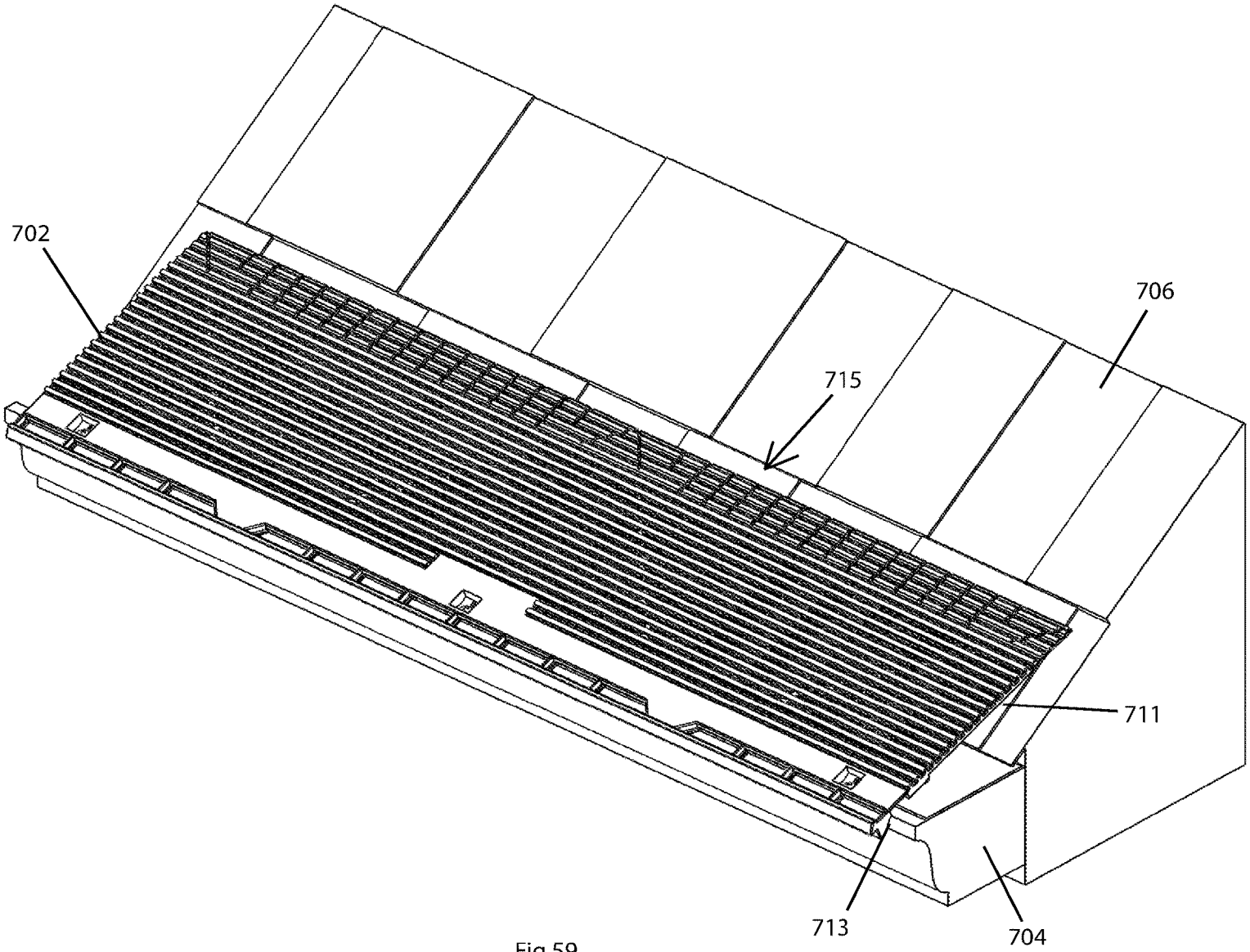
FIG. 59 is a top perspective view of a non-hinged debris collector of the disclosed technology.
Figure 60:
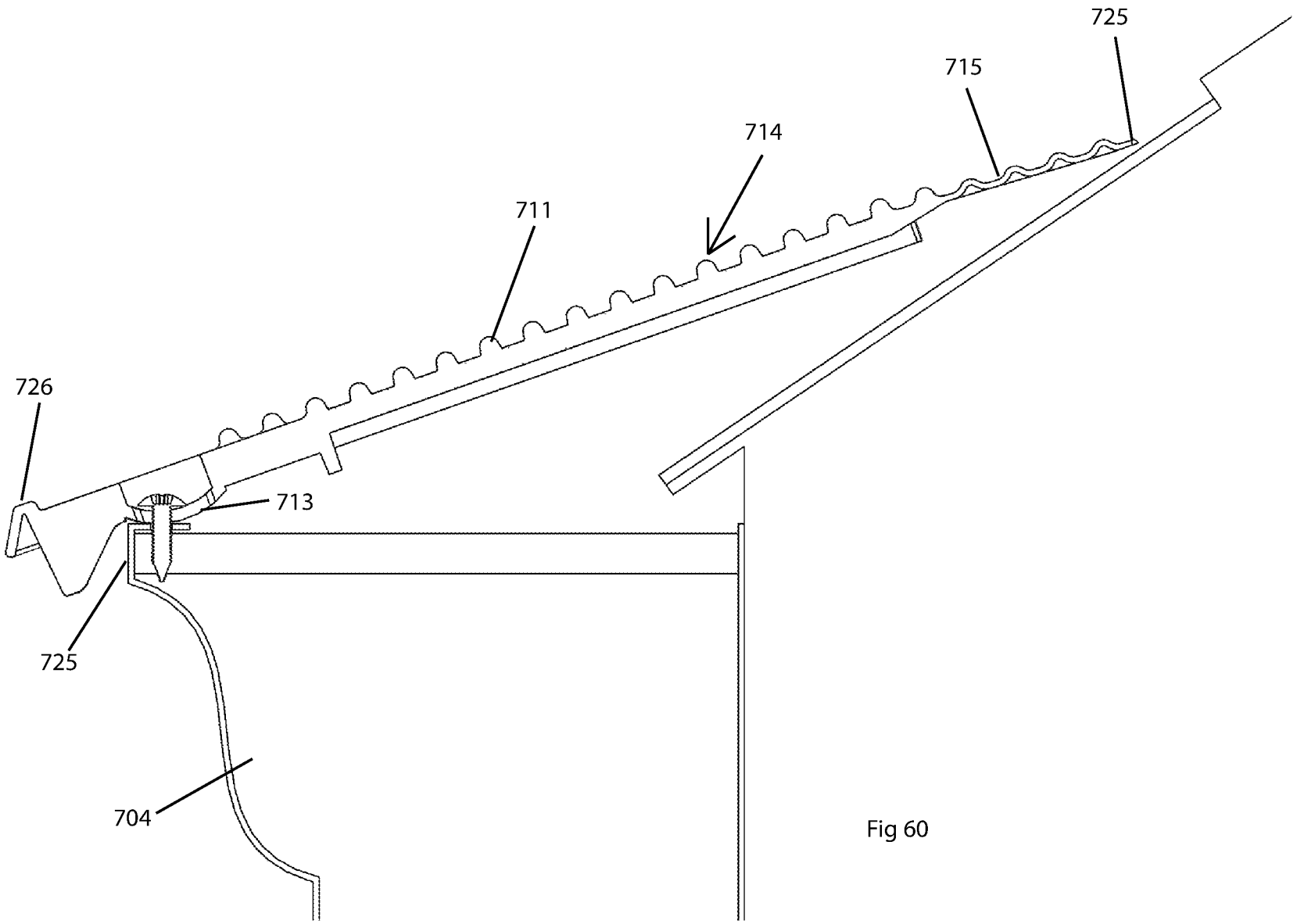
FIG. 60 is a side perspective view of the non-hinged debris collector of the disclosed technology as shown in FIG. 59.
Figure 61:
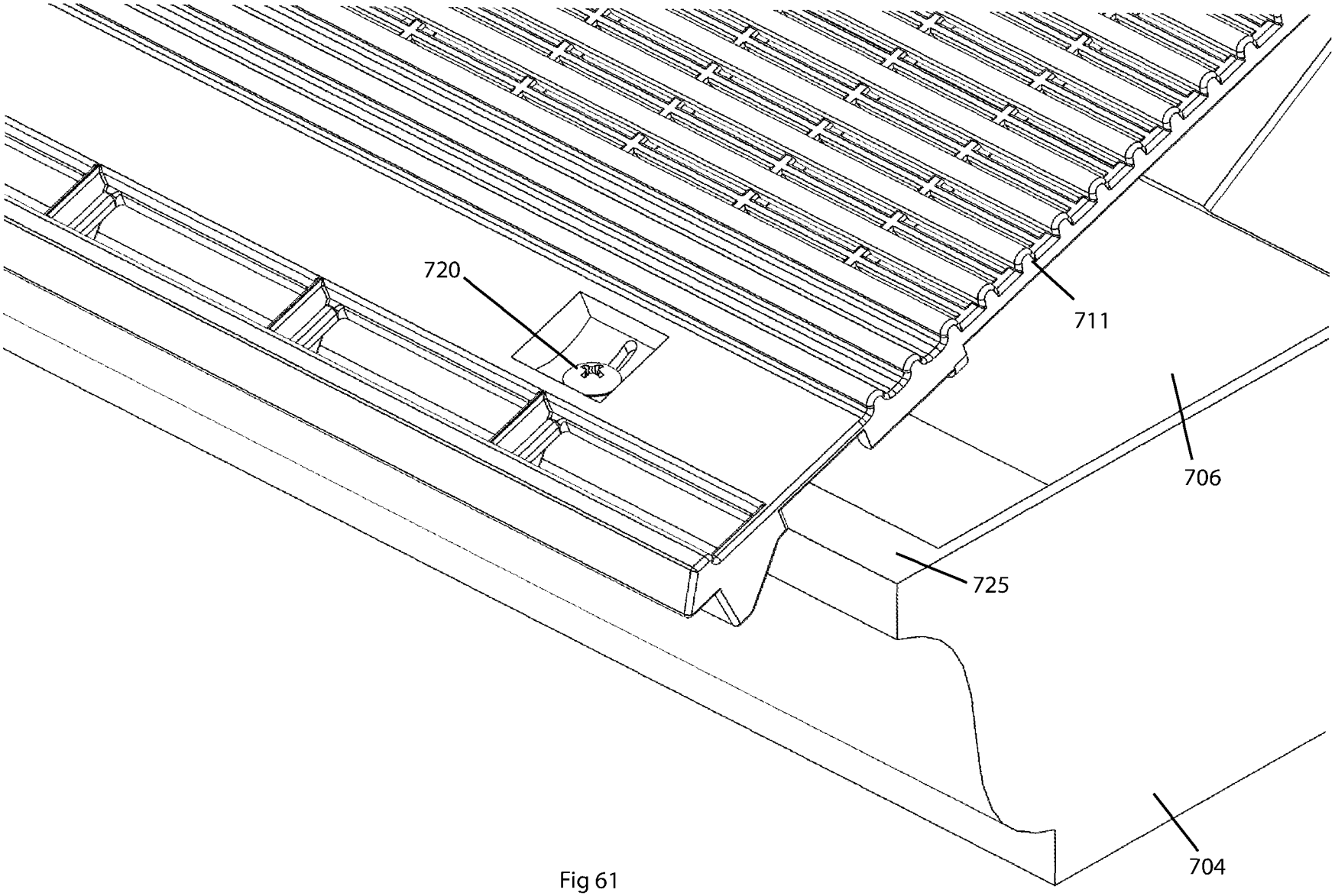
FIG. 61 is a close-up, top perspective view of the non-hinged debris collector of the disclosed technology as shown in FIG. 59.
Figure 62:
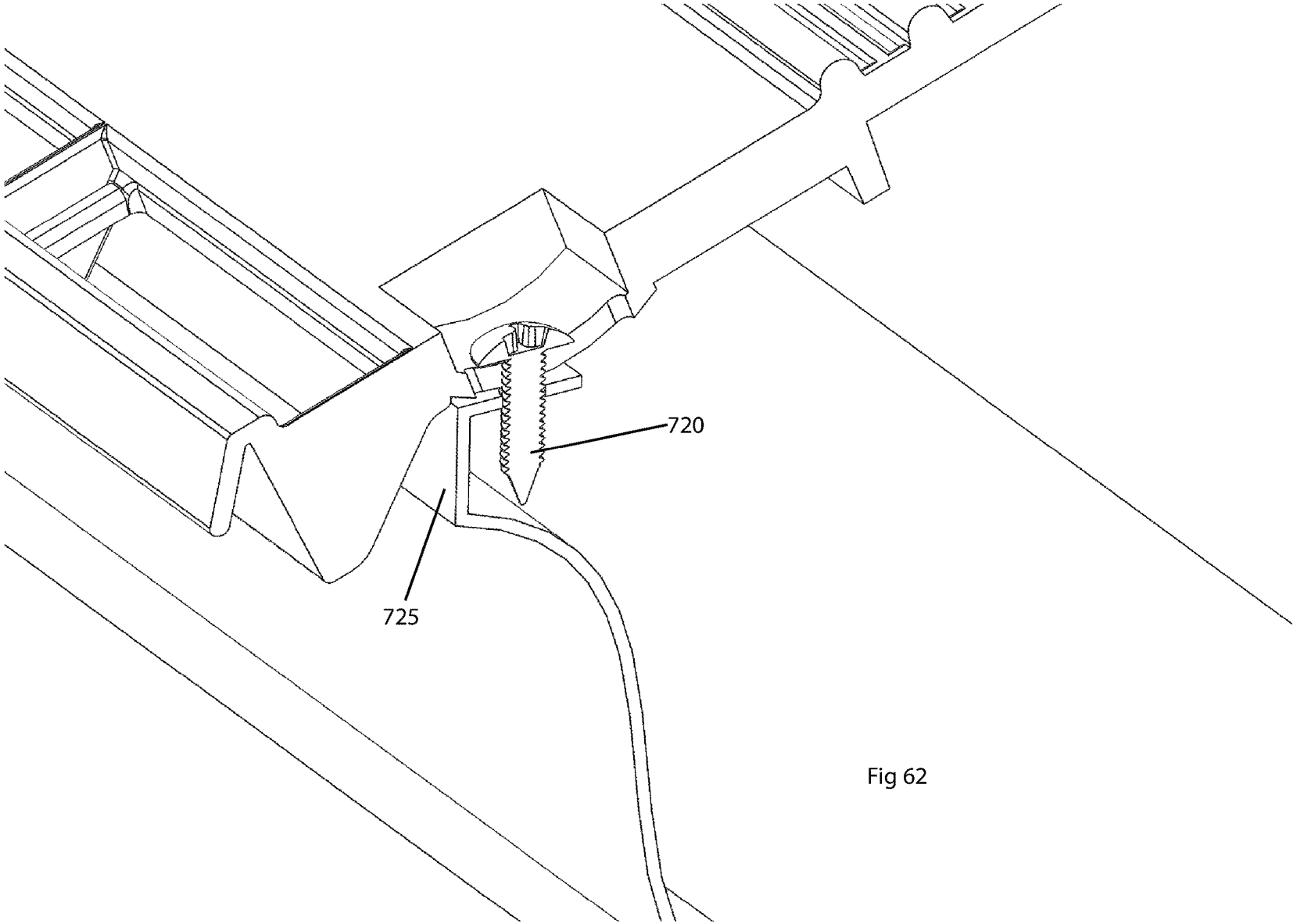
FIG. 62 is a close-up, cross-sectional view of the non-hinged debris collector of the disclosed technology as shown in FIG. 59.

In some implementations, as shown in FIGS. 49-53, a poling tool 500 can be used to rotate a debris collector 402 from the gutter 404. The poling tool can include a handle 502, a hook 506 and a connector 504. In use, the hook 506 is positioned to inside portion of the grab rail 428. A user then can pull down on the poling tool 500 thereby moving the debris collector 402 from a first position to a second position. In some implementations, as shown in FIGS. 51-53, the grab rail 428 can include a catch 450 for establishing a grab point for the poling tool 500.

In some implementations, as shown in FIGS. 54-58, a debris collector 602 can be installed on a gutter 604 of a sloped roof 606. The debris collector 602 can include a collection assembly 611 and a mounting assembly 613. The collection assembly 611 and the mounting assembly 613 can be movably connected to each other with a hinge 620. The hinge 620 allows the debris collector 602 to move from a first position to a second position. The first position allows debris to collect on a surface of the collection assembly 611 and the second position allows for removal of the debris from the collection assembly 611.

In some implementations, the collection assembly 611 can be a single unit formed from an injection molding process using polymers, thermoplastics, thermosets, elastomers and combinations thereof, e.g., including but not limited to, polyester, polyphenylene, polypropylene, polystyrene and polyvinyl. In other implementations, the collection assemblies can be made from malleable metallic materials and/or other plastic compositions and components.

The collection assembly 611 of the debris collector 602 can include a screen section 614, a front section 626 and a back edge 625.

In some implementations, the screen section 614 can include a finger section 615, a ripple section 616, a guard section 617 and guide grooves 623.

In some implementations, the finger section 615 can include a plurality of flexible fingers 615*a-n* capable of resting on the roof 606 and conforming to a shape of the roofing shingles 607. The back edge 625 and fingers 615*a-n* allow water and debris to flow from a roof surface over the ripple section 616 where the water drains through the screen section 614 and into the gutter 604 while the debris remains on a top side of the screen section 614. This provides for better water flow and does not allow debris to be caught between the back edge 625 and the roof 606.

In some implementations, the ripple section 616 can be laid out in a grid pattern and include water diverters 618*a*, 618*b*. The water diverters 618*a*, 618*b* can be formed in many shapes and configurations but in this implementation, the diverters 618*a*, 618*b* are shaped as teardrop diverters 618*a* and wedge diverters 618*b*. The tear drop diverters 618*a* and wedge diverters 618*b* are shaped so as water flows over the screen section the ripple section 616 can create surface tension thereby allowing the water flow to slow while passing over the top surface of the screen section 614. Gaps 619 can be formed between the diverters 618*a*, 618*b*. These gaps 619 can increase in size from top to bottom so as to create a venturi effect which acts like a vacuum and can pull water from the top surface of the screen section 614 through the ripple section 616 while retaining any debris that collects on a top surface of the screen section 614.

In some implementations, the guard section 617 sits above the edge of the gutter 604 and the mounting assembly 613. The guard section 617 can be rippled and allow any water that did not flow into the gutter to flow over the guard section 617 towards the front section 626.

In some implementations, the guide grooves 623 are used to create break away seams at 45-degree angles so that the screen section can be cut for creating inside and outside corners sections, described more fully below.

The front section 626 of the debris collector 602 can include a hook socket 631 for receiving a tip of poling tool. The hook socket 631 can include a grab rail 628, drip edge 640 and a V-shaped opening 641.

The grab rail 628 can be positioned and extend along the front section 626 of the collection assembly 611, but other configurations are contemplated. The grab rail 628, when actuated by a poling tool, as described in other embodiments above, acts as a lever and allows the debris collector 602 to be moved from the first position to the second position and vice versa. In use, a user can rotate the debris collector 602 from the first position to a second position via the hinge 620.

The front section 626 of the debris collector 602 can also include a tee receiver guide 629 for receiving the hinge 620. That is, the tee receiver guide 629 can comprise fingers 629*a*, 629*b* for slidably receiving a tee section 622 of the hinge 620.

The mounting assembly 613 of the debris collector 402 can include a gutter mounting section 630 and a hinge mounting section 632. The gutter mounting section 630 can be an L-shaped mount for attaching to a gutter rail of roof gutter 604. The gutter mounting section 630 can securely retain the debris collector 602 to the roof gutter system 604, as described above but other attachment mechanisms are contemplated, e.g., snap-on components. The hinge mounting section 632 can project from the gutter mounting section 630 at one end and can be fixedly attached to the hinge 620 at the other end.

The hinge 620 can include a hinge section 621 and a tee section 622. The hinge section 621 can be constructed from a flexible material, e.g., a thermoplastic elastomer/rubber while the tee section 622 can be constructed from a solid material e.g., polymers, thermoplastics, thermosets and/or elastomers. Other hinges are contemplated, e.g. piano hinges In some implementations, the gutter mounting section 630, the hinge mounting section 632, the hinge section 621 and the tee section 622 can be integrally connected to one another through a co-extrusion process. For example, the gutter mounting section 630, the hinge mounting section 632, and the tee section 622 can be constructed from a solid material e.g., polymers, thermoplastics, thermosets, elastomers while the hinge section 421 can be constructed from a flexible material, e.g., a thermoplastic elastomer/rubber. Other manufacturing processes are contemplated.

To assemble the debris collector 602, the tee section 622 of the hinge 620 can be slidably received by the tee receiver guide 629. Once in place, the mounting assembly 613 of the debris collector 602 can be screwably mounted to the gutter 604. In some implementations, the collection assembly 611 can be removed and replaced as needed.

In some implementations, as shown in FIGS. 59-62, a debris collector 702 installed on a gutter 704 attached to a sloped roof 706 can include a collection assembly 711 and a mounting assembly 713. The collection assembly 711 and the mounting assembly 713 can be fixedly connected to the gutter 704 with screws or some other type of non-hinged attachment method. The fixed debris collector 702 allows debris to collect on its top.

In some implementations, the collection assembly 711 can be a single unit formed from an injection molding process using polymers, thermoplastics, thermosets, elastomers and combinations thereof, e.g., including but not limited to, polyester, polyphenylene, polypropylene, polystyrene and polyvinyl. In other implementations, the collection assemblies can be made from malleable metallic materials and/or other plastic compositions and components.

The collection assembly 711 of the debris collector 702 can include a screen section 714, a front section 726 and a back edge 725.

In some implementations, the screen section 714 can include a finger section 715 and a ripple section 716. In some implementations, the finger section 715 can be configured to rest on the roof 706 and conform to a shape of the roofing shingles 707. This provides for better water flow and does not allow any debris to be caught between the back edge 725 and the roof. In use, the back edge 725 and fingers 715 allow water and debris to flow from a roof surface. In some implementations, the screen section 714 can be laid out in a grid pattern and include a ripple section as described above.

The gutter mounting section 730 can be a rounded mount so that the gutter mounting section 730 can be adjusted for conforming to a pitch of the roof and then attached to a gutter rail 725 of roof gutter 704 but other shapes are contemplated. The gutter mounting section 730 can securely retain the debris collector 702 to the roof gutter system 704, as described above but other attachment mechanisms are contemplated, e.g., snap-on components. In this implementation, leaves and debris can be blown off the debris collector 702.

Figure 63:
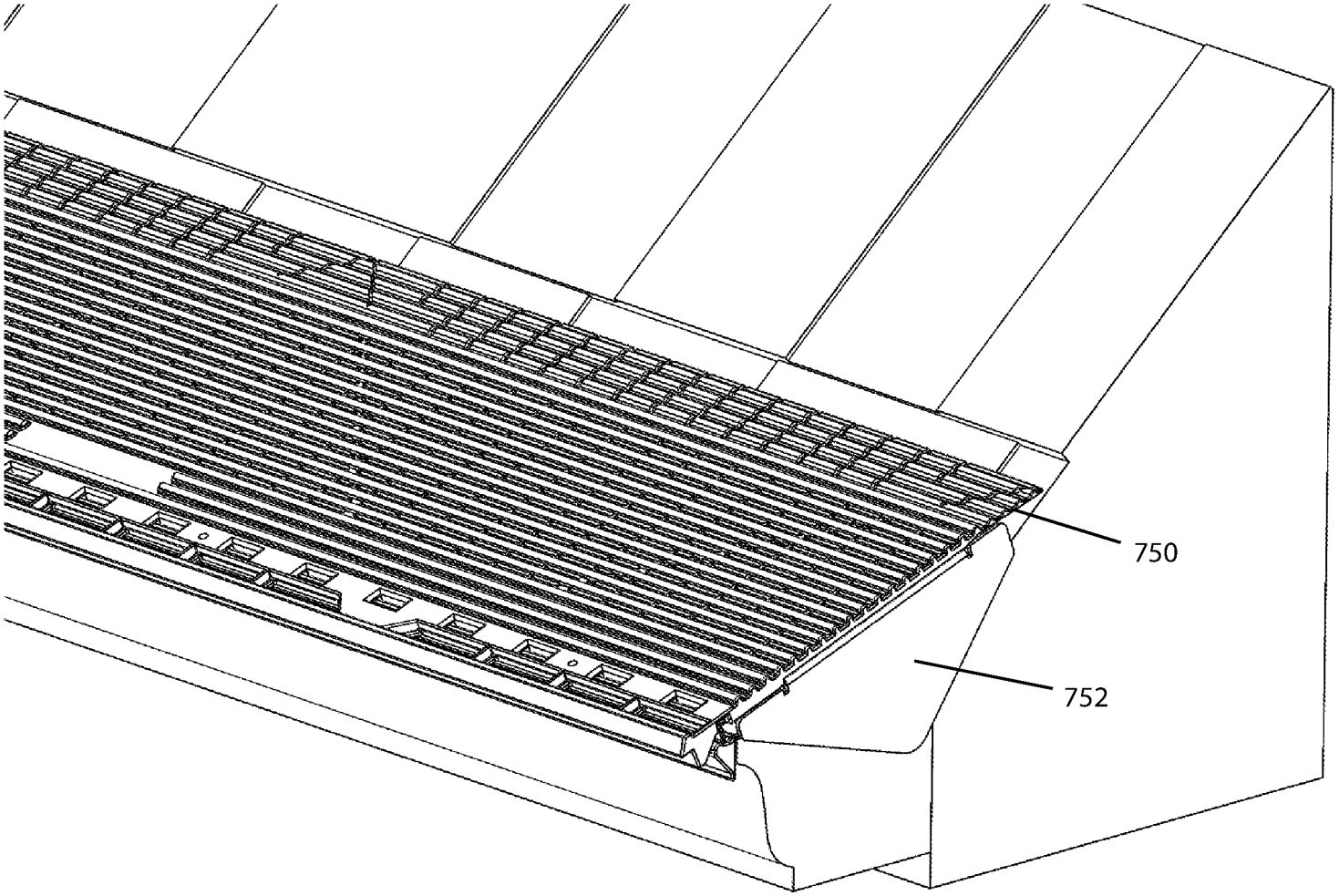
FIG. 63 is a top perspective view of a hinged debris collector of the disclosed technology in a first position having an end cap installed.
Figure 64:
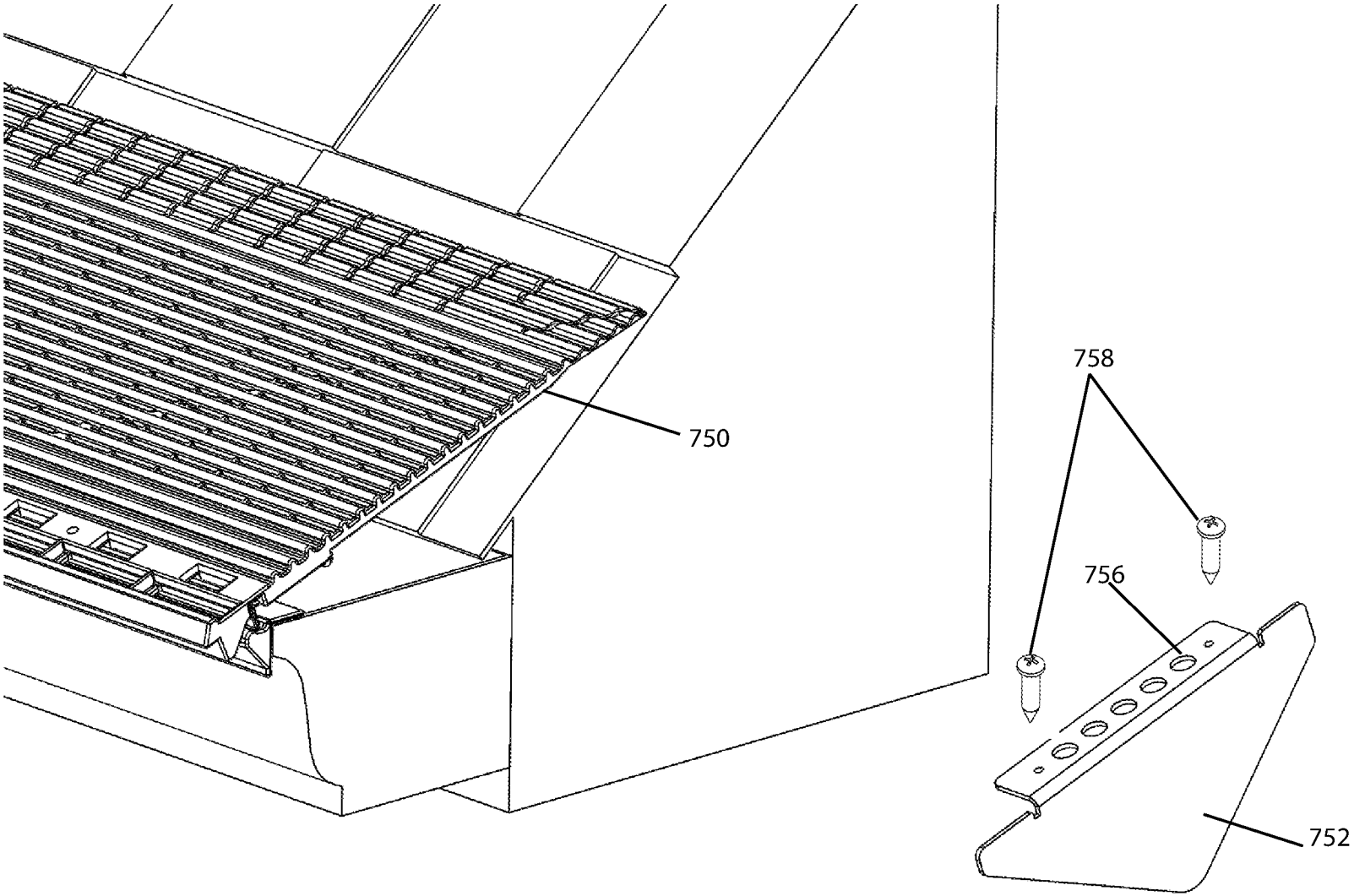
FIG. 64 is a top perspective view of the hinged debris collector of the disclosed technology, as shown in FIG. 63, with the end cap removed.
Figure 65:
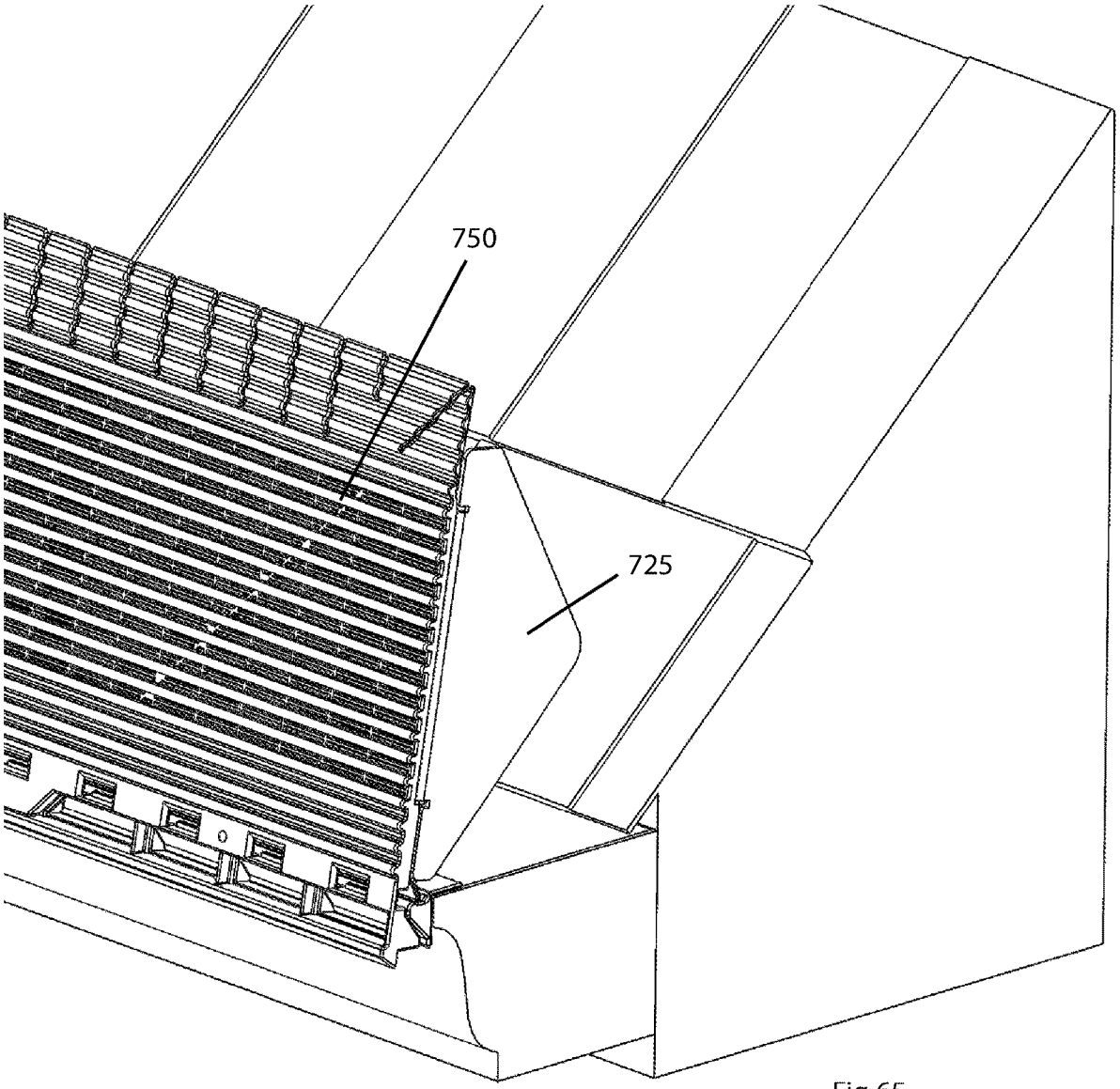
FIG. 65 is a top perspective view of the hinged debris collector of the disclosed technology, as shown in FIG. 63, in a second position with the end cap installed.
Figure 66:
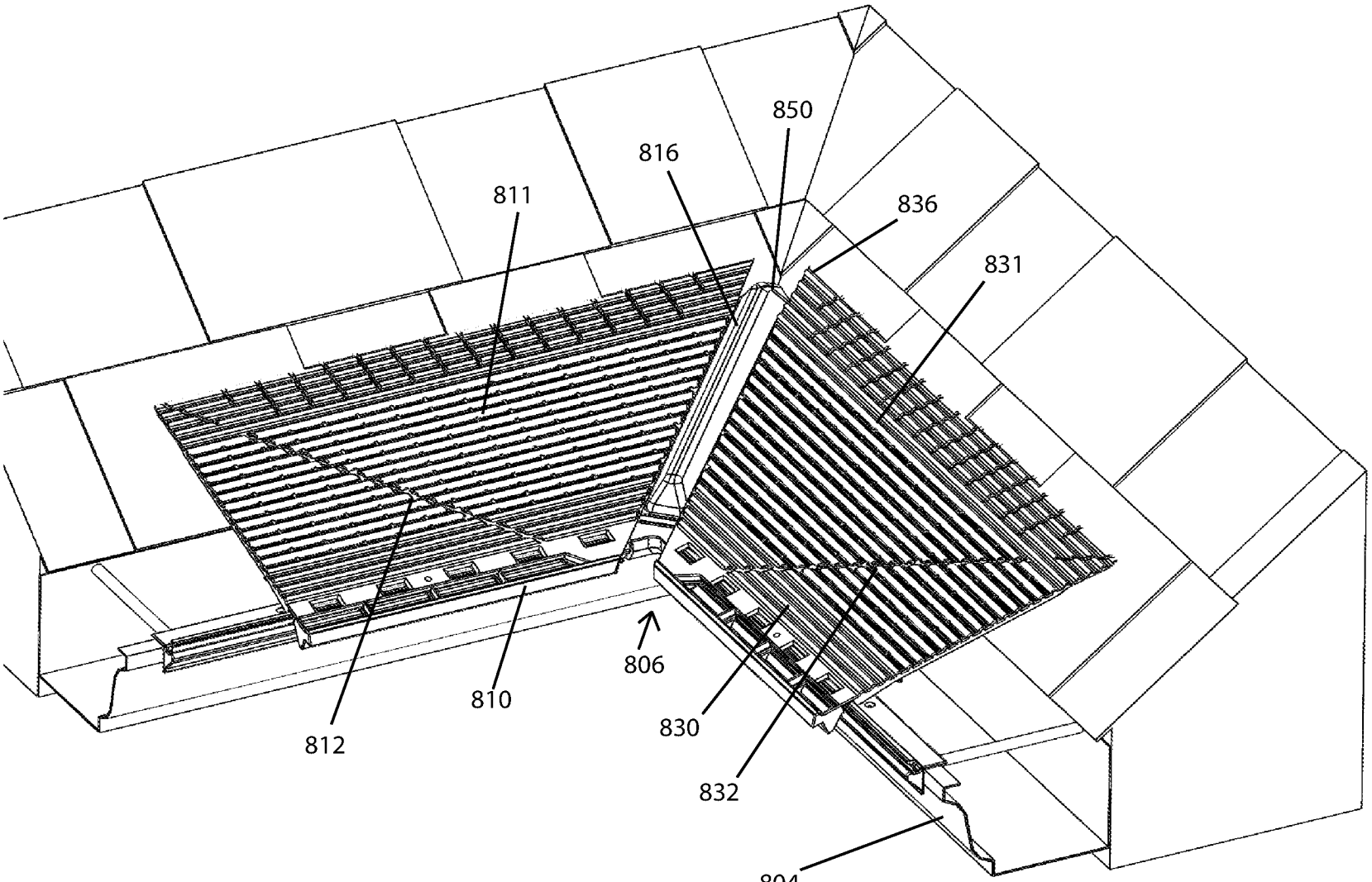
FIG. 66 is a top perspective view of inside-corner debris collectors of the disclosed technology.
Figure 67:
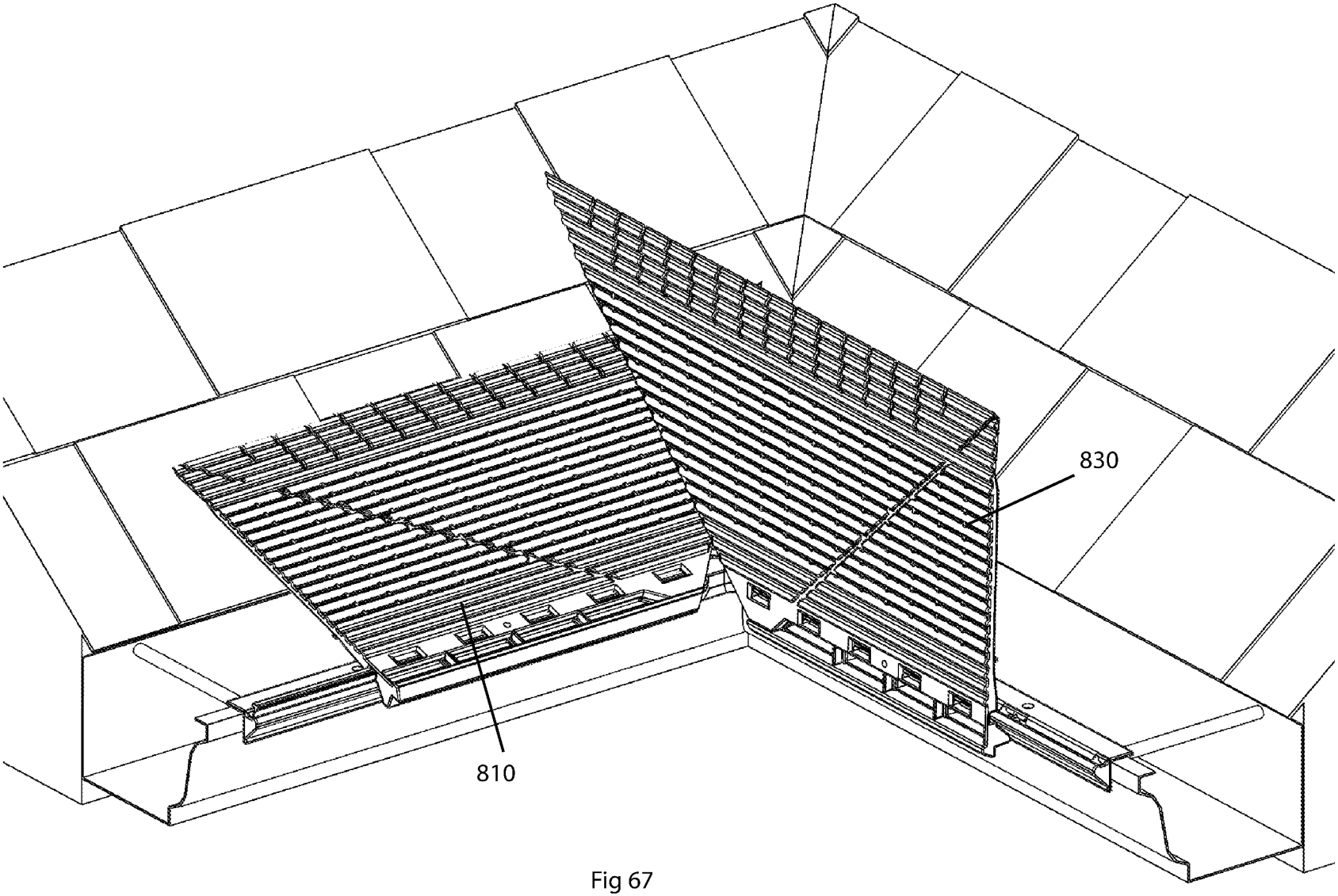
FIG. 67 is a top perspective view of the inside-corner debris collectors of the disclosed technology, as shown in FIG. 66, with a first side in a first position and a second side in a second position.
Figure 68:
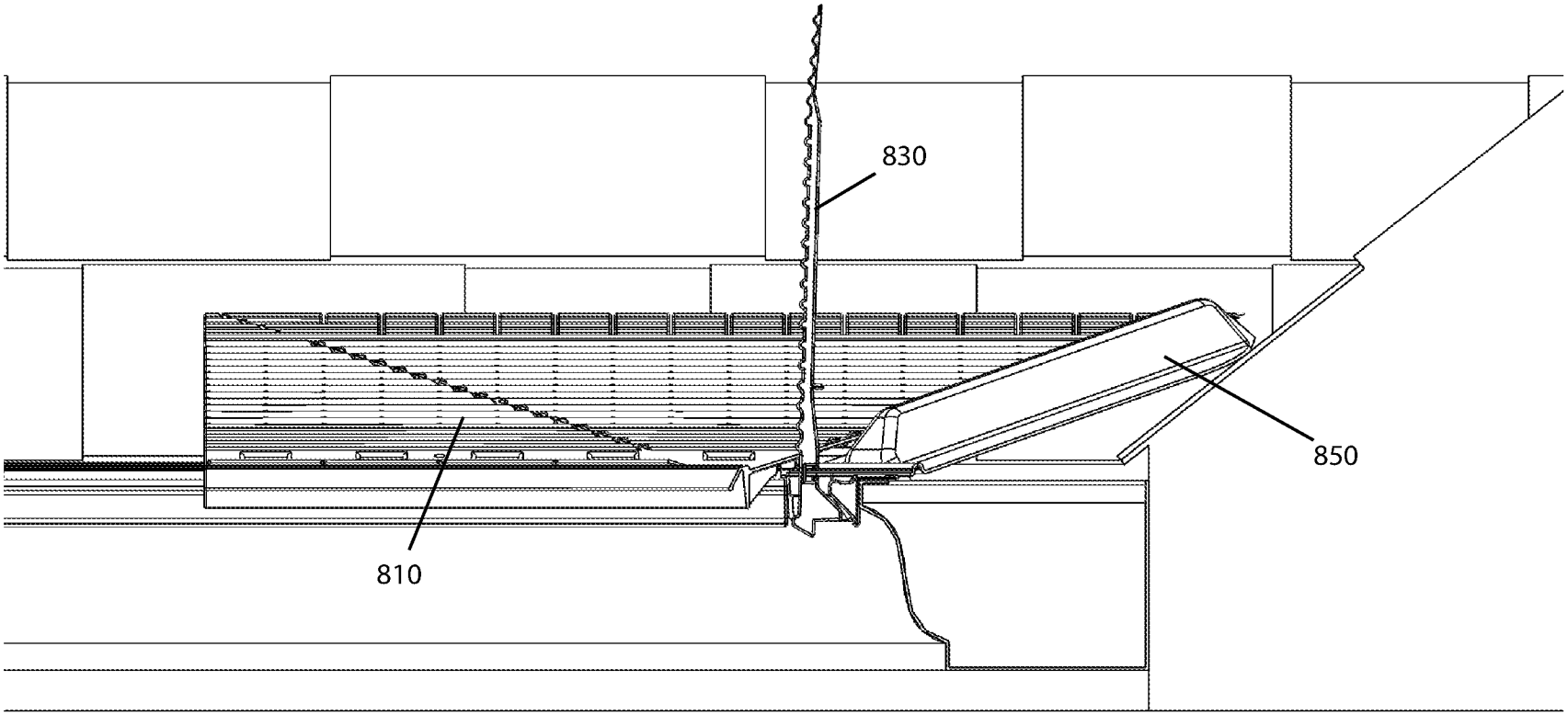
FIG. 68 is a side perspective view of the inside-corner debris collectors of the disclosed technology, as shown in FIG. 66, with a first side in a first position and a second side in a second position.
Figure 69:
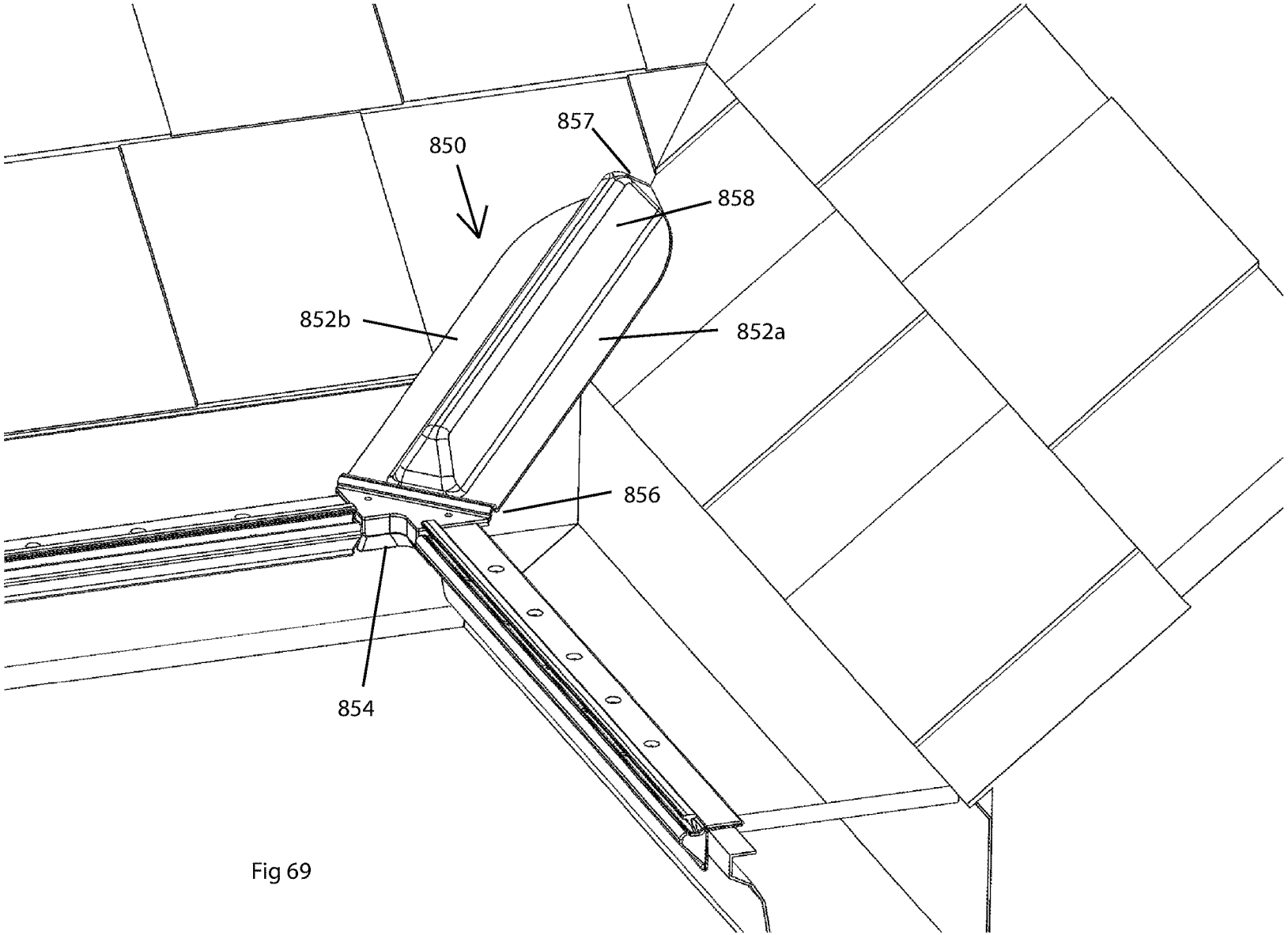
FIG. 69 is a top perspective view of a deflector of the inside-corner debris collectors of the disclosed technology, as shown in FIG. 66, in a first position.
Figure 70:
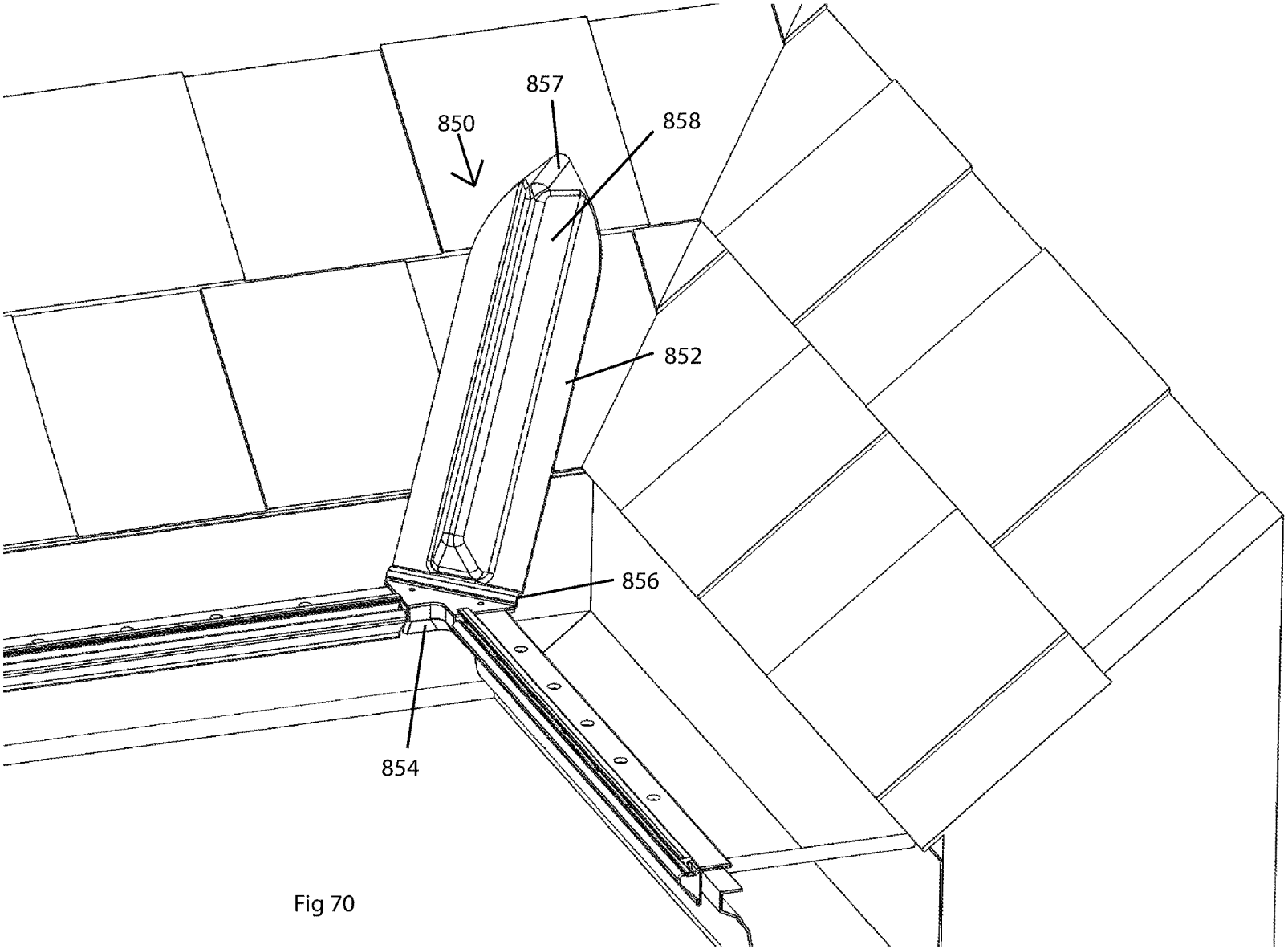
FIG. 70 is a top perspective view of the deflector of the inside-corner debris collectors of the disclosed technology, as shown in FIG. 66, in a second position.
Figure 71:
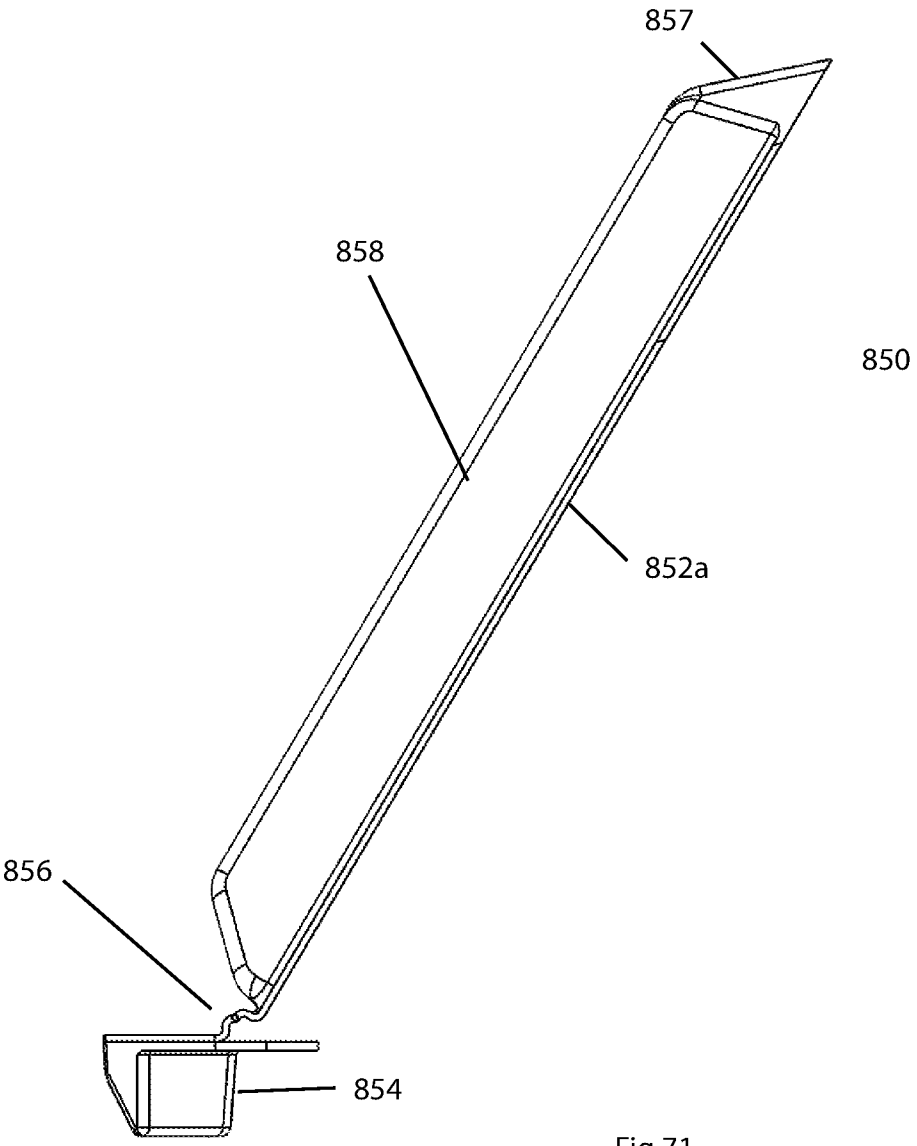
FIG. 71 is a side perspective view of the deflector of the inside-corner debris collectors of the disclosed technology, as shown in FIG. 66, in a second position.
Figure 72:
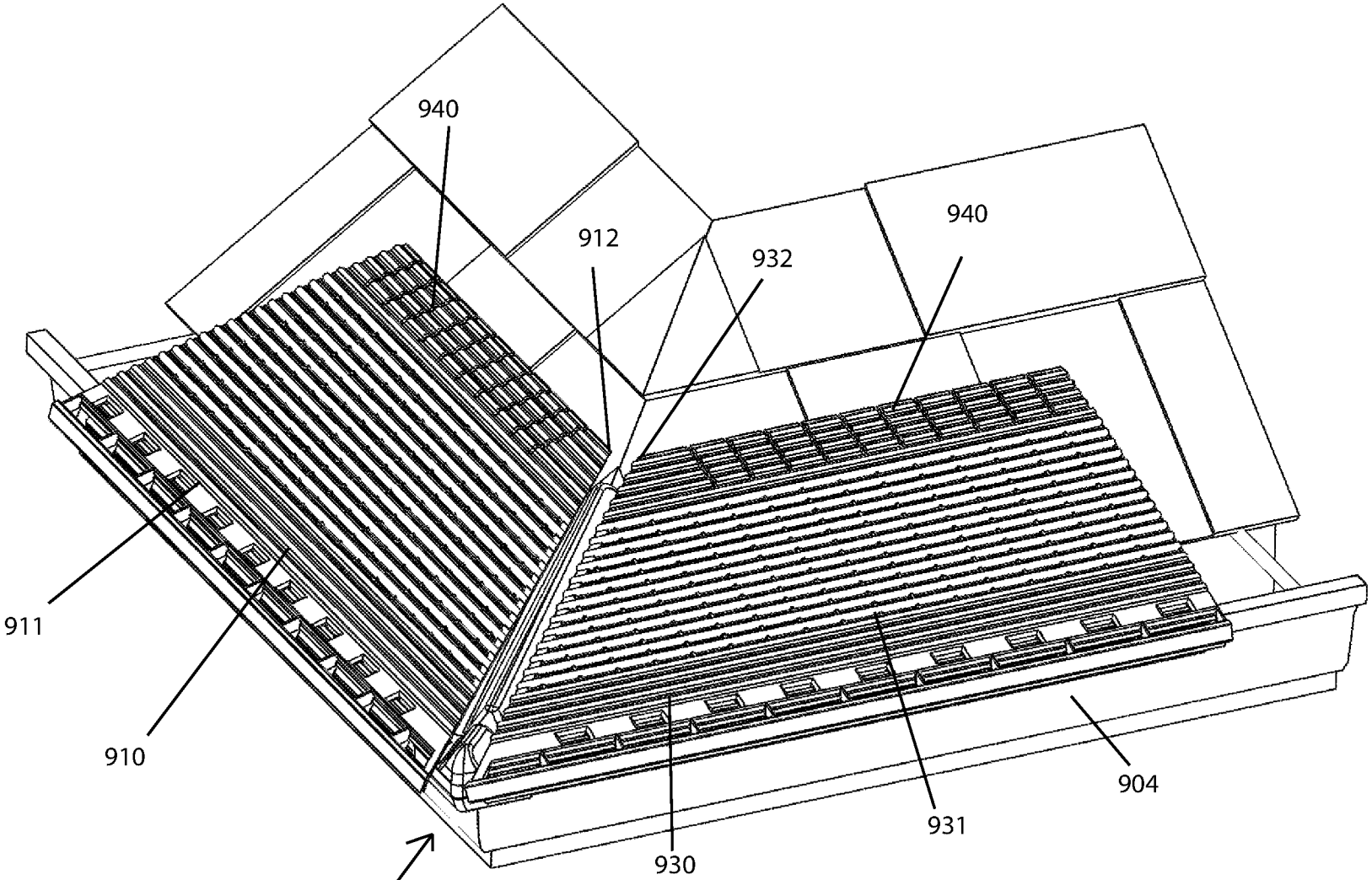
FIG. 72 is a top perspective view of outside-corner debris collectors of the disclosed technology.
Figure 73:
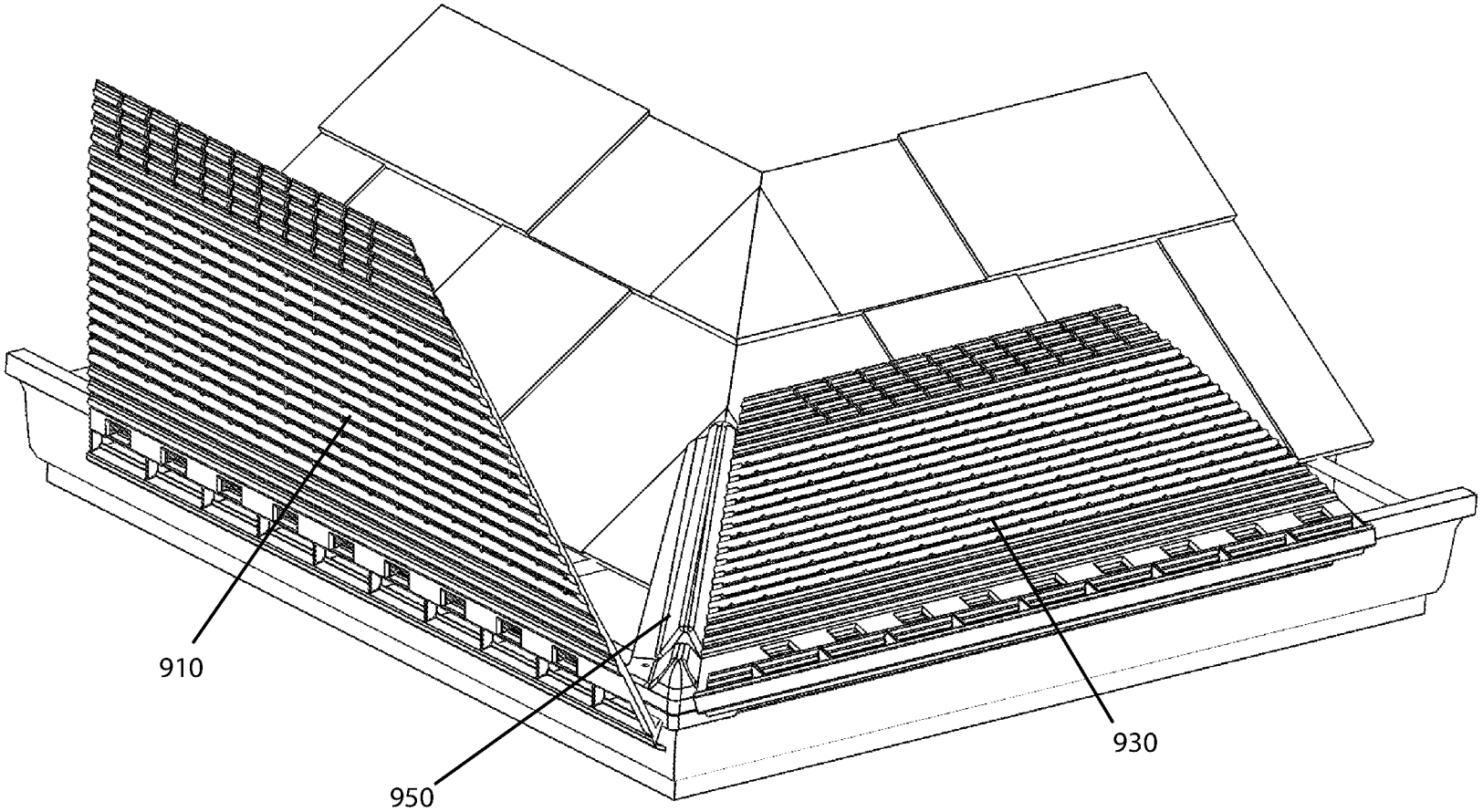
FIG. 73 is a top perspective view of the outside-corner debris collectors of the disclosed technology, as shown in FIG. 72, with a first side in a first position and a second side in a second position.
Figure 74:
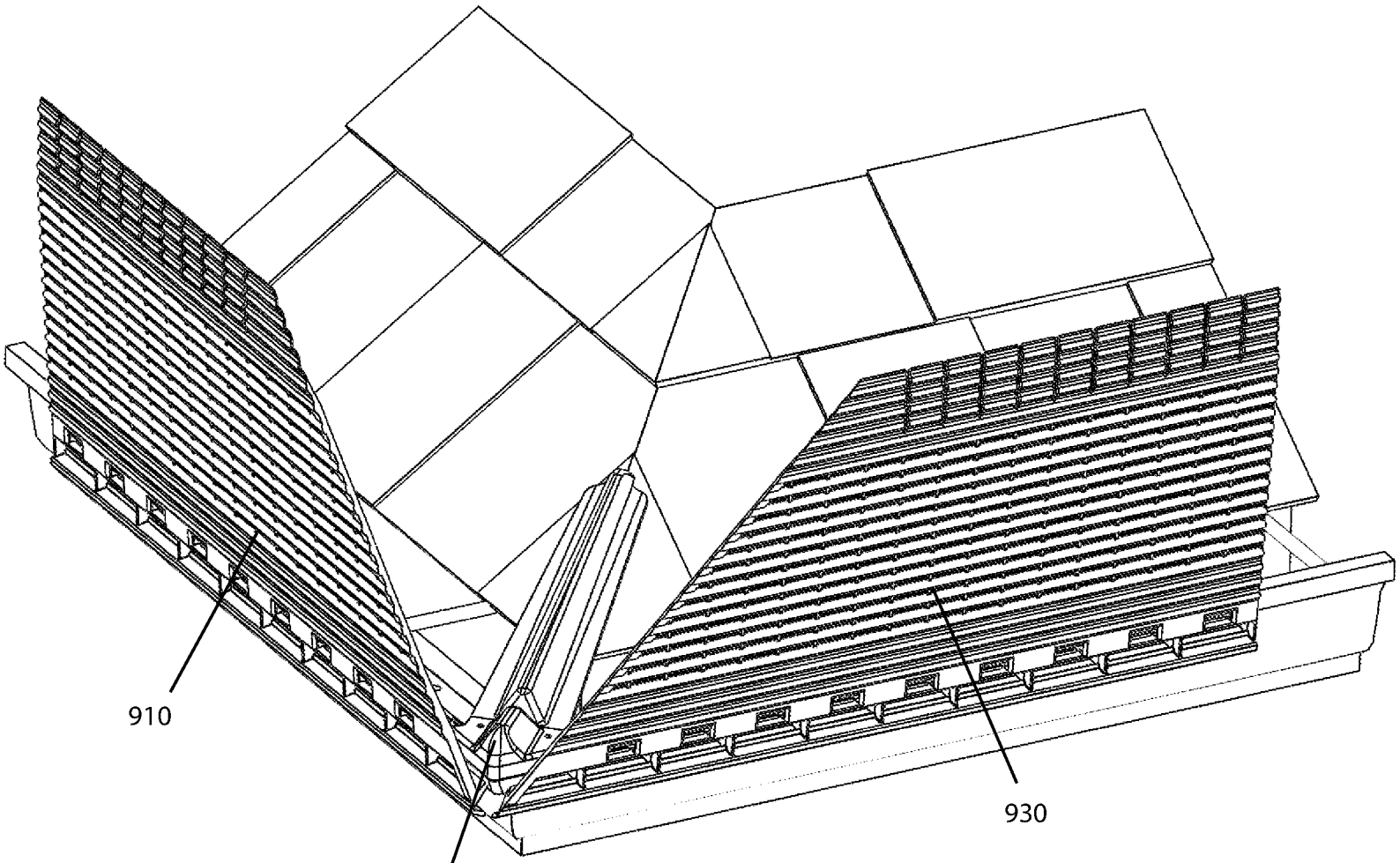
FIG. 74 is a side perspective view of the outside-corner debris collectors of the disclosed technology, as shown in FIG. 72, with a first side in a second position and a second side in a second position.
Figure 75:
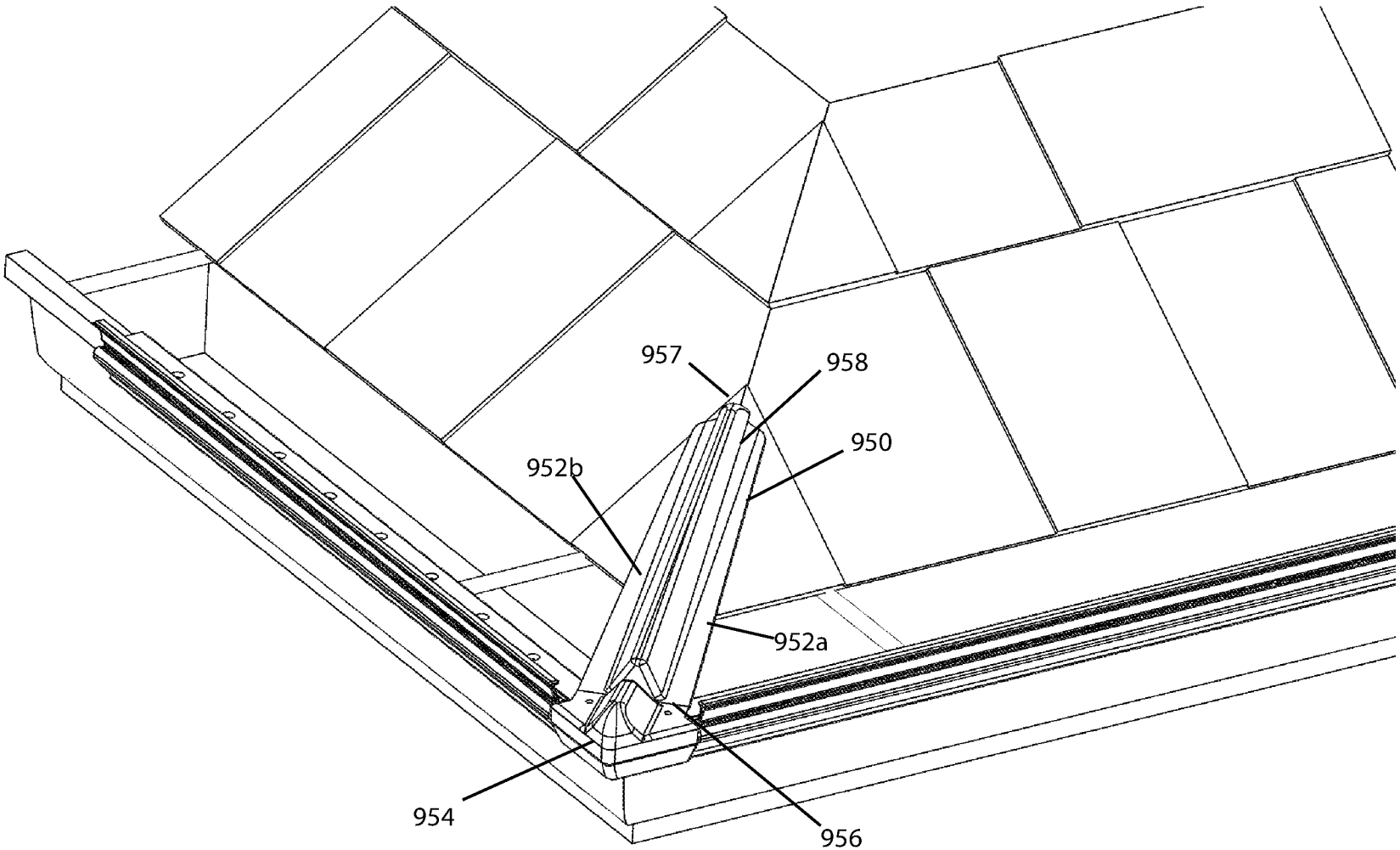
FIG. 75 is a top perspective view of a deflector of the outside-corner debris collectors of the disclosed technology, as shown in FIG. 72, in a first position.
Figure 76:
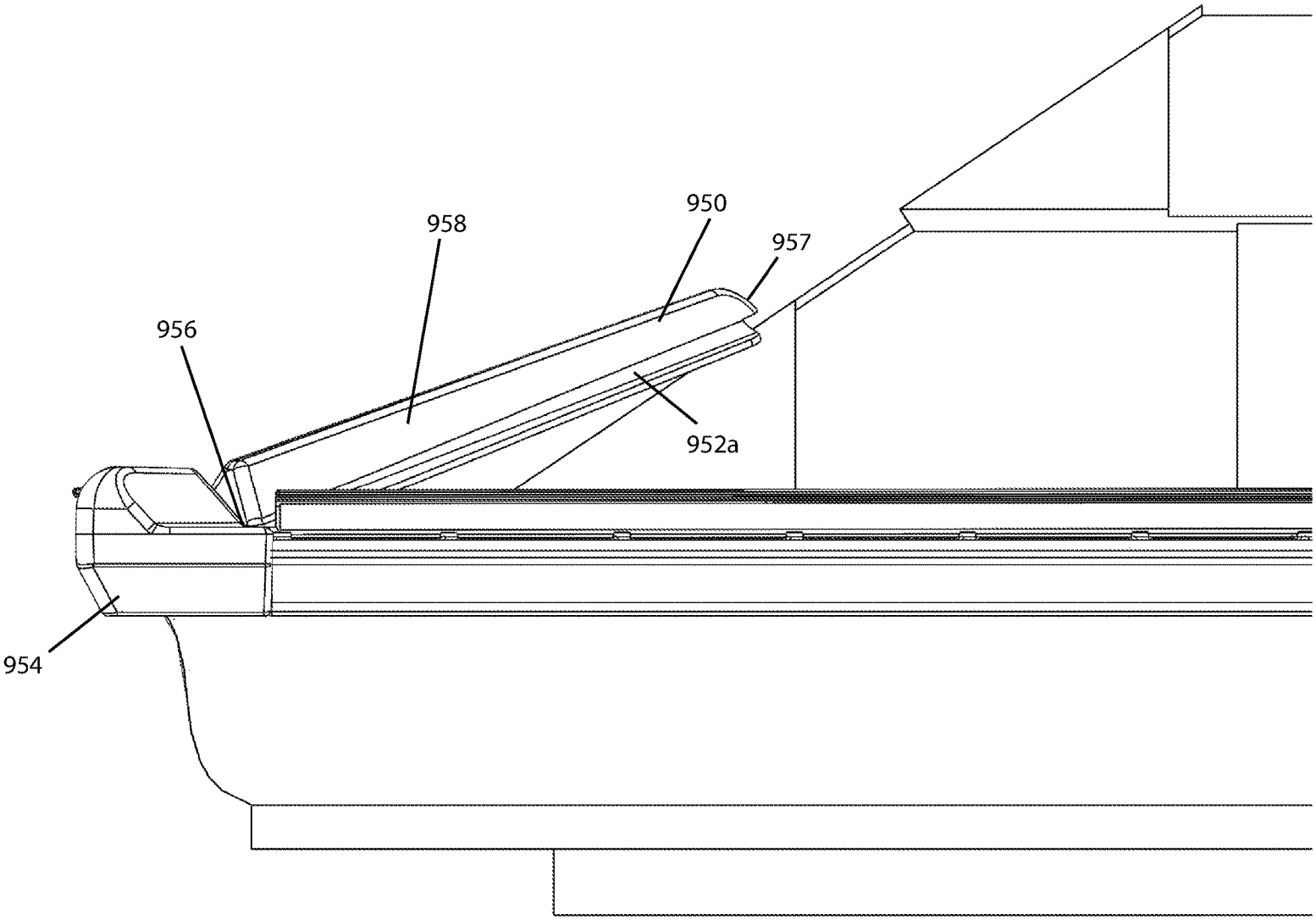
FIG. 76 is a side perspective view of the deflector of the outside-corner debris collectors of the disclosed technology, as shown in FIG. 72, in a first position.
Figure 77:
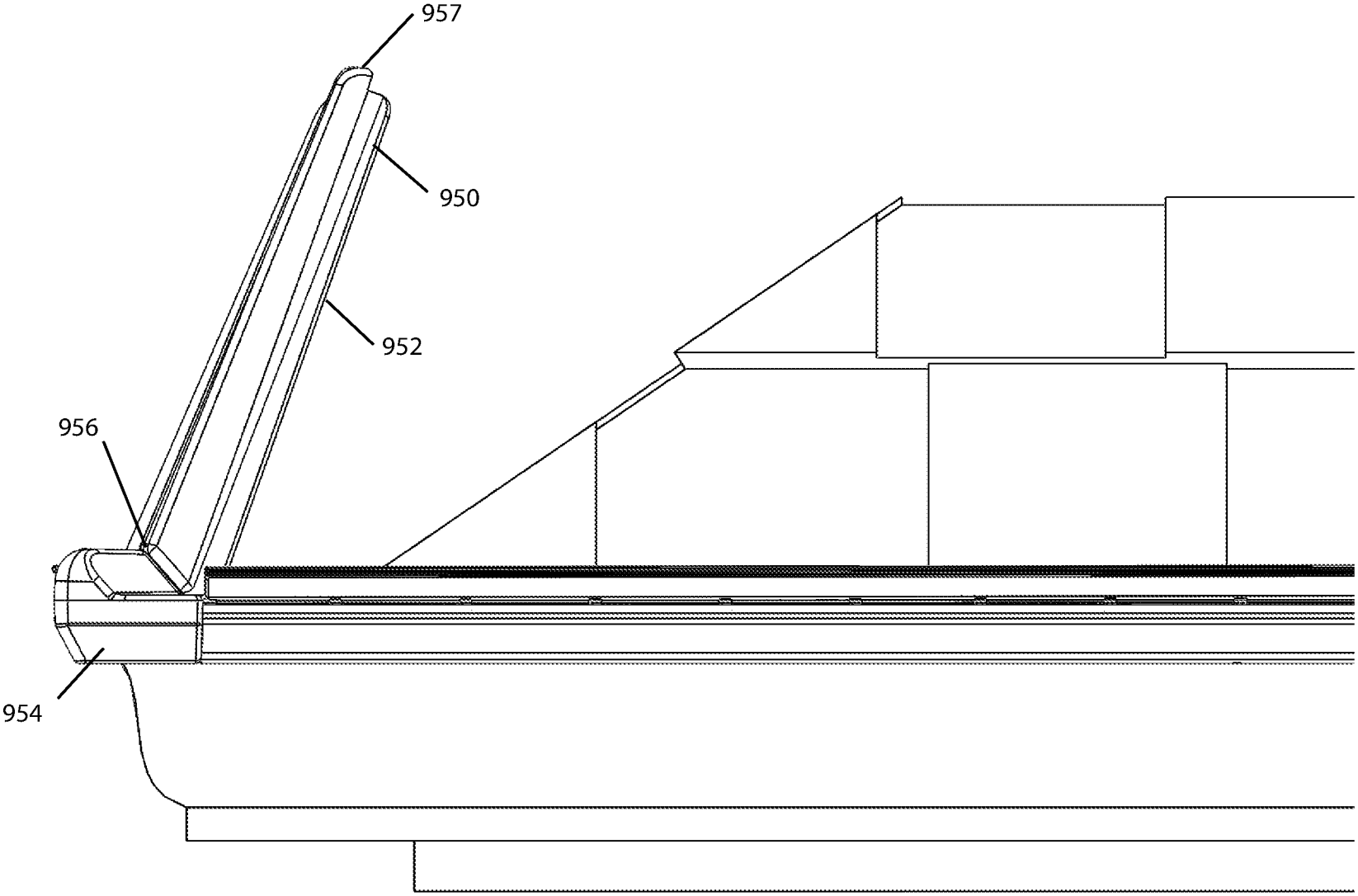
FIG. 77 is a side perspective view of the deflector of the outside-corner debris collectors of the disclosed technology, as shown in FIG. 72, in a second position.
Figure 78:
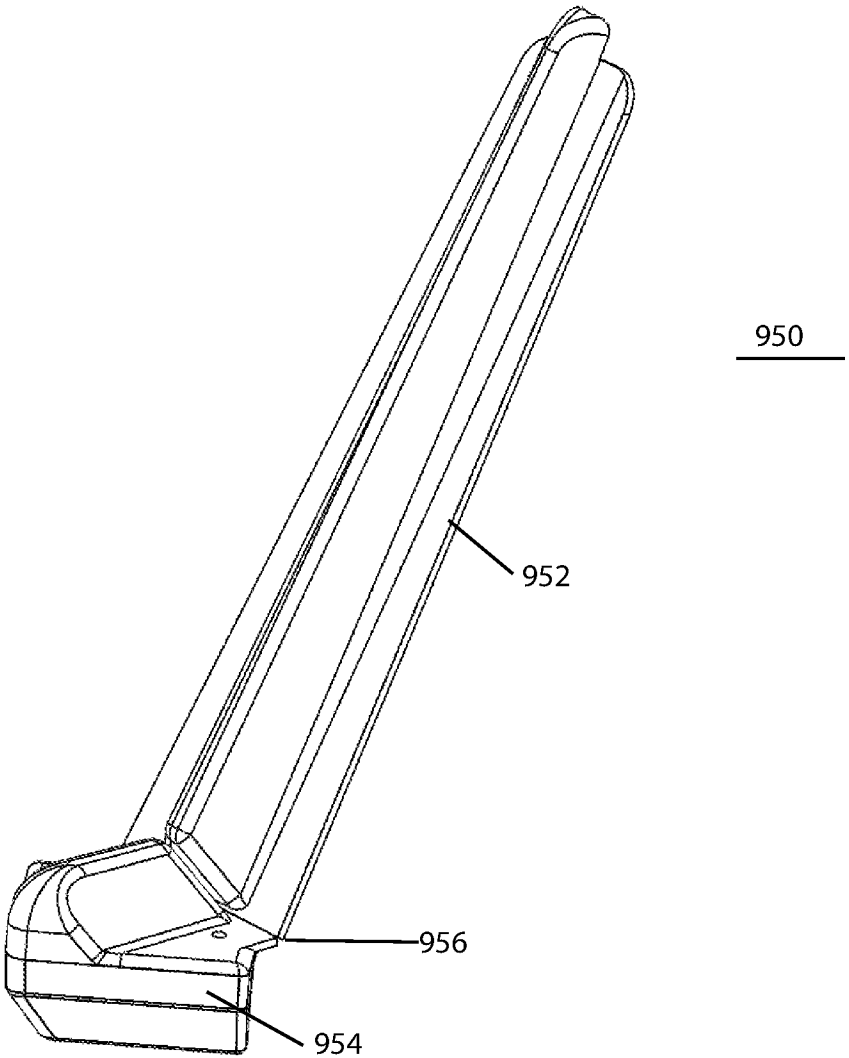
FIG. 78 is a side perspective view of the deflector of the outside-corner debris collectors of the disclosed technology, as shown in FIG. 72, in a second position.

In some implementations, a debris collector 750 can be used in conjunction with end caps 752, shown in FIGS. 63-65. The end caps can be used for aesthetic purposes and for keeping out animals and bugs. The end caps 752 can be attached to the debris collector 750 using, e.g., screws 758 attached through screw holes 756, other attachments methods are contemplated. In use, the end caps will move with the debris collector 750 as the debris collector is moved between positions as described above and shown in FIGS. 63 and 65. These end caps 752 can also be used with the fixed debris collector described above.

In some implementations, debris collector systems can be cut along guide grooves to form 45-degree edges so that two debris collectors can be placed in close proximity to each other at inside and outside corners of a gutter system. To better align and support the cut debris collectors, the cut debris collectors can be used in conjunction with corner deflectors. These corner deflectors can be arranged for inside corners or outside corners of a gutter system as described below.

Inside-corner debris collectors 810, 830, shown in FIGS. 66-71, are configured to cover a gutter 804 at an inside corner 806. The inside-corner debris collectors 810, 830 can include hinged screen sections 811, 831 respectively. The hinged screen sections 811, 831 can be cut for corner use using guide grooves 812, 832. The inside-corner debris collector 810, 830 operate as described above with other implementations of the disclosed technology with respect to a hinge allowing the inside-corner debris collectors 810, 830 to move from a first position to a second position with respect to a mount. Additionally, the inside-corner debris collectors 810, 830 can include fingers for matching a roof pitch. In some implementations, the inside-corner debris collectors 810, 830 can have a screen section be laid out in a grid pattern and can include a ripple section as described above.

In some implementations, the inside-corner debris collector 810, 830 can be used in conjunction with a valley deflector 850. The valley deflector 850 can include a ridge 858, sides 852*a-b*, a mount 854, a hinge 856 and a head 857. The hinge 856 allows the valley deflector 850 to move from a first position to a second position with respect to the mount 854 as shown on FIGS. 69-70. In use, side edges 816, 836 of the inside-corner debris collectors 810, 830 can rest on the sides 852*a-b* so as to provide support for the angled cut of the inside-corner debris collector 810, 830. The ridge 585 is positioned between the sides 852*a-b* so to allow water to run off the deflector 850 and directs leaves and debris to the sides and onto the inside-corner debris collector 810, 830 to either blow off or be flipped. The head 857 includes a V-shape so as to rest on within the roof valley and the hinge conforms to the roof pitch thereby creating an angle between the mount 854 and the head 857 that matches the angle of the inside-corner debris collector 810, 830 with respect to the roof. The valley deflector 950 can also be raised to be cleaned.

Outside-corner debris collectors 910, 930, shown in FIGS. 72-78, are configured to cover a gutter 904 at an outside corner 906. The outside-corner debris collectors 910, 930 can include hinged screen sections 911, 931 respectively. The hinged screen sections 911, 931 can be cut for corner use using guide grooves 912, 932, as described above. The outside-corner debris collector 910, 930 operate as described above with other implementations of the disclosed technology with respect to a hinge allowing the outside-corner debris collectors 910, 930 to move from a first position to a second position with respect to a mount. Additionally, the outside-corner debris collectors 910, 930 can include fingers 940 for matching a roof pitch as well as all other features described above. In some implementations, the outside-corner debris collectors 910, 930 can have a screen section be laid out in a grid pattern and can include a ripple section as described above.

In some implementations, the outside-corner debris collector 910, 930 can be used in conjunction with a hip deflector 950. The hip deflector 950 can include a ridge 958, sides 952*a-b*, a mount 954, a hinge 956 and a head 957. The hinge 956 allows the hip deflector 950 to move from a first position to a second position with respect to the mount 954 as shown on FIGS. 75-77. In use, side edges 916, 936 of the outside-corner debris collectors 910, 930 can rest on the sided 952*a-b* so as to provide support for the angled cut of the outside-corner debris collector 910, 930. The ridge 958 is positioned between the sides 952*a-b* so to allow water to run off the deflector 950850 and directs leaves and debris to the sides and onto the inside-corner debris collector 810, 830 to either blow off or be flipped. The head 957 includes an inverted V-shape so as to rest on within on roof hip and the hinge conforms to the roof pitch thereby creating an angle between the mount 954 and the head 957 that matches the angle of the inside-corner debris collector 910, 930 with respect to the roof. The hip deflector 950 can also be raised to be cleaned.

Figure 79:
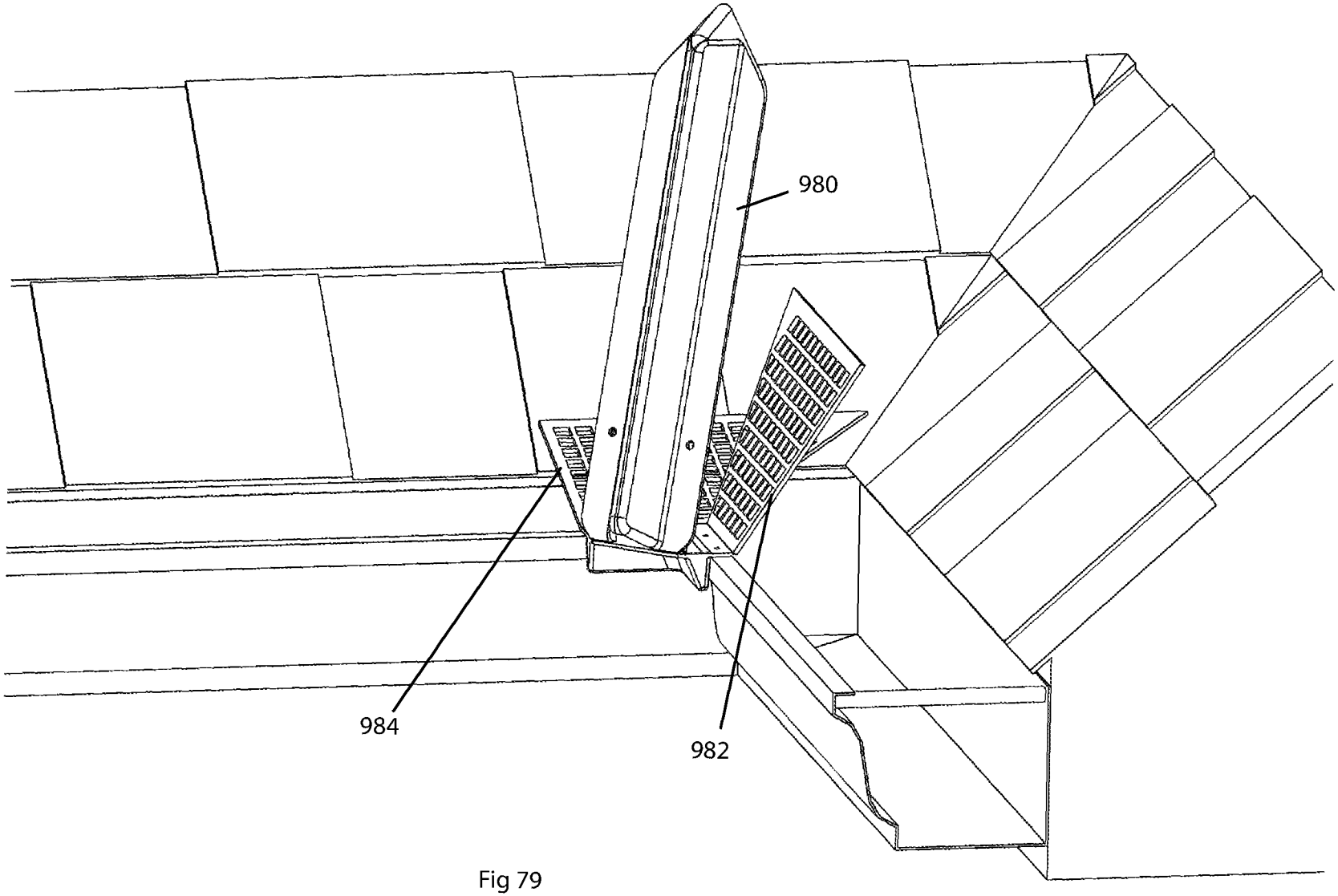
FIG. 79 is a perspective view of a deflector in a first position with side screens in a first position and a second position.
Figure 80:
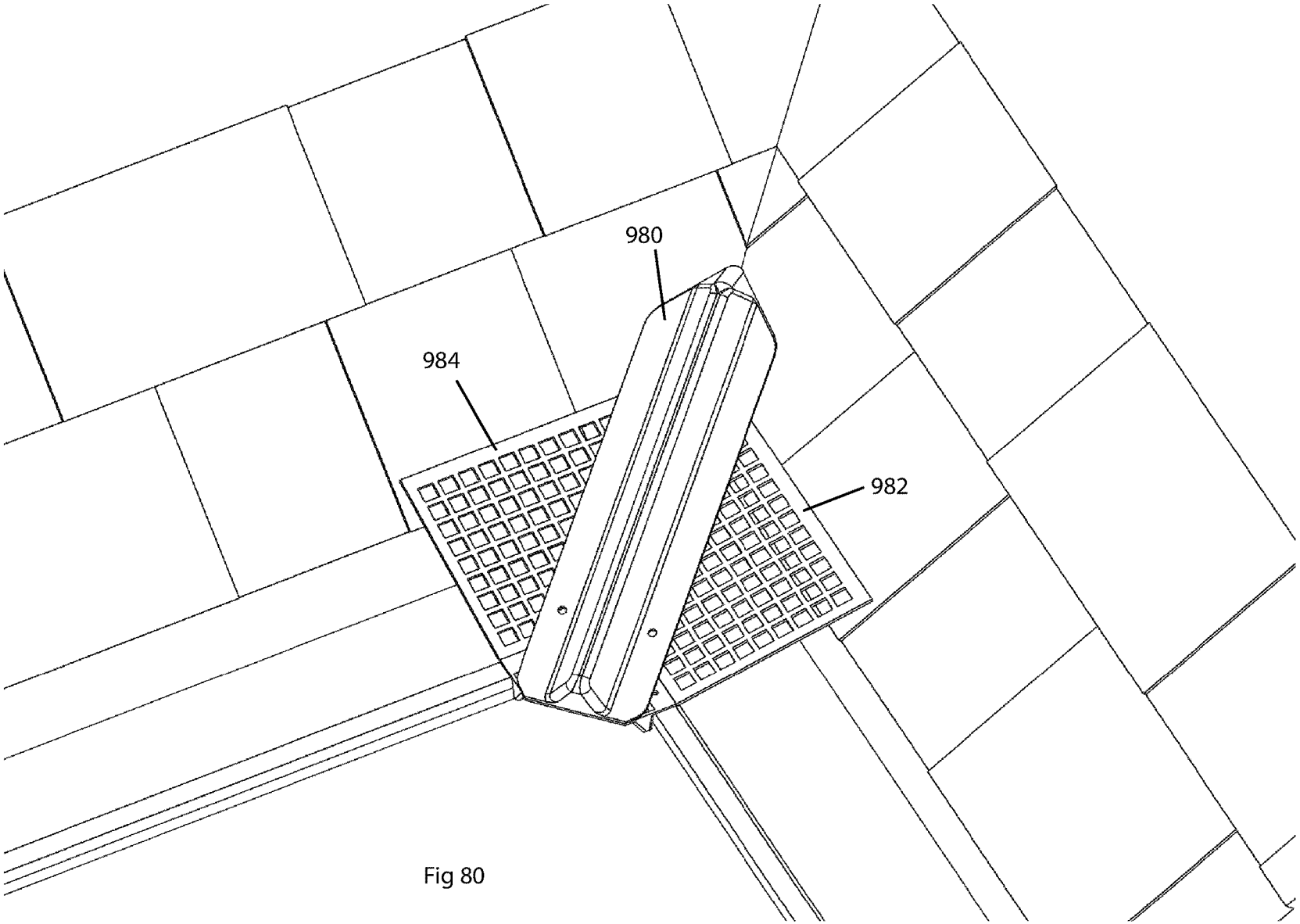
FIG. 80 is a top perspective view of a deflector with side screens, as shown in FIG. 79, in a first position.

In another implementations, a corner deflector 980 can include side screen sections 982, 984 that can also be moved between a first position and a second position as needed, as shown in FIGS. 79 and 80.

While presently preferred embodiments have been described for purposes of the disclosure, numerous changes in the arrangement can be made by those skilled in the art. Such changes are encompassed within the spirit of the invention as defined by the appended claims.

The foregoing Detailed Description is to be understood as being in every respect illustrative and exemplary, but not restrictive, and the scope of the disclosed technology disclosed herein is not to be determined from the Detailed Description, but rather from the claims as interpreted according to the full breadth permitted by the patent laws. It is to be understood that the embodiments shown and described herein are only illustrative of the principles of the disclosed technology and that various modifications may be implemented by those skilled in the art without departing from the scope and spirit of the disclosed technology. Those skilled in the art could implement various other feature combinations without departing from the scope and spirit of the disclosed technology. Although the embodiments of the present disclosure have been described with specific examples, it is to be understood that the disclosure is not limited to those specific examples and that various other changes, combinations and modifications will be apparent to one of ordinary skill in the art without departing from the scope and spirit of the disclosed technology which is to be determined with reference to the following claims.

The invention claimed is:

1. An apparatus for catching debris comprising:

a collection assembly, the collection assembly including a screen section, the screen section including a plurality of diverters, the plurality of diverters including rows of alternating teardrop diverters and wedge diverters, the teardrop diverters and the wedge diverters being spaced apart from one another so as form a gap between the teardrop diverters and the wedge diverters, the gap widening in a downward direction from a top surface of the screen section to a bottom surface of the screen section; and a mounting assembly configured to be attached to a gutter system, the mounting assembly including a hinge that pivotally connects the mounting assembly to the collection assembly such that the collection assembly is movable between a first position and a second position.

2. The apparatus of claim 1 wherein the screen section further includes a plurality of fingers located along a back edge of the screen section, the plurality of fingers being flexible and allowing the plurality of fingers to conform to a roof surface.

3. The apparatus of claim 1 wherein the mounting assembly is fixedly attached to the gutter system.

4. The apparatus of claim 1 wherein the collection assembly is fixedly attached to the gutter system.

5. The apparatus of claim 1 wherein the plurality of diverters are configured to break water tension and slow water flow as water flows over the top surface of the screen section from a roof surface.

6. The apparatus of claim 5 wherein the teardrop diverters and the wedge diverters create a venturi effect as water is drained from the top surface of the screen section into the gutter system.

7. The apparatus of claim 1 wherein the screen section includes guide grooves for creating corners angles for the screen section.

8. The apparatus of claim 7 wherein the guide grooves are configured to be supported by deflectors.

9. An apparatus for catching debris comprising:

a collection assembly, the collection assembly including a screen section, the screen section including a plurality of fingers located along a back edge of the screen section, the plurality of fingers including bumps and ridges, the bumps and ridges configured to slow a speed of a water flow from a roof surface, the plurality of fingers being flexible such that the plurality of fingers conform to the roof surface; and a mounting assembly configured to be attached to a gutter system, the mounting assembly including a hinge that pivotally connects the mounting assembly to the collection assembly such that the collection assembly is movable between a first position and a second position.

10. The apparatus of claim 9 wherein the mounting assembly is fixedly attached to the gutter system.

11. The apparatus of claim 9 wherein the collection assembly is fixedly attached to the gutter system.

12. The apparatus of claim 9 wherein the screen section includes guide grooves for creating corners angles for the screen section.

13. The apparatus of claim 12 wherein the guide grooves are configured to be supported by deflectors.

14. The apparatus of claim 9 wherein the screen section further includes a plurality of diverters configured to break water tension and slow water flow as water flows over the plurality of diverters from the roof surface, the plurality of diverters being spaced apart from one another in such a way that the slowed water is capable of draining into the gutter system from the screen section.

15. The apparatus of claim 14 wherein the plurality of diverters include teardrop diverters and wedge diverters.

16. The apparatus of claim 15 wherein a configuration of the teardrop diverters and the wedge diverters creates gaps between the teardrop diverters and the wedge diverters increasing in size from top to bottom thereby creating a venturi effect as water is drained into the gutter system.

* * * * *